US008238586B2

(12) United States Patent
Qian et al.

(10) Patent No.: US 8,238,586 B2
(45) Date of Patent: Aug. 7, 2012

(54) THERMOACOUSTIC DEVICE

(75) Inventors: Li Qian, Beijing (CN); Yu-Quan Wang, Beijing (CN); Chen Feng, Beijing (CN); Liang Liu, Beijing (CN)

(73) Assignee: Beijing FUNATE Innovation Technology Co., Ltd., Beijing (CN)

( * ) Notice: Subject to any disclaimer, the term of this patent is extended or adjusted under 35 U.S.C. 154(b) by 314 days.

(21) Appl. No.: 12/661,925

(22) Filed: Mar. 25, 2010

(65) Prior Publication Data

US 2010/0188935 A1 Jul. 29, 2010

Related U.S. Application Data

(63) Continuation of application No. 12/655,398, filed on Dec. 30, 2009.

(30) Foreign Application Priority Data

| | | |
|---|---|---|
| Dec. 30, 2008 | (CN) | 2008 1 0191730 |
| Dec. 30, 2008 | (CN) | 2008 1 0191733 |
| Dec. 30, 2008 | (CN) | 2008 1 0191734 |
| Dec. 30, 2008 | (CN) | 2008 1 0191735 |
| Dec. 30, 2008 | (CN) | 2008 1 0191736 |
| Dec. 30, 2008 | (CN) | 2008 1 0191738 |
| Jan. 15, 2009 | (CN) | 2009 1 0000259 |
| Aug. 28, 2009 | (CN) | 2009 1 0169652 |
| Sep. 11, 2009 | (CN) | 2009 1 0170294 |

(51) Int. Cl.
*H04R 25/00* (2006.01)

(52) U.S. Cl. ..... 381/164; 381/394; 381/111

(58) Field of Classification Search ..... 381/111, 381/164, 394
See application file for complete search history.

(56) References Cited

U.S. PATENT DOCUMENTS 1,526,778 A * 2/1925 De Forest ..... 381/164
(Continued)

FOREIGN PATENT DOCUMENTS

CN 2425468 3/2001
(Continued)

OTHER PUBLICATIONS

Swift Gregory W., Thermoacoustic Engines and Refrigerators, Physics Today, Jul. 1995, pp. 22-28, vol. 48.

(Continued)

*Primary Examiner* — Curtis Kuntz
*Assistant Examiner* — Ryan Robinson
(74) *Attorney, Agent, or Firm* — Altis Law Group, Inc.

(57) ABSTRACT

A thermoacoustic device includes a sound wave generator, a number of first electrodes and a number of second electrodes. The sound wave generator includes a carbon nanotube structure. The second electrodes and the first electrodes are separately connected to the sound wave generator. The second electrodes and the first electrodes are parallel to each other and are alternately arranged at uniform intervals. A working voltage applied to the first and second electrodes is less than or equal to about 50 volts. The sound wave generator and the first and second electrodes satisfy a formula of $$1\Omega \le \frac{R_1}{(n-1)^2} \le 125\Omega.$$

Wherein R1 represents a resistance of the sound wave generator in the direction from the first electrodes to the second electrodes, and n represents a sum of the total number of the first electrodes and the second electrodes.

20 Claims, 28 Drawing Sheets

U.S. PATENT DOCUMENTS

| | | | | |
|---|---|---|---|---|
| 1,528,774 | A | 3/1925 | Kranz | |
| 4,002,897 | A | 1/1977 | Kleinman et al. | |
| 4,334,321 | A | 6/1982 | Edelman | |
| 4,503,564 | A | 3/1985 | Edelman et al. | |
| 4,641,377 | A | 2/1987 | Rush et al. | |
| 4,766,607 | A | 8/1988 | Feldman | |
| 5,694,477 | A | 12/1997 | Kole | |
| 6,473,625 | B1 | 10/2002 | Williams et al. | |
| 6,777,637 | B2 | 8/2004 | Nakayama et al. | |
| 6,803,116 | B2 | 10/2004 | Ikeda | |
| 6,808,746 | B1 | 10/2004 | Dai et al. | |
| 6,921,575 | B2 | 7/2005 | Horiuchi et al. | |
| 7,045,108 | B2 | 5/2006 | Jiang et al. | |
| 7,393,428 | B2 | 7/2008 | Huang et al. | |
| 7,474,590 | B2 * | 1/2009 | Watabe et al. | 367/140 |
| 7,723,684 | B1 | 5/2010 | Haddon et al. | |
| 7,799,163 | B1 | 9/2010 | Mau et al. | |
| 8,094,840 | B2 * | 1/2012 | Miyachi | 381/164 |
| 2001/0005272 | A1 | 6/2001 | Buchholz | |
| 2001/0048256 | A1 | 12/2001 | Miyazaki et al. | |
| 2002/0076070 | A1 | 6/2002 | Yoshikawa et al. | |
| 2005/0040371 | A1 | 2/2005 | Watanabe et al. | |
| 2005/0201575 | A1 | 9/2005 | Koshida et al. | |
| 2006/0104451 | A1 | 5/2006 | Browning et al. | |
| 2006/0147081 | A1 | 7/2006 | Mango, III et al. | |
| 2006/0264717 | A1 | 11/2006 | Pesach et al. | |
| 2007/0166223 | A1 | 7/2007 | Jiang et al. | |
| 2008/0095694 | A1 | 4/2008 | Nakayama et al. | |
| 2008/0170982 | A1 | 7/2008 | Zhang et al. | |
| 2008/0260188 | A1 | 10/2008 | Kim | |
| 2008/0299031 | A1 | 12/2008 | Liu et al. | |
| 2009/0016951 | A1 | 1/2009 | Kawabata et al. | |
| 2009/0028002 | A1 | 1/2009 | Sugiura et al. | |
| 2009/0085461 | A1 | 4/2009 | Feng et al. | |
| 2009/0096346 | A1 | 4/2009 | Liu et al. | |
| 2009/0096348 | A1 | 4/2009 | Liu et al. | |
| 2009/0145686 | A1 | 6/2009 | Watabe et al. | |
| 2009/0153012 | A1 | 6/2009 | Liu et al. | |
| 2009/0167136 | A1 | 7/2009 | Liu et al. | |
| 2009/0167137 | A1 | 7/2009 | Liu et al. | |
| 2010/0054502 | A1 | 3/2010 | Miyachi | |
| 2010/0054507 | A1 | 3/2010 | Oh et al. | |
| 2010/0166232 | A1 | 7/2010 | Liu et al. | |
| 2011/0171419 | A1 | 7/2011 | Li et al. | |
| 2012/0000293 | A1 * | 1/2012 | Baughman et al. | 73/861.08 |

FOREIGN PATENT DOCUMENTS

| | | |
|---|---|---|
| CN | 2779422 Y | 5/2006 |
| CN | 1787696 | 6/2006 |
| CN | 2787870 | 6/2006 |
| CN | 2798479 | 7/2006 |
| CN | 1821048 | 8/2006 |
| CN | 1886820 | 12/2006 |
| CN | 1944829 | 4/2007 |
| CN | 1982209 | 6/2007 |
| CN | 101284662 | 10/2008 |
| CN | 201150134 | 11/2008 |
| CN | 101314464 | 12/2008 |
| CN | 101471213 | 7/2009 |
| CN | 101400198 | 9/2010 |
| JP | 49-24593 | 3/1974 |
| JP | 60-22900 | 2/1985 |
| JP | 1-255398 | 10/1989 |
| JP | 3-147497 | 6/1991 |
| JP | 4-126489 | 4/1992 |
| JP | 9-105788 | 4/1997 |
| JP | 11-300274 | 11/1999 |
| JP | 2001333493 | 11/2001 |
| JP | 2002-186097 | 6/2002 |
| JP | 2002346996 | 12/2002 |
| JP | 2002542136 | 12/2002 |
| JP | 2003500325 | 1/2003 |
| JP | 2003198281 | 7/2003 |
| JP | 2003-266399 | 9/2003 |
| JP | 2003-319490 | 11/2003 |
| JP | 20042103 | 1/2004 |
| JP | 2004229250 | 8/2004 |
| JP | 2005-51284 | 2/2005 |
| JP | 2005-73197 | 3/2005 |
| JP | 2005189322 | 7/2005 |
| JP | 2005-318040 | 11/2005 |
| JP | 2005-341554 | 12/2005 |
| JP | 2005333601 | 12/2005 |
| JP | 2006-180082 | 7/2006 |
| JP | 2006270041 | 10/2006 |
| JP | 2007-24688 | 2/2007 |
| JP | 2007-54831 | 3/2007 |
| JP | 2007-167118 | 7/2007 |
| JP | 2007-187976 | 7/2007 |
| JP | 2008-101910 | 5/2008 |
| JP | 2009-31031 | 2/2009 |
| JP | 2009-91239 | 4/2009 |
| JP | 2009-94074 | 4/2009 |
| JP | 2009-146896 | 7/2009 |
| JP | 2009-146898 | 7/2009 |
| JP | 2009-164125 | 7/2009 |
| KR | 10-0761548 | 9/2007 |
| TW | 200740976 | 11/2007 |
| TW | 200744399 | 12/2007 |
| TW | 201029481 | 8/2010 |
| WO | WO0073204 | 12/2000 |
| WO | WO2005102924 | 11/2005 |
| WO | WO2007049496 | 5/2007 |
| WO | WO2007052928 | 5/2007 |
| WO | WO2007099975 | 9/2007 |
| WO | WO2007111107 | 10/2007 |
| WO | WO2008/029451 | 3/2008 |

OTHER PUBLICATIONS

P. De Lange, On Thermophones, Proceedings of the Royal Society of London. Series A, Apr. 1 1915, pp. 239-241, vol. 91, No. 628.

Kaili Jiang, Qunqing Li, Shoushan Fan, Spinning continuous carbon nanotube yarns, Nature, Oct. 24, 2002, pp. 801, vol. 419.

Lin Xiao, Zhuo Chen, Chen Feng, Liang Liu et al, Flexible, Stretchable, Transparent Carbon Nanotube Thin Film Loudspeakers, Nano Letters, 2008, pp. 4539-4545, vol. 8, No. 12, US.

Kai Liu, Yinghui Sun, Lei Chen, Chen Feng, Xiaofeng Feng, Kaili Jiang et al., Controlled Growth of Super-Aligned Carbon Nanotube Arrays for Spinning Continuous Unidirectional Sheets with Tunable Physical Properties, Nano Letters, 2008, pp. 700-705, vol. 8, No. 2.

W. Yi, L.Lu, Zhang Dianlin et al., Linear Specific Heat of Carbon Nanotubes, Physical Review B, Apr. 1, 1999, vol. 59, No. 14, R9015-9018.

Zhuangchun Wu, Zhihong Chen, Xu Du et al.,Transparent, Conductive Carbon Nanotube Films, Science, Aug. 27, 2004, pp. 1273-1276, vol. 305.

Edward C. Wente, The Thermophone, Physical Review, 1922, pp. 333-345,vol. 19.

J.J.Hopfield, Spectra of Hydrogen, Nitrogen and Oxygen in the Extreme Ultraviolet, Physical Review, 1922, pp. 573-588,vol. 20.

Yang Wei, Kaili Jiang, Xiaofeng Feng, Peng Liu et al., Comparative studies of multiwalled carbon nanotube sheets before and after shrinking, Physical Review B, Jul. 25, 2007, vol. 76, 045423.

Lina Zhang, Chen Feng, Zhuo Chen, Liang Liu et al., Superaligned Carbon Nanotube Grid for High Resolution Transmission Electron Microscopy of Nanomaterials, Nano Letters, 2008, pp. 2564-2569, vol. 8, No. 8.

Mei Zhang, Shaoli Fang, Anvar A. Zakhidov, Sergey B. Lee et al., Strong, Transparent, Multifunctional, Carbon Nanotube Sheets, Science, Aug. 19, 2005, pp. 1215-1219, vol. 309.

Frank P. Incropera, David P. Dewitt et al., Fundamentals of Heat and Mass Transfer, 6th ed., 2007, pp. A-5, Wiley:Asia.

Xiaobo Zhang, Kaili Jiang, Chen Feng, Peng Liu et al., Spinning and Processing Continuous Yarns from 4-Inch Wafer Scale Super-Aligned Carbon Nanotube Arrays, Advanced Materials, 2006, pp. 1505-1510, vol. 18.

Strutt John William, Rayleigh Baron, The Theory of Sound, 1926, pp. 226-235, vol. 2.

William Henry Preece, On Some Thermal Effects of Electric Currents, Proceedings of the Royal Society of London, 1879-1880, pp. 408-411, vol. 30.
H.D. Arnold, I.B. Crandall, The Thermophone as a Precision Source of Sound, Physical Review, 1917, pp. 22-38, vol. 10.
Braun Ferdinand, Notiz uber Thermophonie, Ann. Der Physik, Apr. 1898, pp. 358-360,vol. 65.
Alexander Graham Bell, Selenium and the Photophone, Nature, Sep. 23, 1880, pp. 500-503.
Silvanus P. Thompson, The Photophone, Nature, 23, Sep. 1880, vol. XXII, No. 569, pp. 481.
Lee et al., Photosensitization of nonlinear scattering and photoacoustic emission from single-walled carbon nanotubes, Applied Physics Letters, 13, Mar. 2008, 92, 103122.
Chen, Huxiong; Diebold, Gerald, "Chemical Generation of Acoustic Waves: A Giant Photoacoustic Effect", Nov. 10, 1995, Science, vol. 270, pp. 963-966.
Amos, S.W.; "Principles of Transistor Circuits"; 2000; Newnes-Butterworth-Heinemann; 9th ed.;p. 114.

* cited by examiner

THERMOACOUSTIC DEVICE

RELATED APPLICATIONS

The present application is a continuation of U.S. patent application Ser. No. 12/655,398, filed Dec. 30, 2009, entitled, "THERMOACOUSTIC DEVICE", which application are fully incorporated by reference herein. This application is related to applications entitled, "THERMOACOUSTIC DEVICE", filed Mar. 11, 2010 Ser. No. 12/661,106; "THERMOACOUSTIC DEVICE", filed Mar. 11, 2010 Ser. No. 12/661,109; "THERMOACOUSTIC DEVICE", filed Mar. 11, 2010 Ser. No. 12/661,108; "SPEAKER", filed Mar. 11, 2010 Ser. No. 12/661,132; "THERMOACOUSTIC DEVICE", filed Apr. 8, 2010 Ser. No. 12/756,872; "SPEAKER", filed Mar. 11, 2010 Ser. No. 12/661,148; and "THERMOACOUSTIC DEVICE", filed Mar. 11, 2010 Ser.No. 12/661,149.

BACKGROUND

1. Technical Field

The present disclosure relates to thermoacoustic devices and speakers using the same, particularly, to a carbon nanotube based thermoacoustic device and a speaker using the same.

2. Description of Related Art

Speaker is an electro-acoustic transducer that converts electrical signals into sound. There are different types of speakers that can be categorized according by their working principles, such as electro-dynamic speakers, electromagnetic speakers, electrostatic speakers and piezoelectric speakers. However, the various types ultimately use mechanical vibration to produce sound waves, in other words they all achieve "electro-mechanical-acoustic" conversion. Among the various types, the electro-dynamic speakers are most widely used.

Referring to FIG. 43, the electro-dynamic speaker 300, according to the prior art, typically includes a voice coil 302, a magnet 304 and a cone 306. The voice coil 302 is an electrical conductor, and is placed in the magnetic field of the magnet 304. By applying an electrical current to the voice coil 302, a mechanical vibration of the cone 306 is produced due to the interaction between the electromagnetic field produced by the voice coil 302 and the magnetic field of the magnets 304, thus producing sound waves by kinetically pushing the air. However, the structure of the electric-powered loudspeaker 300 is dependent on magnetic fields and often weighty magnets.

Thermoacoustic effect is a conversion of heat to acoustic signals. The thermoacoustic effect is distinct from the mechanism of the conventional speaker, which the pressure waves are created by the mechanical movement of the diaphragm. When signals are inputted into a thermoacoustic element, heating is produced in the thermoacoustic element according to the variations of the signal and/or signal strength. Heat is propagated into surrounding medium. The heating of the medium causes thermal expansion and produces pressure waves in the surrounding medium, resulting in sound wave generation. Such an acoustic effect induced by temperature waves is commonly called "the thermoacoustic effect".

A thermophone based on the thermoacoustic effect was created by H. D. Arnold and I. B. Crandall (H. D. Arnold and I. B. Crandall, "The thermophone as a precision source of sound", Phys. Rev. 10, pp 22-38 (1917)). They used platinum strip with a thickness of $7\times10^{-5}$ cm as a thermoacoustic element. The heat capacity per unit area of the platinum strip with the thickness of $7\times10^{-5}$ cm is $2\times10^{-4}$ J/cm$^2$*K. However, the thermophone adopting the platinum strip, listened to the open air, sounds extremely weak because the heat capacity per unit area of the platinum strip is too high.

Carbon nanotubes (CNT) are a novel carbonaceous material having extremely small size and extremely large specific surface area. Carbon nanotubes have received a great deal of interest since the early 1990s, and have interesting and potentially useful electrical and mechanical properties, and have been widely used in a plurality of fields. Fan et al. discloses a thermoacoustic device with simpler structure and smaller size, working without the magnet in an article of "Flexible, Stretchable, Transparent Carbon Nanotube Thin Film Loudspeakers", Fan et al., Nano Letters, Vol. 8 (12), 4539-4545 (2008). The thermoacoustic device includes a sound wave generator which is a carbon nanotube film. The carbon nanotube film used in the thermoacoustic device has a large specific surface area, and extremely small heat capacity per unit area that make the sound wave generator emit sound audible to humans. The sound has a wide frequency response range. Accordingly, the thermoacoustic device adopted the carbon nanotube film has a potential to be used in places of the loudspeakers of the prior art.

However, the carbon nanotube film used in the thermoacoustic device having a small thickness and a large area is easily damaged by the external forces applied thereon.

BRIEF DESCRIPTION OF THE DRAWINGS

Many aspects of the present thermoacoustic device and a speaker using the same can be better understood with reference to the following drawings. The components in the drawings are not necessarily to scale, the emphasis instead being placed upon clearly illustrating the principles of the present thermoacoustic device and a speaker using the same. Moreover, in the drawings, like reference numerals designate corresponding parts throughout the several views.

DETAILED DESCRIPTION OF EXEMPLARY EMBODIMENTS

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Reference will now be made to the drawings to describe, in detail, embodiments of a thermoacoustic device and a speaker using the same.

Figure 1:
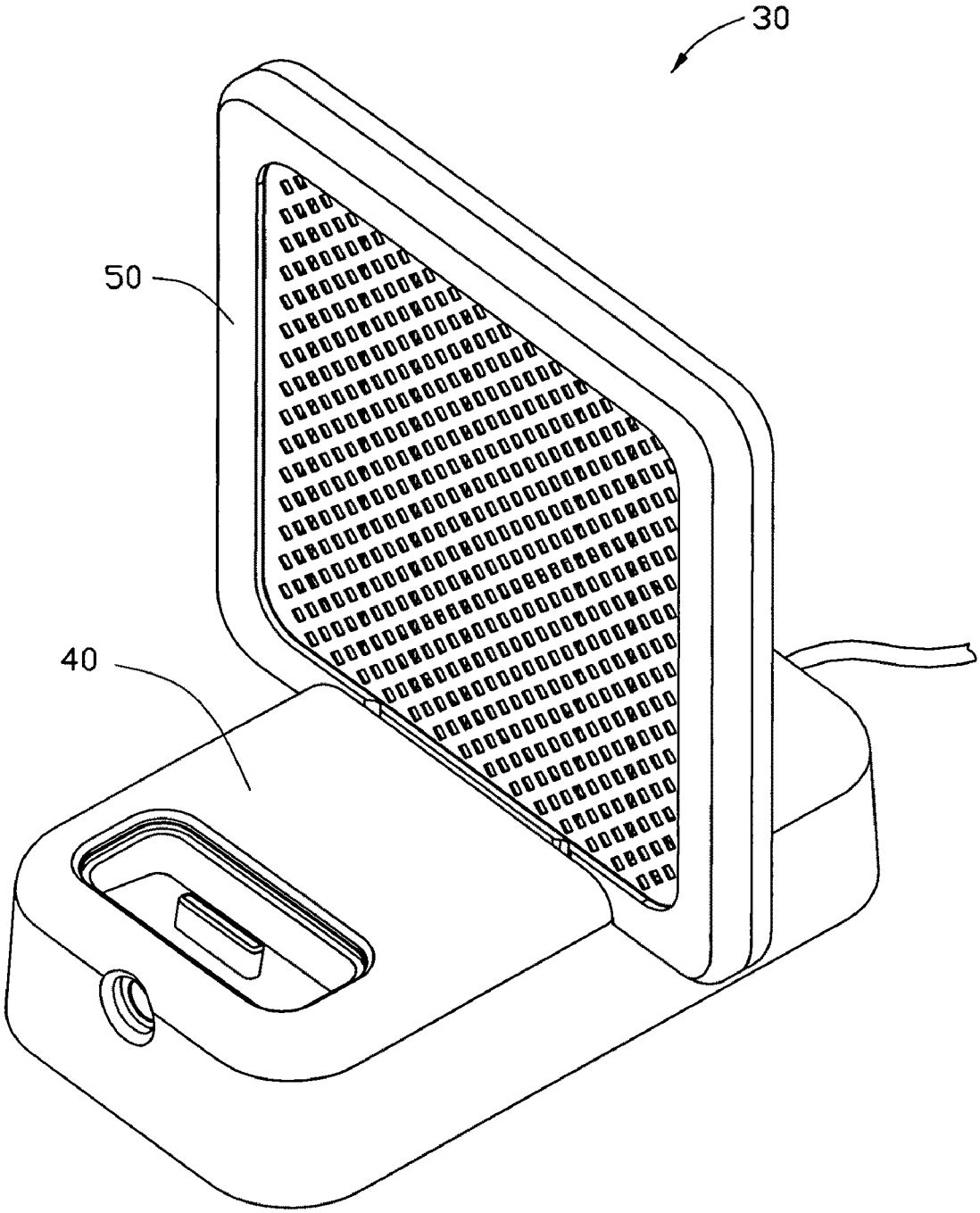
FIG. 1 is a schematic structural view of one embodiment of a speaker.

Referring to the embodiment shown in FIG. 1, a speaker 30 of one embodiment includes a base 40, and a thermoacoustic device 50 detachably installed on the base 40.

Base

Figure 2:
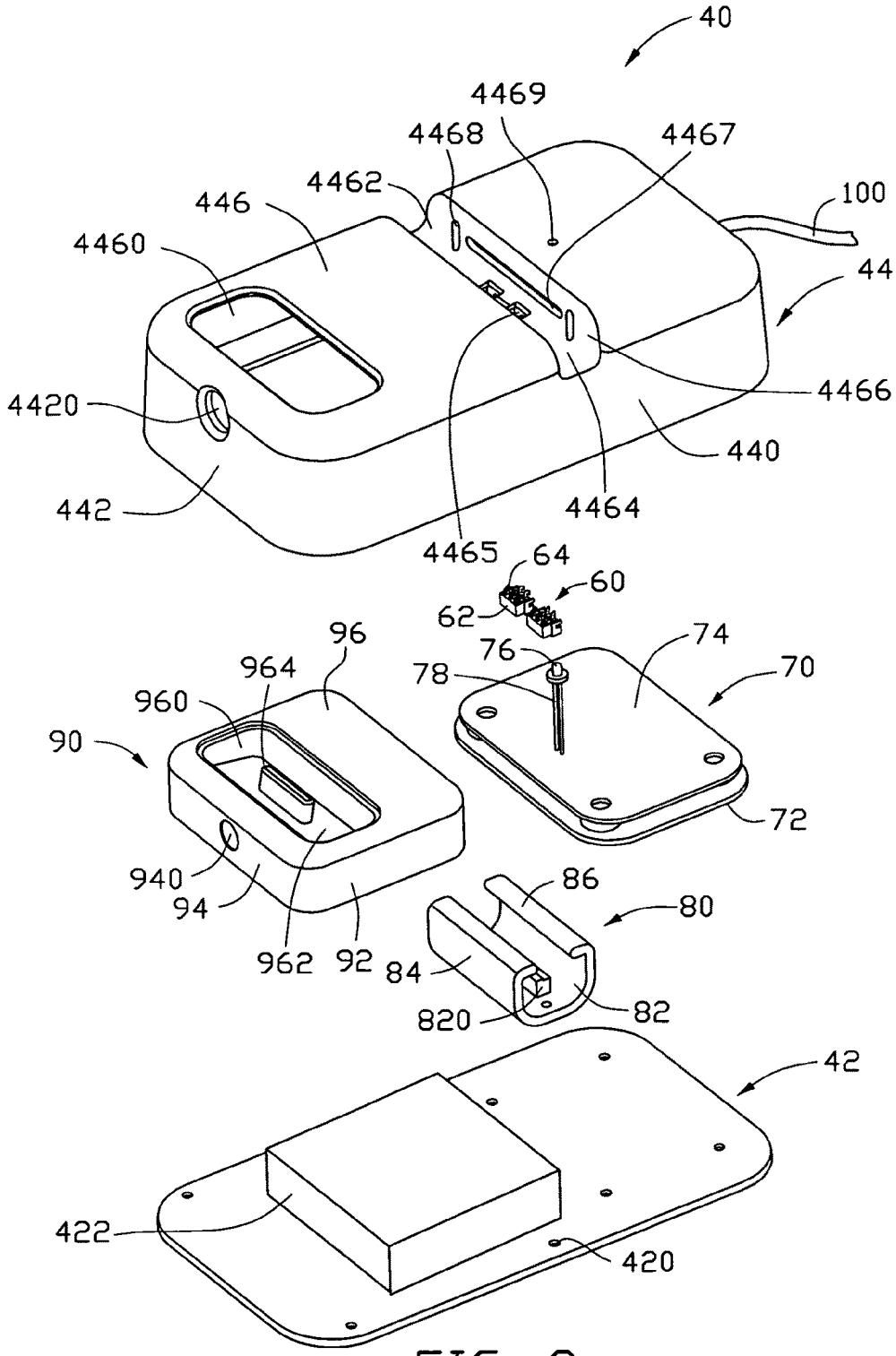
FIG. 2 is an exploded schematic structural view of a base of the speaker shown in FIG. 1.
Figure 3:
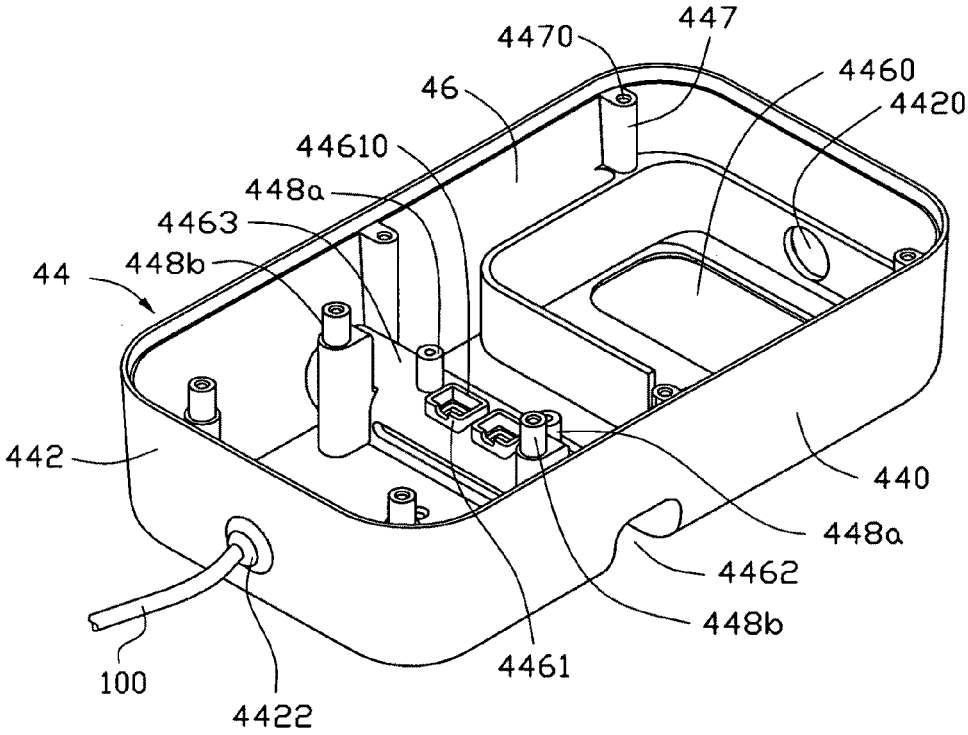
FIG. 3 is a schematic structural view of the inverted base shown in FIG. 2.

Referring to the embodiment shown in FIGS. 2 to 3, an embodiment of the base 40 includes a plate 42, a shell 44 covering the plate 42, a first connector 60, a second connector 90, an amplifier circuit device 70, and a fixing piece 80. The plate 42 and the shell 44 form a receiving room 46. The first connector 60, the amplifier circuit device 70, the fixing piece 80 and the second connector 90 are received in the receiving room 46. The first connector 60 is electrically connected to the thermoacoustic device 50 for inputting audio signal thereto. The amplifier circuit device 70 supplies amplifier circuit for the thermoacoustic device 50. The fixing piece 80 fixes the first connector 60 and the thermoacoustic device 50 to the shell 44. The second connector 90 can be connected with an external audio signal input device (not shown). The thermoacoustic device 50 can receive the audio signal from the audio signal input device and produce sound waves.

In one embodiment, the plate 42 can be made of metal, alloy, glass or resin. Shape and size of the plate 42 can be varied according to actual needs. In one embodiment, the plate 42 is a plastic plate having a substantially rectangular shape. A plurality of fixing holes 420 is defined in the plate 42. The fixing holes 420 is used to fix the shell 44 and the amplifier circuit device 70 on the plate 42 by extending fixing means such as screws (not shown) through the fixing holes 420. The plate 42 has a protruding portion 422 corresponding to and supporting the second connector 90. The protruding portion 422 protrudes upwardly from a top surface of a left portion of the plate 42 towards the shell 44.

The shell 44 is coupled to the plate 42. The shell 44 can be made of metal, alloy, glass or resin. Shape and size of the shell 44 can be varied according to actual needs. In one embodiment, the shell 44 is a container having an opening which is located at one side of the shell 44. The shell 44 generally includes a top plate 446 and a plurality of sidewalls extending downwardly from a periphery of the top plate 446 towards the plate 42. In some embodiments, the top plate 446 is substantially rectangular and the sidewalls can be divided in to a pair of first sidewalls 440 and a pair of second sidewalls 442. The pair of first sidewalls 440 is located at a opposite ends of the top plate 446. The pair of second sidewalls 442 is located at another end of the top plate 446. The first sidewalls 440 are longer than the second sidewalls 442. The receiving room 46 is defined by the plate 42, the first and second sidewalls 440, 442, and the top plate 446.

A circular opening 4420 can be defined through the second sidewall 442 at the left side when the base 40 is in the position shown in FIG. 2, to expose infrared signal reception terminal (not shown) of the second connector 90. The opening 4420 is adjacent to the top plate 446 because the second connector 90 is supported on the protruding portion 422. As shown in FIG. 2, the opening 4420 is defined through a joint portion between the top plate 446 and the second sidewall 442 at the left side. A bulge 4422 is located on the other second sidewall 442 and adjacent to the top plate 446. The bulge 4422 (shown in FIG. 3) has a through hole (not labeled) through which a power cord 100 extends out of the shell 44. A rectangular opening 4460 is on top plate 446 corresponding to the second connector 90. A through hole 4469 is defined through a right portion of the top plate 446.

The top plate 446 is concaved at a position between the rectangular opening 4460 and the through hole 4469 towards the plate 42 to form a concavity 4462 at a top of the top plate 446 and form a protrusion 4463 viewed from bottom aspect. The concavity 4462 extends parallel to the second sidewalls 442 and has a length equal to the width of the top plate 446 (e.g., the length of the second sidewalls 442). In the position shown in FIG. 2, the concavity 4462 transversely extends across the top plate 446. The concavity 4462 has a U-shaped cross-section along a longitudinal direction of the top plate 446. The concavity 4462 includes a bottom plate 4464 and two opposite side plates 4466 extending upwardly from opposite sides of bottom plate 4464. Two rectangular openings 4465 are separately defined through the center of the bottom plate 4464 to accommodate the first connector 60 located therein. Each of the two side plates 4466 has a slot 4467 and two guiding bulges 4468. The slot 4467 is long and narrow, and extends along a length direction of the concavity 4462. The two guiding bulges 4468 are located on two opposite sides of the slot 4467 along a length direction of the slot 4467. The two guiding bulges 4468 have a columnar shape.

The protrusion 4463 is located in the receiving room 46 of the shell 44, as shown in FIG. 3. Two rectangular fixing grooves 4461 are located on the protrusion 4463 corresponding to the rectangular openings 4465. Each of the fixing grooves 4461 is encircled by a periphery wall 44610 which extends from the protrusion 4463 towards the plate 42. Two cylinders 448*a* extend from the protrusion 4463 towards the plate 42. The two rectangular fixing grooves 4461 are located between the two cylinders 448*a*. The two cylinders 448*a* and the two rectangular fixing grooves 4461 are arranged in a line to facilitate locating the fixing piece 80 between the two cylinders 448*a*.

A plurality of protruding poles 447 is located on the inner surface of the shell 44. Each of the protruding poles 447 has an installation hole 4470. The installation holes 4470 correspond to the fixing holes 420 of the plate 42 in a one-to-one manner. A plurality of screws extends through the fixing holes 420 and is engaged in the installation holes 4470 of the protruding poles 447. Thus, the shell 44 is secured on the plate 42.

Figure 4:
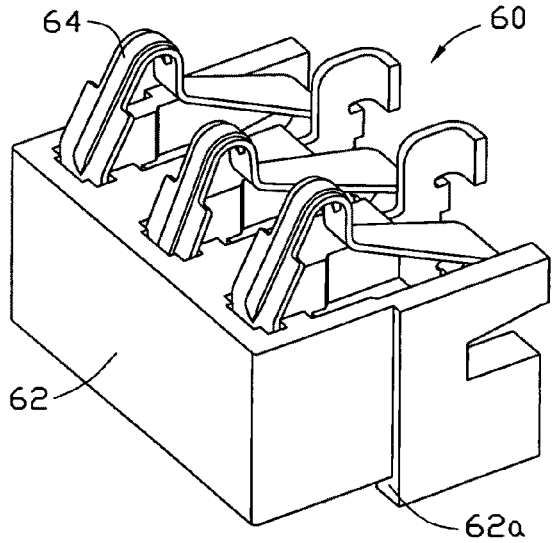
FIG. 4 is an enlarged view of a first connector of the speaker shown in FIG. 2.

Referring to the embodiment shown in FIG. 2 and FIG. 4, the first connector 60 can be plugs, sockets, or elastic contact pieces. In one embodiment, the first connector 60 includes two separate square bases 62 and a plurality of metal contacts 64 located on each of the bases 62. The outer configuration of the bases 62 is designed to match an inner surface of the fixing groove 4461. A step structure 62*a* is provided on a bottom of the first connector 60.

The amplifier circuit device 70 is electrically connected to the first connector 60 and the second connector 90. The amplifier circuit device 70 amplifies the signals input from the second connector 90 and sends the amplified signals to the thermoacoustic device 50 through the first connector 60. In one embodiment, the amplifier circuit device 70 includes a base board 72, a printed circuit board 74, and an indicator lamp 76. The base board 72 is used to support the printed circuit board 74. The base board 72 can be a rectangular metal plate. The printed circuit board 74 can have a shape that corresponds to the base board 72 and have an amplifier circuit (not shown) integrated therein. The printed circuit board 74 and the base board 72 are spaced and parallel to each other. Four pads (not shown) are located between the printed circuit board 74 and the base board 72. The indicator lamp 76 is supported on and electrically connected to the printed circuit board 74. The indicator lamp 76 extends through the through hole 4469 of top plate 446 of the shell 44 when the shell 44 is mounted on the plate 42. The amplifier circuit device 70 is electrically connected to the power cord 100. Further, a heat sink (not shown) can be located adjacent to the amplifier circuit device 70 to cool the amplifier circuit device 70. In one embodiment, the amplifier circuit device 70 is secured in the base 40 via four posts 448*b* on the top plate 446. Referring to the embodiment shown in FIG. 3, four posts 448*b* perpendicularly extend from the top plate 446. The posts 448*b* extend through corners of the amplifier circuit device 70 and engage with four nuts (not shown) which extend through the plate 42, whereby the amplifier circuit device 70 is secured between the plate 42 and the top plate 446.

Figure 5:
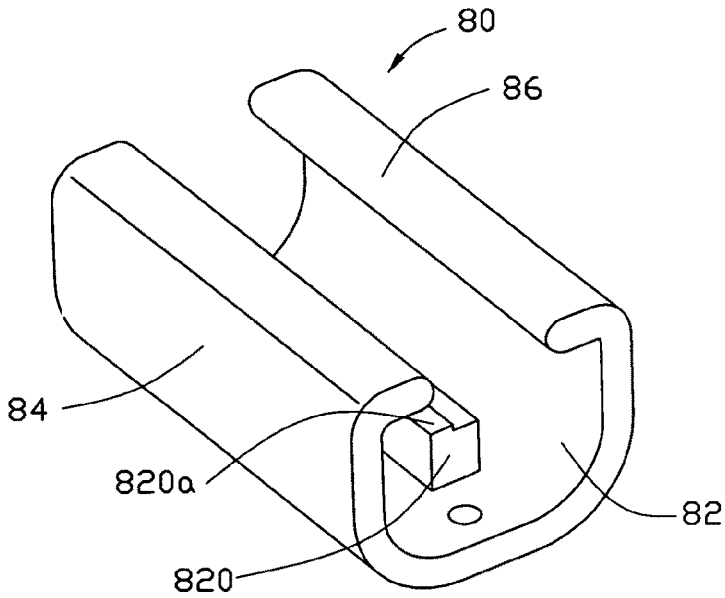
FIG. 5 is an enlarged view of a fixing piece of the speaker shown in FIG. 2.

Referring to the embodiment shown in FIG. 5, the fixing piece 80 is an elastic structure and includes two opposite side walls 84, a bottom wall 82 connecting the two opposite side walls 84, and two hook portions 86 extending from two top ends of the side walls 84 toward inside of the fixing piece 80. The fixing piece 80 engages with the protrusion 4463 of the shell 44, in such a manner that the hook portions 86 are inserted into the slot 4467, and is ready to engage the thermoacoustic device 50 so as so detachably secure the thermoacoustic device 50 on the base 40. A projecting portion 820 protrudes upwardly from the bottom wall 82 towards the hook portions 86. A step structure 820*a* is further located on a top free end of the projecting portion 820 along a length direction of the projecting portion 820. The step structure 820*a* of the fixing piece 80 is capable of engaging with the step structure 62*a* of the first connector 60. When the first connector 60 is installed in the fixing grooves 4461, the projecting portion 820 engages with the step structure 62*a* of the first connector 60. As a result, the projecting portion 820 pushes the first connector 60 to move upwardly to its position. The first connector 60 is then held in the fixing grooves 4461 by the fixing piece 80. The protrusion 4463 in the shell 44 is received in the fixing piece 80. The projecting portion 820 of the fixing piece 80 is inserted into the fixing grooves 4461 of the protrusion 4463. Further, two through holes (not labeled) are defined through opposite sides of the projecting portion 820 capable of having screws extending therethrough to secure the fixing piece 80 on the top plate 446.

The second connector 90 is located on the protruding portion 422 of the plate 42. The second connector 90 can be a link connector or board connector. The second connector 90 is used to couple the amplifier circuit device 70 with an external audio signal source (not shown). In one embodiment, the second connector 90 includes a shell and circuit components (not shown) located therein. The shell of the second connector 90 includes two opposite short sidewalls 92, two opposite long sidewalls 94, a top plate 96 and a bottom plate (not shown) connecting the short sidewalls 92 and the long sidewalls 94. A circular hole 940 is defined at one long sidewall 94 adjacent to the top plate 96 corresponding to the circular opening 4420 of the shell 40 to expose infrared signal reception terminal (not shown) of the second connector 90 when the base 40 is assembled. A receiving room 960 is defined in the top plate 96 at a position adjacent to the circular hole 940 and concaved from the top surface of the top plate 96 towards the plate 42. The receiving room 960 has a similar shape as the rectangular opening 4460 of the top plate 446 of the shell 44. The receiving room 960 is exposed out via the rectangular opening 4460 after the base 40 is assembled. The receiving room 960 is defined by a bottom wall 962 and a sidewall (not labeled) connected with the bottom wall 962. An angle exists between the bottom wall 962 and the top plate 96 of the second connector 90. In one embodiment, the sidewall is substantially perpendicular to the top plate 96, and the bottom wall 962 is oblique relative to the top plate 96. A protrusion 964 extends from a center of the bottom wall 962 and serves as an interface between the external audio signal source and the base 40. The protrusion 964 can be connected with any music devices including MP3, MP4 and other music players. In one embodiment, the protrusion 964 is a docking station interface.

In one embodiment, the base 40 can be assembled as follows. The second connector 90 is placed on the protruding portion 422 of the plate 42. The amplifier circuit device 70 is placed on the plate 42 beside the protruding portion 422. The first connector 60 is placed in the two rectangular openings 4465 of the shell 44 with the metal contacts 64 exposing outside through the two rectangular openings 4465 and with the base 62 abutting against edges of the two rectangular openings 4465 so as to prevent the base 62 from escaping the two rectangular openings 4465. The fixing piece 80 is placed on and pressed towards the protrusion 4463 in the shell 44, the hook portions 86 of the fixing piece 80 are inserted into the slot 4467 of the shell 44. As a result, and the first connector 60 is pushed upwardly to its position by the projecting portion 820 of the fixing piece 80. Thus, the shell 44 is covered and fixed on the plate 42.

Figure 6:
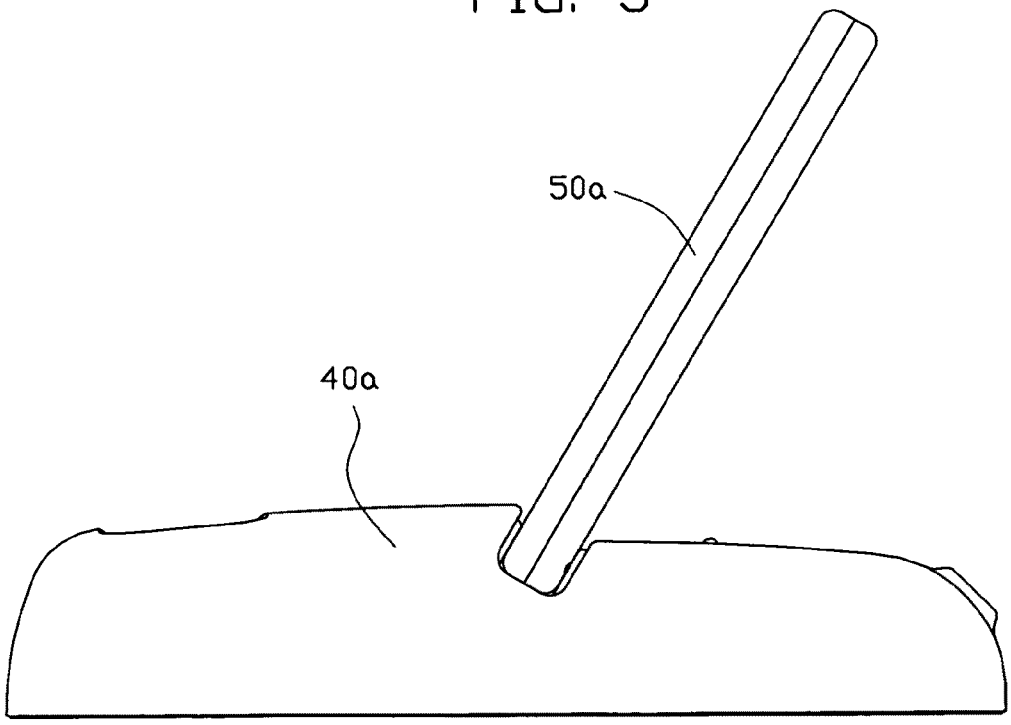
FIG. 6 is a schematic side view of one embodiment of a speaker.
Figure 7:
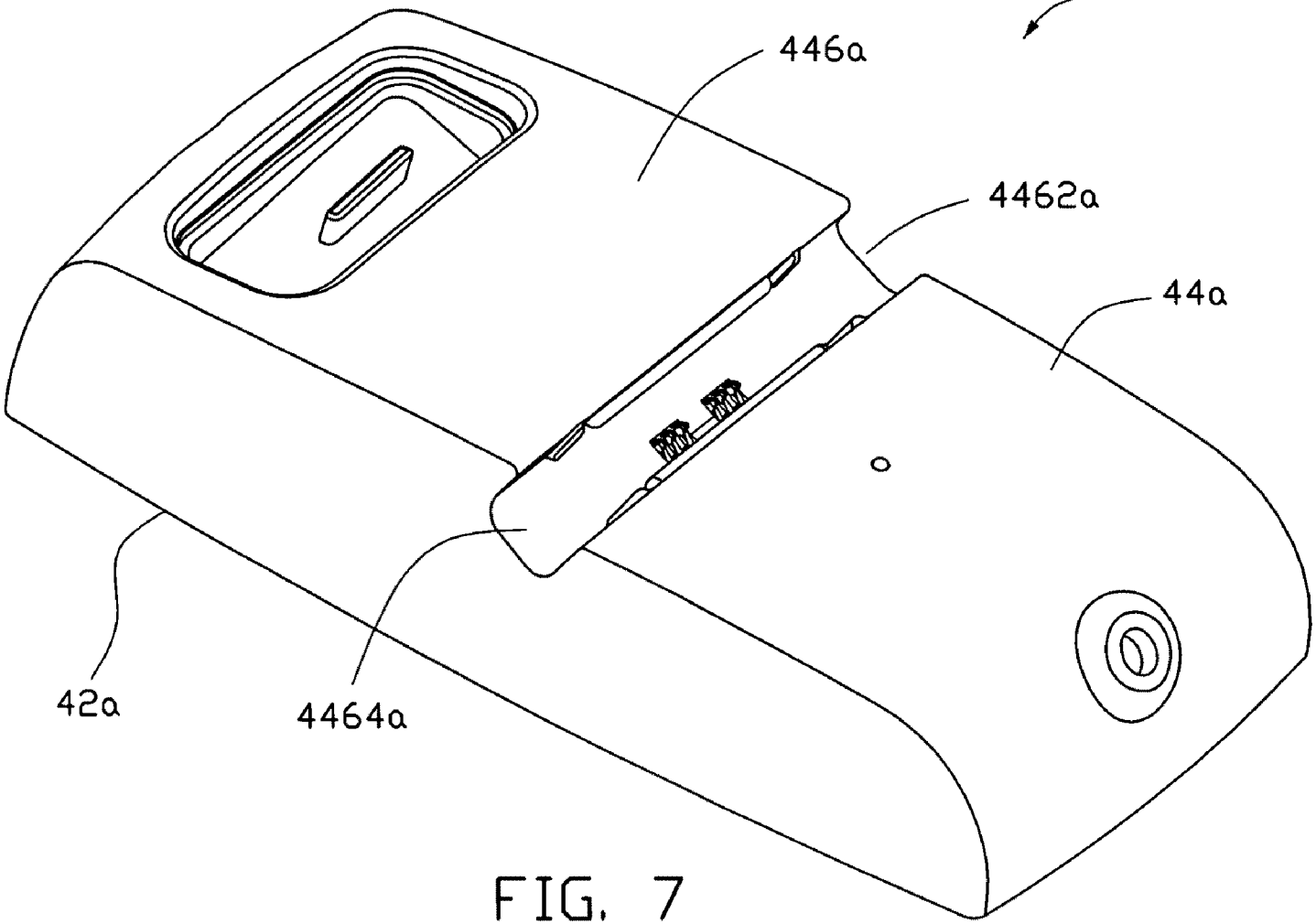
FIG. 7 is a schematic structural view of the base shown in FIG. 6.

Further, the base 40 can also have other structures. In one embodiment illustrated in FIGS. 6 and 7, the base 40*a* includes a plate 42*a* and a shell 44*a* attached to the plate 42*a*. The shell 44*a* includes a top plate 446*a*. A concavity 4462*a* is defined in the top plate 446. The concavity 4462*a* is defined by a bottom plate 4464*a* and two side plates (not labeled) connected with the bottom plate 4464*a*. The concavity 4462*a* has an inclined U-shaped cross-section. The rotation angle or inclined angle of the U-shaped cross-section is in a range from above 0 degrees to less than 90 degrees relative to a direction perpendicular to the top plate 446*a*. In one embodiment, the rotation angle or inclined angle of the U-shaped cross-section is in a range from above 0 degrees to less than 60 degrees relative to a direction substantially perpendicular to the top plate 446*a*. In one embodiment, the concavity 4462*a* has a U-shaped cross-section rotated about 15 degrees relative to the direction perpendicular to the top plate 446*a*.

When the thermoacoustic device 50*a* is inserted into the concavity 4462*a* of the base 40*a*, an angle exist between the thermoacoustic device 50*a* and the plate 42*a*. Since the thermoacoustic device 50*a* produces sound waves by heating the surrounding medium thereof, heat is produced during the working process thereof. The existed angle can be set for dissipating the heat produced by the thermoacoustic device 50*a*, thereby ensuring the thermoacoustic device 50*a* will work properly. Additionally, the angle can be set to direct heat away from an intended user In another embodiment, the base 40 includes a protruding portion (not shown), and the thermoacoustic device 50 has a concavity (not shown) defined therein. The first connector 60 is located in the concavity; a third connector (not shown) is located on the protruding portion. The thermoacoustic device 50 can be detachably installed on the base 40 by a detachable engagement between the concavity and the protruding portion. The first connector 60 and the third connector are electrically connected.

Thermoacoustic Device

Figure 8:
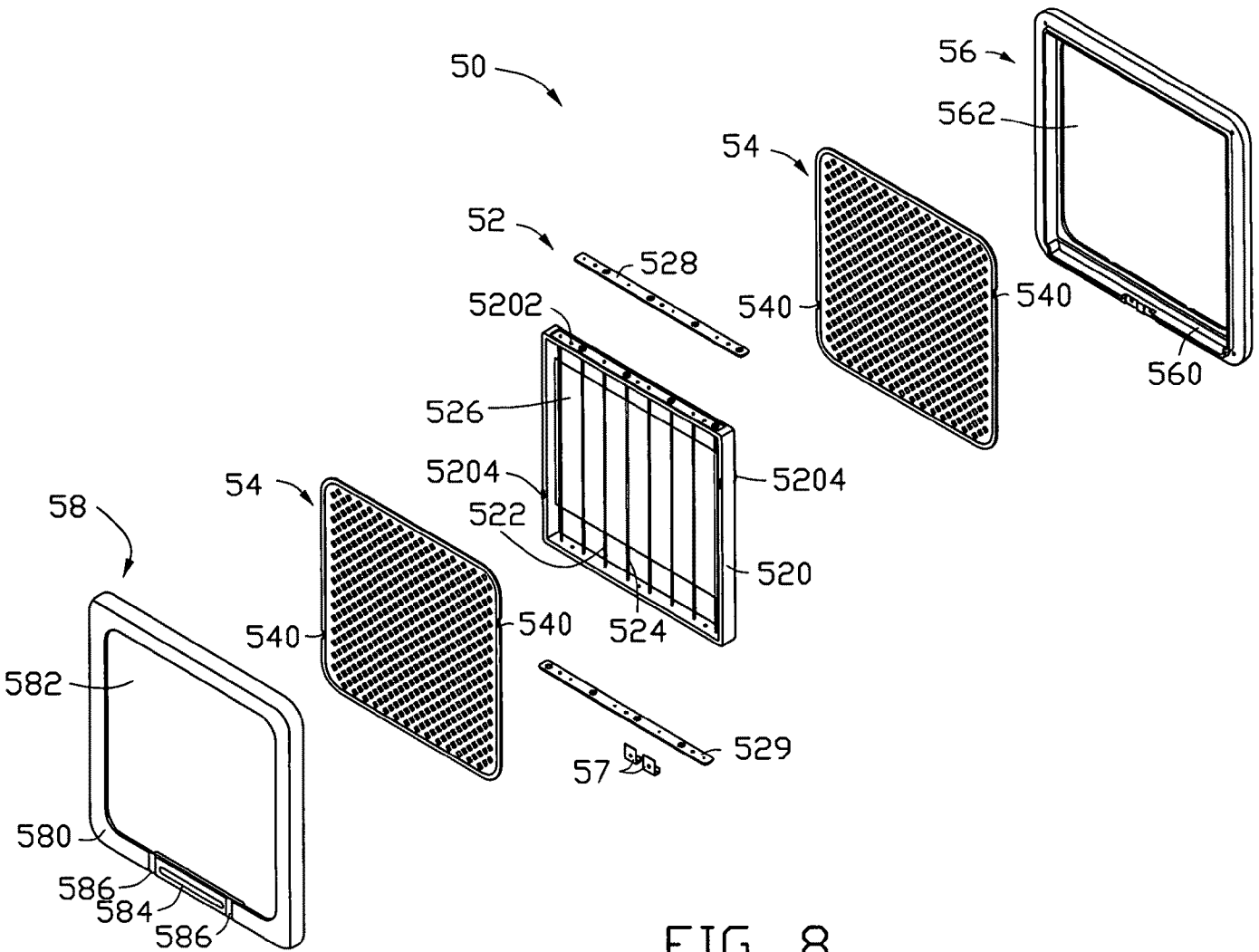
FIG. 8 is an exploded schematic structural view of a thermoacoustic device of the speaker in FIG. 1.
Figure 9:
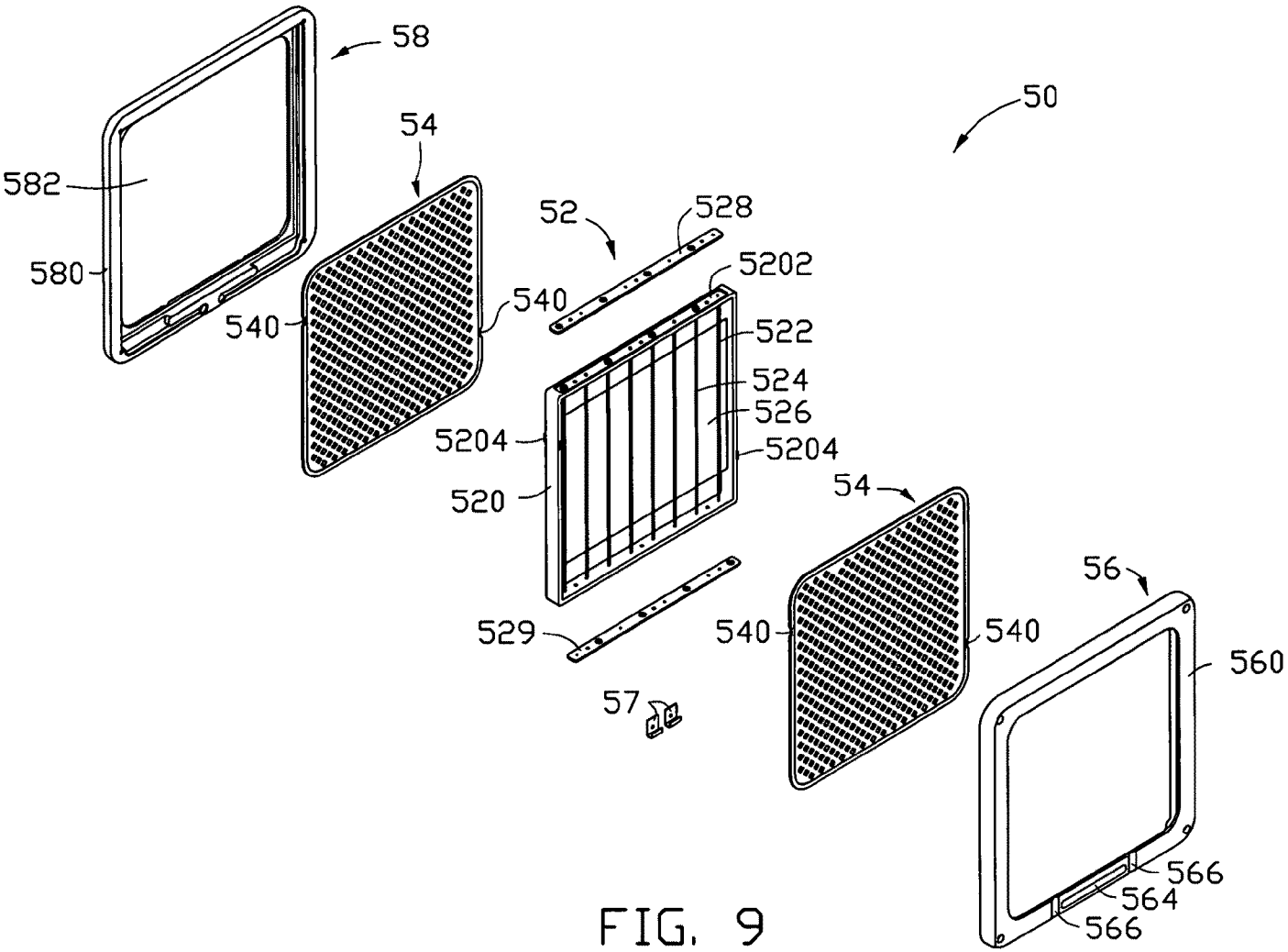
FIG. 9 is an exploded schematic structural view of the thermoacoustic device shown in FIG. 8, viewed from another aspect.

Referring to FIGS. 8 and 9, the thermoacoustic device 50 includes a thermoacoustic module 52, two protection components 54, a first fixing frame 56 and a second fixing frame 58. The protection components 54 are located on opposite sides of the thermoacoustic module 52. The first fixing frame 56 engages with the second fixing frame 58 to clamp the thermoacoustic module 52 and the protection components 54 therebetween.

Thermoacoustic Module

The thermoacoustic module 52 includes a supporting frame 520, a plurality of first electrodes 522, a plurality of second electrodes 524, and a sound wave generator 526. The supporting frame 520 includes two sets of opposite beams. Opposite ends of the first electrodes 522 and the second electrodes 524 can be fixed on the beams of the supporting frame 520. The first electrodes 522 and the second electrodes 524 are alternately arranged and spaced from each other. The first electrodes 522 and the second electrodes 524 are electrically connected to the sound wave generator 526. The sound wave generator 526 receives signals output from the first electrodes 522 and the second electrodes 524 and produces sound waves.

Sound Wave Generator

The sound wave generator 526 has a low heat capacity per unit area that can realize "electrical-thermal-sound" conversion. The sound wave generator 526 can have a large specific surface area for causing the pressure oscillation in the surrounding medium by the temperature waves generated by the sound wave generator 526. The heat capacity per unit area of the sound wave generator 526 can be less than $2\times10^{-4}$ $J/cm^2*K$. In one embodiment, the sound wave generator 526 includes or can be a carbon nanotube structure. The carbon nanotube structure can have a large specific surface area (e.g., above 30 $m^2/g$). The heat capacity per unit area of the carbon nanotube structure is less than $2\times10^{-4}$ $J/cm^2*K$. In one embodiment, the heat capacity per unit area of the carbon nanotube structure is less than or equal to $1.7\times10^{-6}$ $J/cm^2*K$.

The carbon nanotube structure can include a plurality of carbon nanotubes uniformly distributed therein, and the carbon nanotubes therein can be combined by van der Waals attractive force therebetween. It is understood that the carbon nanotube structure must include metallic carbon nanotubes. The carbon nanotubes in the carbon nanotube structure can be arranged orderly or disorderly. The term 'disordered carbon nanotube structure' includes, but is not limited to, a structure where the carbon nanotubes are arranged along many different directions, arranged such that the number of carbon nanotubes arranged along each different direction can be almost the same (e.g. uniformly disordered); and/or entangled with each other. 'Ordered carbon nanotube structure' includes, but not limited to, a structure where the carbon nanotubes are arranged in a systematic manner, e.g., the carbon nanotubes are arranged approximately along a same direction and or have two or more sections within each of which the carbon nanotubes are arranged approximately along a same direction (different sections can have different directions). The carbon nanotubes in the carbon nanotube structure can be selected from single-walled, double-walled, and/or multi-walled carbon nanotubes. Diameters of the single-walled carbon nanotubes range from about 0.5 nanometers to about 50 nanometers. Diameters of the double-walled carbon nanotubes range from about 1 nanometer to about 50 nanometers. Diameters of the multi-walled carbon nanotubes range from about 1.5 nanometers to about 50 nanometers. It is also understood that there may be many layers of ordered and/or disordered carbon nanotube films in the carbon nanotube structure.

The carbon nanotube structure may have a substantially planar structure. The thickness of the carbon nanotube structure may range from about 0.5 nanometers to about 1 millimeter. The smaller the specific surface area of the carbon nanotube structure, the greater the heat capacity per unit area will be. The greater the heat capacity per unit area, the smaller the sound pressure level.

Figure 10:
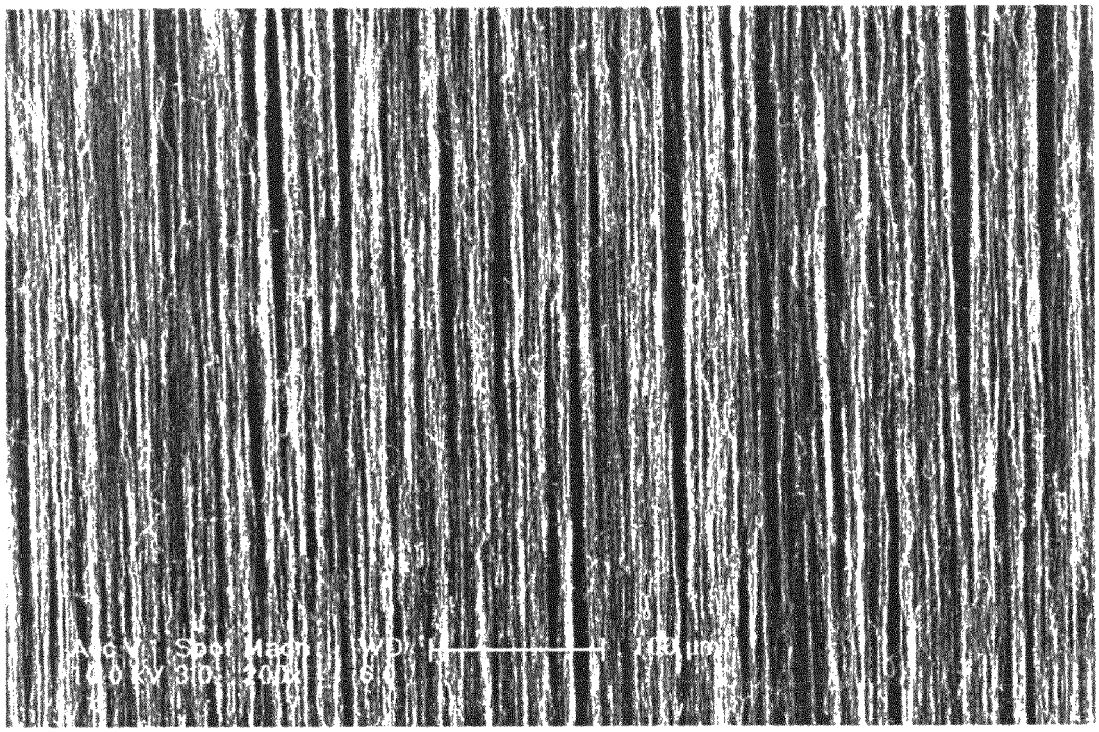
FIG. 10 shows a Scanning Electron Microscope (SEM) image of an aligned carbon nanotube film.
Figure 11:
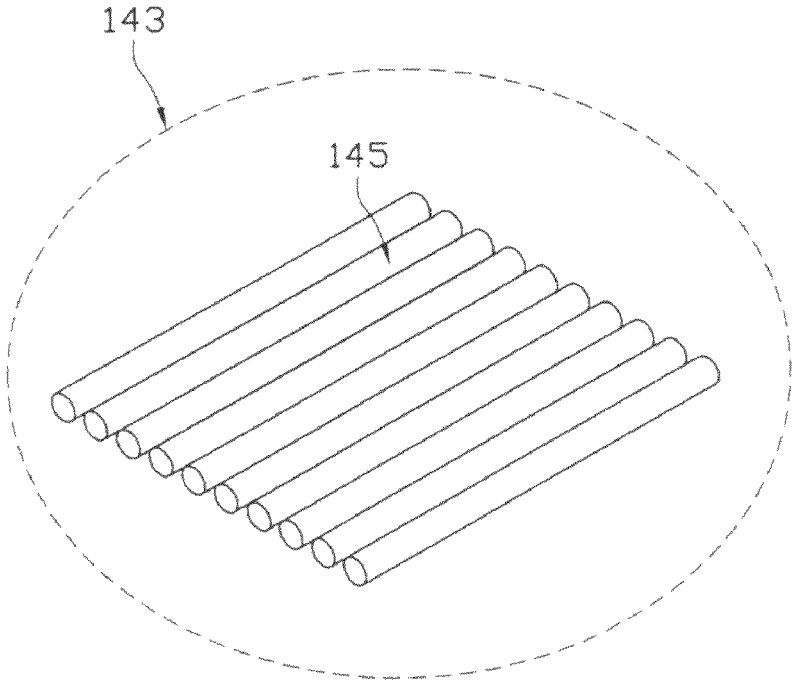
FIG. 11 is a schematic structural view of a carbon nanotube segment.

In one embodiment, the carbon nanotube structure can include at least one drawn carbon nanotube film. Examples of a drawn carbon nanotube film are taught by U.S. Pat. No. 7,045,108 to Jiang et al., and WO 2007015710 to Zhang et al. The drawn carbon nanotube film includes a plurality of successive and oriented carbon nanotubes joined end-to-end by van der Waals attractive force therebetween. The carbon nanotubes in the carbon nanotube film can be substantially aligned in a single direction. The drawn carbon nanotube film can be formed by drawing a film from a carbon nanotube array that is capable of having a film drawn therefrom. Referring to FIGS. 10 and 11, each drawn carbon nanotube film includes a plurality of successively oriented carbon nanotube segments 143 joined end-to-end by van der Waals attractive force therebetween. Each carbon nanotube segment 143 includes a plurality of carbon nanotubes 145 parallel to each other, and combined by van der Waals attractive force therebetween. As can be seen in FIG. 10, some variations can occur in the drawn carbon nanotube film. The carbon nanotubes 145 in the drawn carbon nanotube film are also oriented along a preferred orientation.

The drawn carbon nanotube film also can be treated with an organic solvent. After treatment, the mechanical strength and toughness of the treated drawn carbon nanotube film are increased and the coefficient of friction of the treated drawn carbon nanotube films is reduced. The treated drawn carbon nanotube film has a larger heat capacity per unit area and thus produces less of a thermoacoustic effect than the same film before treatment. A thickness of the drawn carbon nanotube film can range from about 0.5 nanometers to about 100 micrometers.

The carbon nanotube structure of the sound wave generator 526 also can include at least two stacked drawn carbon nanotube films. In other embodiments, the carbon nanotube structure can include two or more coplanar drawn carbon nanotube films. Coplanar drawn carbon nanotube films can also be stacked one upon other coplanar films. Additionally, an angle can exist between the orientation of carbon nanotubes in adjacent drawn films, stacked and/or coplanar. Adjacent drawn carbon nanotube films can be combined by only the van der Waals attractive force therebetween without the need of an additional adhesive. The number of the layers of the drawn carbon nanotube films is not limited. However, as the stacked number of the drawn carbon nanotube films increases, the specific surface area of the carbon nanotube structure will decrease. A large enough specific surface area (e.g., above 30 $m^2/g$) must be maintained to achieve an acceptable acoustic volume. An angle between the aligned directions of the carbon nanotubes in the two adjacent drawn carbon nanotube films can range from 0 degrees to about 90 degrees. When the angle between the aligned directions of the carbon nanotubes in adjacent drawn carbon nanotube films is larger than 0 degrees, a microporous structure is defined by the carbon nanotubes in the sound wave generator 526. The carbon nanotube structure in one embodiment employing these films will have a plurality of micropores. Stacking the drawn carbon nanotube films will add to the structural integrity of the carbon nanotube structure. In some embodiments, the carbon nanotube structure has a free standing structure and does not require the use of structural support. The term "free-standing" includes, but is not limited to, a structure that does not have to be supported by a substrate and can sustain the weight of itself when it is hoisted by a portion thereof without any significant damage to its structural integrity. The suspended part of the structure will have more sufficient contact with the surrounding medium (e.g., air) to have heat exchange with the surrounding medium from both sides thereof.

Furthermore, the drawn carbon nanotube film and/or the entire carbon nanotube structure can be treated, such as by laser, to improve the light transmittance of the drawn carbon nanotube film or the carbon nanotube structure. For example, the light transmittance of the untreated drawn carbon nanotube film ranges from about 70%-80%, and after laser treatment, the light transmittance of the untreated drawn carbon nanotube film can be improved to about 95%.

The carbon nanotube structure can be flexible and produce sound while being flexed without any significant variation to the sound produced. The carbon nanotube structure can be tailored or folded into many shapes and put onto a variety of rigid or flexible insulating surfaces, such as on a flag or on clothes and still produce the same quality sound.

The sound wave generator having a carbon nanotube structure comprising of one or more aligned drawn films has another striking property. It is stretchable perpendicular to the alignment of the carbon nanotubes. The carbon nanotube structure can be stretched to 300% of its original size, and can become more transparent than before stretching. In one embodiment, the carbon nanotube structure adopting one layer drawn carbon nanotube film is stretched to 200% of its original size. The light transmittance of the carbon nanotube structure, about 80% before stretching, is increased to about 90% after stretching. The sound intensity is almost unvaried during or as a result of the stretching.

The sound wave generator is also able to produce sound waves faithfully or properly even when a part of the carbon nanotube structure is punctured and/or torn. If part of the carbon nanotube structure is punctured and/or torn, the carbon nanotube structure is able to produce sound waves faithfully. Punctures or tears to a vibrating film or a cone of a conventional loudspeaker will greatly affect the performance thereof.

In the embodiment shown in FIGS. 8 and 9, the sound wave generator 526 includes a carbon nanotube structure comprising the drawn carbon nanotube film, and the drawn carbon nanotube film includes a plurality of carbon nanotubes arranged along a preferred direction. The thickness of the sound wave generator 526 is about 50 nanometers. It is understood that when the thickness of the sound wave generator 526 is small, for example, less than 10 micrometers, the sound wave generator 526 has greater transparency. Thus, it is possible to acquire a transparent thermoacoustic device 50 by employing a transparent sound wave generator 526 comprising of a transparent carbon nanotube film in the thermoacoustic device 50.

Working medium of the sound wave generator 526 can vary. Resistivity of the working medium can be larger than that of the sound wave generator 526. The working medium includes gaseous or liquid dielectric medium. The gaseous dielectric medium can be air. The liquid dielectric medium includes non-electrolyte solution, water and organic solvents. The water can be purified water, tap water, fresh water and seawater. The organic solvent can be methanol, ethanol and acetone. In one embodiment, the working medium is air and has excellent sound producing property.

First and Second Electrodes

The first electrode 522 and the second electrode 524 are made of conductive material. The shape of the first electrode 522 or the second electrode 524 is not limited and can be lamellar, rod, wire, and block among other shapes. Materials of the first electrode 522 and the second electrode 524 can be metals, alloys, conductive adhesives, carbon nanotubes, indium tin oxides, and other conductive materials. The metals can be tungsten, molybdenum and stainless steel. In one embodiment, the first electrode 522 and the second electrode 524 are rod-shaped stainless steel electrodes. The plurality of first electrodes 522 is electrically connected, and the plurality of second electrodes 524 is electrically connected. Specifically, the plurality of first electrodes 522 are electrically connected by a first conductive element 528 and electrically insulated from a second conductive element 529. The plurality of second electrodes 524 is electrically connected by the second conductive element 529 and electrically insulated from the first conductive element 528.

In one embodiment, the thermoacoustic module 52 includes four first electrodes 522 and four second electrodes 524. The four first electrodes 522 are electrically connected by the first conductive element 528. The four second electrodes 524 are electrically connected by the second conductive element 529. The first electrodes 522 and the second electrodes 524 are alternately arranged. Each first electrode 522 is located between two adjacent second electrodes 524, resulting in a parallel connections of portions of the sound wave generator 526 between the first electrodes 522 and the second electrodes 524. The parallel connections in the sound wave generator 526 provide for lower resistance, thus input voltage required to the thermoacoustic device 50, to obtain the same sound level, can be lowered.

The sound wave generator 526 is electrically connected to the first electrode 522 and the second electrode 524. The first and second electrodes 522, 524 can provide structural support for the sound wave generator 526. Because, some of the carbon nanotube structures have large specific surface area, some sound wave generators 526 can be adhered directly to the first electrode 522 and the second electrode 524 and/or many other surfaces without the use of adhesives. This will result in a good electrical contact between the sound wave generator 526 and the electrodes 522, 524.

Figure 12:
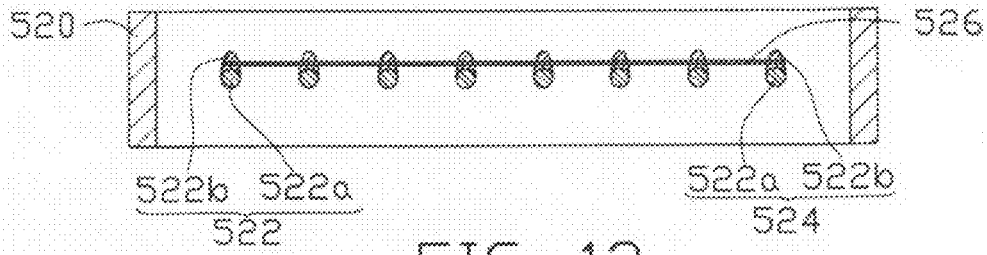
FIG. 12 is a schematic cross-sectional view of a thermoacoustic module having first and second electrodes.

In one embodiment, referring to FIG. 12, both the first electrode 522 and the second electrode 524 include an electrical conductor 522*a* and a conductive adhesive layer 522*b* located on the electrical conductor 522*a*. The first electrode 522 has a same structure as the second electrode 524. A material of the electrical conductors 522*a* includes a metal and an alloy. Specifically, the electrical conductor 522*a* can be made of stainless steel, copper, iron, cobalt, nickel, platinum, palladium or any alloy thereof. The electrical conductors 522*a* can have a shape of rod, strip, block or other shapes. In one embodiment, the electrical conductors 522*a* are stainless steel rods.

A material of the conductive adhesive layer 522*b* is conductive paste or conductive adhesive. Component of the conductive paste or conductive adhesive can include metal particles, binders and solvents. The metal particles can include gold particles, silver particles, and aluminum particles. In one embodiment, the material of the conductive adhesive layer 522*b* is silver conductive paste, and the metal particles are silver particles. To ensure the sound wave generator 526 is secured in the conductive adhesive layer 522*b*, liquid conductive paste is coated on each electrical conductor 522*a*, and the sound wave generator 526 is placed on the liquid conductive paste. When the sound wave generator 526 is a carbon nanotube structure, there are gaps in the carbon nanotube structure formed by the carbon nanotubes therein, the liquid conductive paste can penetrate into the gaps of the carbon nanotube structure. Once the liquid conductive paste is cured, the sound wave generator 526 is fixed in the conductive adhesive layer 522*b*, and thus fixed to the first and second electrodes 522, 524 and electrically connected thereto. This structure can increase the stability of the thermoacoustic device 50.

To ensure the thermoacoustic device 50 works under a safe voltage and produces sound waves, the working voltage of the thermoacoustic device 50 can be lower than 50 V. When the sound wave generator 526 includes one layer of drawn carbon nanotube film, the thermoacoustic device 50 can satisfy the formula:

$$1\Omega \le \frac{R_1}{(n-1)^2} \le 125\Omega \tag{1}$$

wherein n represents a total number of the first electrodes 522 and the second electrodes 524, R1 represents a resistance of the sound wave generator 526 in the direction from the first electrodes 522 to the second electrodes 524. The thermoacoustic device 50 satisfying the expression can work under a working voltage of lower than 50 V, and an input power of lower than 20 watts.

When the sound wave generator 526 includes two or more layers of drawn carbon nanotube films stacked on each other, and the layers of drawn carbon nanotube films are labeled as m, it is believed the thermoacoustic device 50 satisfies the formula:

$$1\Omega \le \frac{R}{m(n-1)^2} \le 125\Omega \tag{2}$$

wherein n represents a total number of the first electrodes 522 and the second electrodes 524 added together, R represents a resistance of one layer of drawn carbon nanotube film in the direction from the first electrodes 522 to the second electrodes 524. The sound wave generator 526 can include one layer of drawn carbon nanotube film playing a role of supporting the other layers of drawn carbon nanotube films. When the drawn carbon nanotube film is perpendicular to the direction extending from the first electrodes 522 to the second electrodes 524, the layer of the drawn carbon nanotube film is not calculated in "m". That is, these not-calculated layer(s) of the drawn carbon nanotube films are, for all intents and purposes, not directly electrically connected to the first electrodes 522 and the second electrodes 524. For example, if the sound wave generator 526 includes four layers of drawn carbon nanotube films. The carbon nanotubes in the first and third layers are arranged along a same direction and electrically connected to the first electrodes 522 and the second electrodes 524, and the carbon nanotubes in the second and fourth layers are arranged along a direction that is perpendicular to the direction extending from the first electrodes 522 to the second electrodes 524, the calculated number of the layers of drawn carbon nanotube films is two.

Figure 13:
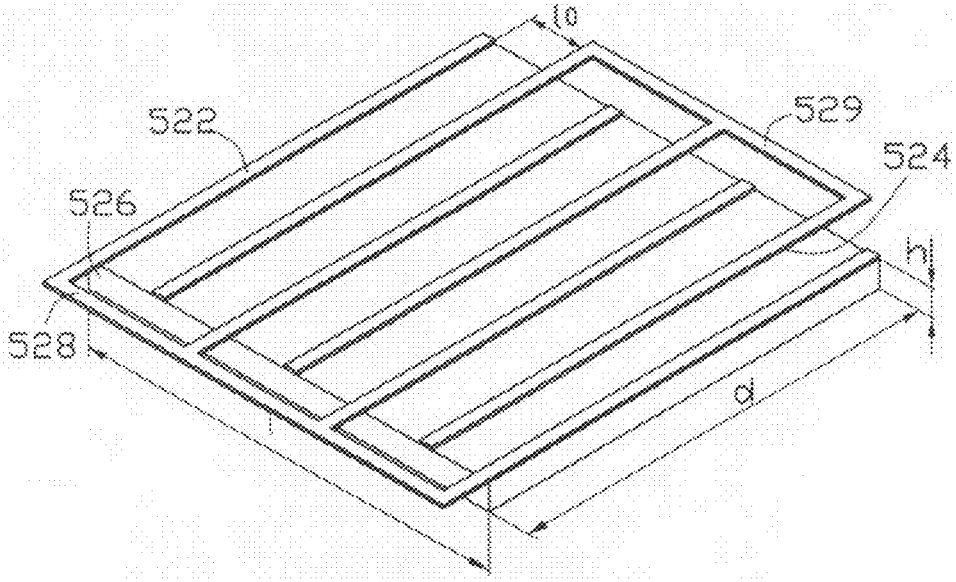
FIG. 13 shows an embodiment of a sound wave generator including a single layer carbon nanotube film and a plurality of first and second electrodes attached to the single layer carbon nanotube film.

Referring to the embodiment shown in FIG. 13, it shows a sound wave generator and a plurality of first and second electrodes. The sound wave generator comprises of a single layer carbon nanotube film. The plurality of first and second electrodes is attached to the single layer carbon nanotube film. For clarity purpose, FIG. 13 only shows the sound wave generator 526, a plurality of first electrodes 522, and a plurality of second electrodes 524, a first conductive element 528, and a second conductive element 529 of the thermoacoustic device 50. The first electrodes 522 and the second electrodes 522 are alternately arranged at uniform intervals. The first conductive element 528 is electrically connected to a common end of the first electrodes 522. The second conductive element 529 is electrically connected to a common end of the second electrodes 524. The first conductive element 528 and the second conductive element 529 are located at opposite sides of the sound wave generator 526 and spaced apart from the sound wave generator 526.

The thermoacoustic device 50 of FIG. 13 will be taken as an example to illustrate the derivation process of the formula (1) and formula (2).

The sound wave generator 526 is a resistance element, and can be a film or layer like structure. In one embodiment, the sound wave generator 526 has a length of l, a width of d and a thickness of h. The thickness is uniform and is a constant. When a voltage is applied by the first and second electrodes 522, 524, current passes through the whole area of the sound wave generator 526, a resistance of the sound wave generator 526 along the direction extending from the first electrodes 522 to the second electrodes 524 satisfies the formula:

$$R_1 = k\frac{l}{S} = k\frac{l}{dh} \tag{3}$$

wherein k represents a resistance of the sound wave generator 526, S represents an area of a cross-section of the sound wave generator 526 along the direction extending from the first electrodes 522 to the second electrodes 524. Since k relates to properties of the material of the sound wave generator 526, the sound wave generator 526 has a uniform conductivity, thus, k is a constant.

When the contact resistances between the first electrode 522 and the sound wave generator 526, and the contact resistances between the second electrodes 524 and the sound wave generator 526 are omitted, resistance of the thermoacoustic device 50 is equal to the resistance of the sound wave generator 526, that is, $R_2=R_1$, wherein R2 represents the resistance of the thermoacoustic device 50.

When the sound wave generator 526 is a square drawn carbon nanotube film (l=d), R1 is a constant and equal to a sheet resistance of the drawn carbon nanotube film, that is $$R_1 = Rs = \frac{k}{h},$$

wherein Rs represents the resistance of the drawn carbon nanotube film. The sheet resistance of the drawn carbon nanotube film can be in a range from about 800 Ohms to about 1000 Ohms.

Since the total number of the first electrodes 522 and the second electrodes 524 is n, the sound wave generator 526 is divided into n−1 portions. The length of the sound wave generator 526 in each portion is $$l_0 = \frac{l}{n-1},$$

when the current flows from the first electrode 522 to the second electrode 524, the cross-section area $S_0$ of each portion of the sound wave generator 526 is substantially equal to S, that is $S_0=S=dh$. Thus, resistance $R_0$ of each portion of the sound wave generator 526 along a direction extending from the first electrode 522 to the second electrode 524 satisfies the formula:

$$R_0 = k\frac{l_0}{S_0} = k\frac{l_0}{dh} = k\frac{l}{(n-1)dh} \tag{4}$$

Since the parallel connections of portions of the sound wave generator 526 between the first electrodes 522 and the second electrodes 524, the resistance R2 of the thermoacoustic device 50 satisfies the formula:

$$R_2 = \frac{R_0}{n-1} = k\frac{l_0}{(n-1)dh} = k\frac{l}{(n-1)^2 dh} \tag{5}$$

Formula (3) is introduced into formula (5), the following formula (6) results:

$$R_2 = \frac{1}{(n-1)^2}R_1 \tag{6}$$

The relationship of input power, working voltage and resistance of the thermoacoustic device 50 satisfies the formula:

$$P = \frac{U^2}{R_2} \tag{7}$$

When the input power of the thermoacoustic device 50, according to experience, is substantially large than or equal to 20 watts, that is when P≧20 W, the thermoacoustic device 50 can work properly and produce sound waves having intensity enough to be heard. Thus, $$P = \frac{U^2}{R_2} \geq 20\ \text{W} \tag{8}$$

Further, thermoacoustic device 50 should work under a safe voltage U, that is, $$U \leqq 50\text{V} \tag{9}$$

Formula (9) is introduced into formula (8), the following formula (10) results:

$$R_2 = \frac{R_1}{(n-1)^2} \leq 125\Omega \tag{10}$$

Furthermore, in use, since the thermoacoustic device 50 is electrically connected to the amplifier circuit device 70 having a resistance, when the thermoacoustic device 50 has a resistance that is too low, the power consumed by the amplifier circuit device 70 would be too high, thus the resistance of the thermoacoustic device 50 should large than 1 Ohm, that is $$1\Omega \le \frac{R_1}{(n-1)^2} \le 125\Omega, \quad (1)$$

Thus, the number of the electrodes n should meet the relationship of Formula (1) and n can be determined by determining $R_1$. In other words, the number of the electrodes n and the $R_1$ play an important role in determining the resistance of the thermoacoustic device 50.

Further, formula (6) is introduced into formula (7), n satisfies the formula:

$$n = \sqrt{\frac{PR_1}{U^2}} + 1 \quad (11)$$

According to formula (11), when the input power P and the working voltage U of the thermoacoustic device 50 are constants, the number of the electrodes n is determined by the resistance R1 of the sound wave generator 526. In other words, the resistance R1 of the sound wave generator 526 can be adjusted by changing the number of the electrodes to meet the requirements of the working conditions of P and U.

Figure 14:
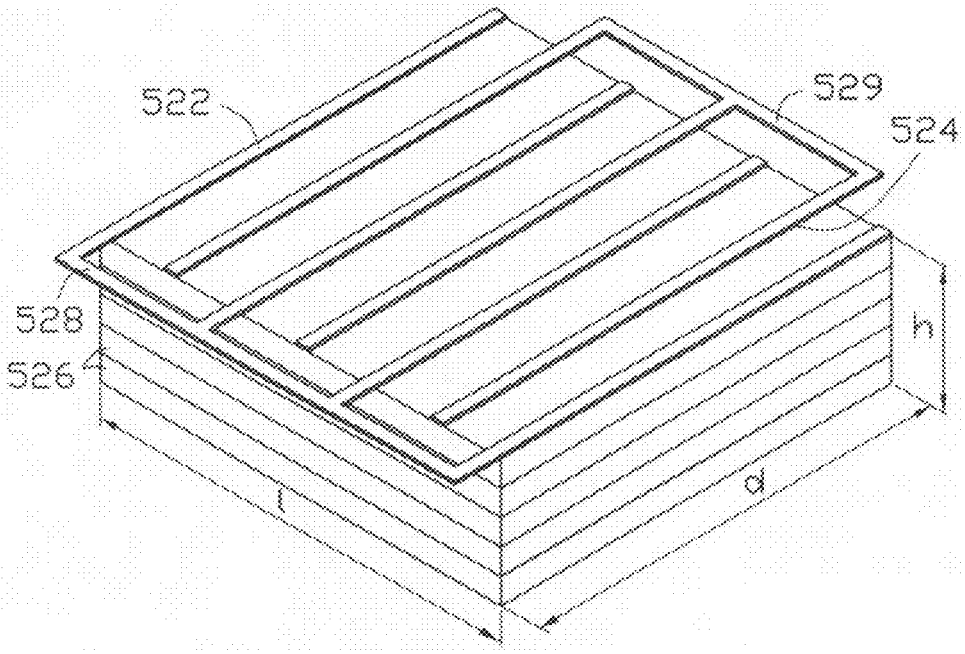
FIG. 14 shows an embodiment of a sound wave generator including a plurality of layers of carbon nanotube film with a plurality of first and second electrodes.

Referring to the embodiment shown in FIG. 14, the sound wave generator 526 includes m layers of drawn carbon nanotube films stacked with each other, and $$R_1 = \frac{R}{m},$$

wherein R represents the resistance of each layer of drawn carbon nanotube film along a direction extending from the first electrodes 522 to the second electrodes 524. Thus, according the combination of formula (6) and formula (1), the following formulas results:

$$R_2 = \frac{1}{m(n-1)^2} R \quad (12)$$

$$1\Omega \le \frac{R}{m(n-1)^2} \le 125\Omega \quad (2)$$

Wherein m represents the layer of the drawn carbon nanotube films in which the carbon nanotubes extend from the first electrodes 522 to the second electrodes 524.

When the drawn carbon nanotube film has a square shape, that is R=Rs. R in formulas (12) and (2) is the sheet resistance of the drawn carbon nanotube film. The sheet resistance of the drawn carbon nanotube film can be in a range from about 800 ohms to about 1000 ohms. When the sheet resistance of the drawn carbon nanotube film is 1000 ohms, according to formula (2), m and n satisfy the formula: $8 \leqq m(n-1)^2 \leqq 1000$, that is $4 \leqq n \leqq 32$. When the layer m of the drawn carbon nanotube film is 2, $3 \leqq n \leqq 23$.

The input power of the thermoacoustic device 50 relates to the area of the sound wave generator 526. When the sound wave generator 526 is at least one layer of drawn carbon nanotube film, power density of the thermoacoustic device 50 is about 1 w/cm$^2$ (watt per square centimeters). In one embodiment, the input power P of the thermoacoustic device 50 is less than 500 watt, that is $20\ W \leqq P \leqq 500\ W$. According to formula (11), when the working voltage of the thermoacoustic device 50 is 42 volts, 36 volts, 24 volts or 12 volts, and m=1, the number n of the electrodes satisfying the scope is listed in the table 1 as follows:

TABLE 1

| | working voltage (volts) | | | |
|---|---|---|---|---|
| | 42 | 36 | 24 | 12 |
| n | $5 \leqq n \leqq 17$ | $5 \leqq n \leqq 20$ | $7 \leqq n \leqq 30$ | $13 \leqq n \leqq 59$ |

When m=2, $$n = \sqrt{\frac{PR_1}{2U^2}} + 1,$$

the number n of the electrodes satisfying the scope is listed in the table 2 as follows:

TABLE 2

| | working voltage (volts) | | | |
|---|---|---|---|---|
| | 42 | 36 | 24 | 12 |
| n | $4 \leqq n \leqq 12$ | $4 \leqq n \leqq 14$ | $6 \leqq n \leqq 21$ | $10 \leqq n \leqq 42$ |

In one embodiment, the sound wave generator 526 is a single drawn carbon nanotube film, the resistance of the thermoacoustic device 50 is in a range from about 4 ohms to about 12 ohms. The working voltage of the thermoacoustic device 50 is about 12 volts, 24 volts or 36 volts. In another embodiment, when the input power P of the thermoacoustic device 50 is 100 watts and the working voltage is 36 volts, the number of the electrodes is 10.

Supporting Frame

Figure 15:
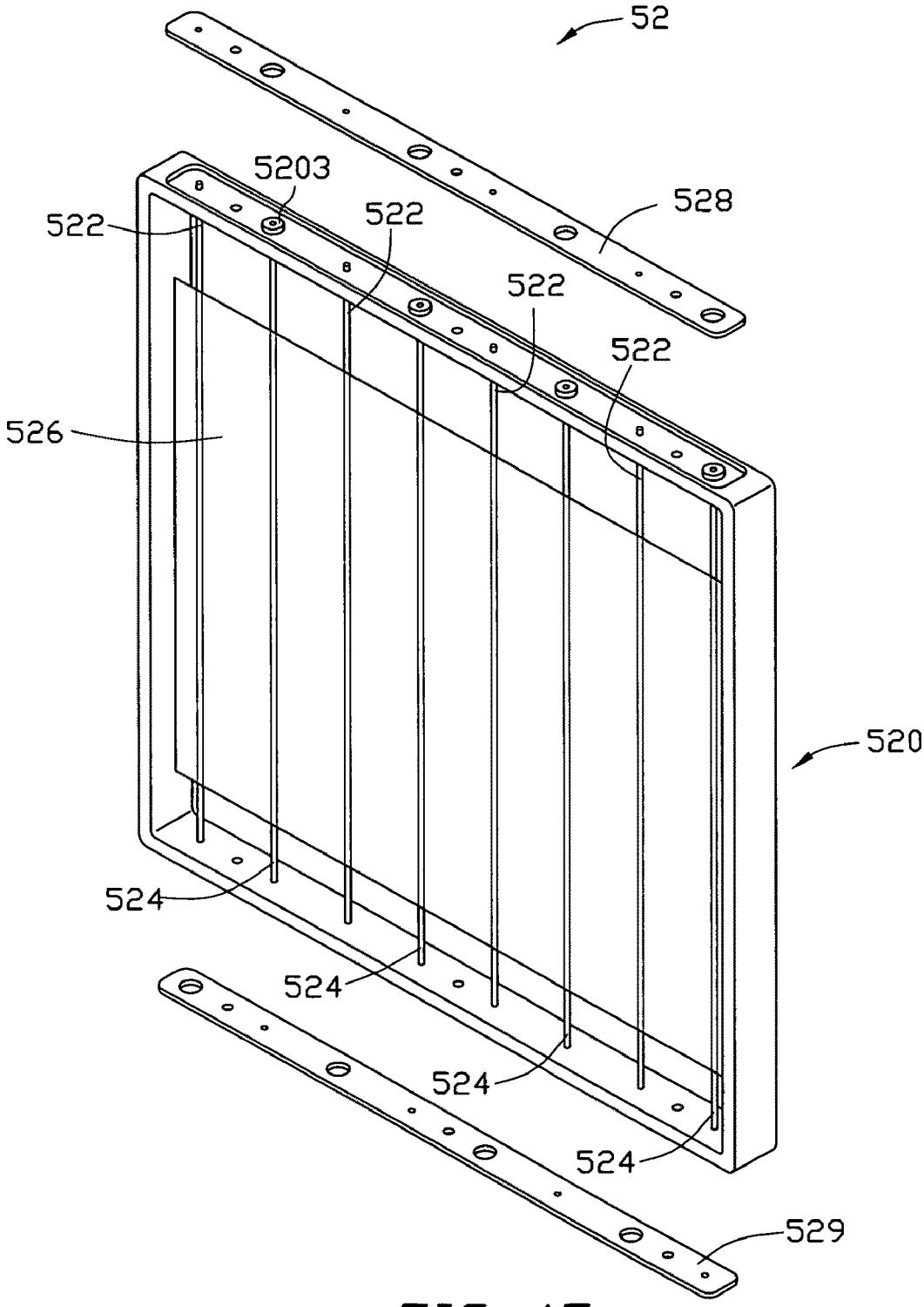
FIG. 15 is a schematic structural view of one embodiment of a thermoacoustic module.
Figure 16:
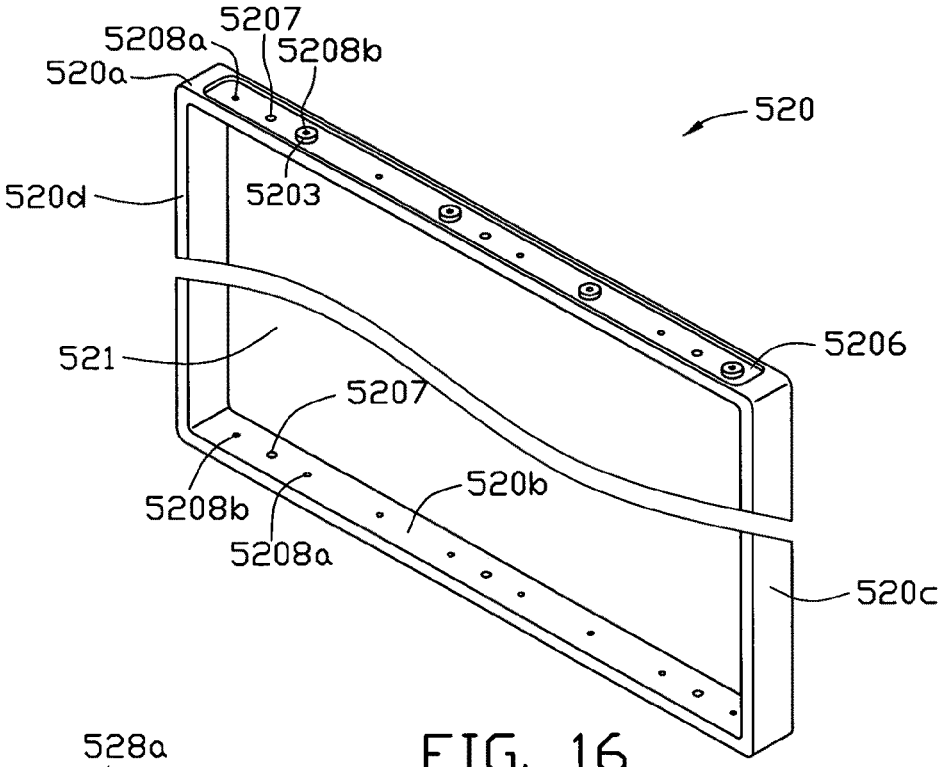
FIG. 16 is a schematic structural view of a supporting frame shown in FIG. 15.

Referring to the embodiment shown in FIGS. 15-16, the supporting frame 520 can play a role in supporting the first and second electrodes 522, 524. The supporting frame 520 is made of insulating materials, such as glass, ceramics, resin, wood, quartz or plastic. In one embodiment, the material of the supporting frame 520 is resin. The supporting frame 520 includes a first beam 520*a*, a second beam 520*b*, a third beam 520*c* and a fourth beam 520*d* joined end to end to define a space 521. The first and second electrodes 522, 524 are located in the space 521. A thickness of the supporting frame 520 can be larger than the thickness of the first electrodes 522 or the second electrodes 522, 524 and the thickness of the sound wave generator 526. The thermoacoustic module 52 further includes a plurality of insulators 5203. The insulators 5203 can be made of glass, ceramic, resin, wood, quartz or plastic. In one embodiment, the insulators 5203 are made of plastic. The first electrodes 522 are electrically connected by the first conductive element 528 and insulated from the second conductive element 529 by the insulators 5203. The second electrodes 524 are electrically connected by the second conductive element 529 and insulated from the first conductive element 528 by the insulators 5203.

In one embodiment, the first beam 520*a*, the second beam 520*b*, the third beam 520*c* and the fourth beam 520*d* can be formed from one piece of material. The first and second electrodes 522, 524 can be perpendicular to the first and second beams 520*a*, 520*b*, and parallel to the third and fourth beams 520*c*, 520*d*. A first concavity 5206 is defined in the first beam 520*a* for receiving the first conductive element 528. The first concavity 5206 has a bottom surface with four first through holes 5208*a*, three installing holes 5207 and four insulators 5203. The first through holes 5208*a* and the insulators 5203 are arranged alternately. The insulators 5203 and the supporting frame 520 can be formed from one piece of material. A second through hole 5208*b* extends through the insulators 5203 and the first beam 520*a*. A distance between each of the first through holes 5208*a* of the first beam 520*a* and each of the second through holes 5208*b* of the first beam 520*a* is equal.

The second beam 520*b* has a same structure as that of the first beam 520*a*. The second beam 520*b* has a second concavity (not shown) the same as the first concavity 5206 for receiving the second conductive element 529. The second concavity also has a bottom surface with four first through holes 5208*b*, three installing holes 5207 and four insulators (not shown) having a cylinder shape. The first through holes 5208*a* and the insulators are alternately arranged. The insulators and the supporting frame 520 can be formed from one piece of material. The first through holes 5208*a* of the second beam 520*b* are opposite to the second through holes 5208*b* of the first beam 520*a* in a one-to-one manner. A second through hole 5208*b* extends through the insulators 5203 and the second beam 520*b*. The second through holes 5208*b* of the second beam 520*b* are opposite to the first through holes 5208*a* of the first beam 520*a* in a one-to-one manner.

It is to be understood that the insulators and the supporting frame 520 can be formed separately and then assembled together.

Figure 17:
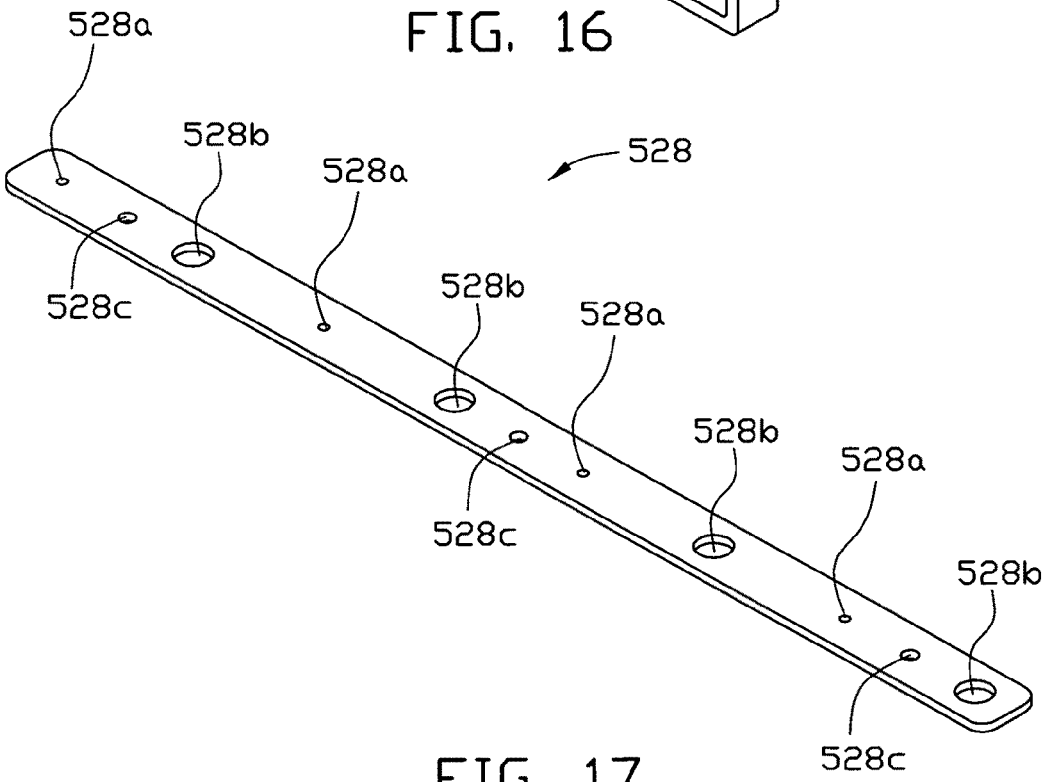
FIG. 17 is a schematic structural view of a first conductive element shown in FIG. 15.

The first conductive element 528 and the second conductive element 529 have a same structure, and the first conductive element 528 is shown as an example to be described in detail. Referring to the embodiment shown in FIG. 17, the first conductive element 528 is a sheet. The first conductive element 528 can be made of metal or alloy, such as gold, silver, copper, iron, nickel, palladium, platinum, any alloy thereof, or other suitable material. In one embodiment, the first conductive element 528 is a rectangle copper sheet. The copper sheet corresponds with an inner surface of the first concavity 5206. An insulating layer (not shown) can be further provided on the top surface of the first conductive element 528 to insulate the first conductive element 528 with the surrounding medium. Thus, the thermoacoustic module 52 is insulated and safe to use. It is understood that the insulating layer is optional.

The first conductive element 528 can have a plurality of conductive holes 528*a*, a plurality of insulating holes 528*b*, and a plurality of fixing holes 528*c*. The conductive holes 528*a* and the insulating holes 528*b* are alternately arranged. A distance between adjacent conductive holes 528*a* and insulating holes 528*b* is equal to the distance between the first through holes 5208*a* and the second through holes 5208*b* of the first beam 520*a*. The plurality of fixing holes 528*c* is used to fix the first conductive element 528 to the supporting frame 520.

In one embodiment, both the first conductive element 528 and the second conductive element 529 have four conductive holes 528*a*, three fixing holes 528*c*, and four insulating holes 528*b*. The first conductive element 528 is received in the first concavity 5206 of the first beam 520*a*. The four insulators 5203 of the first beam 520*a* are located in the four insulating holes 528*b* of the first conductive element 528, and each insulator 5203 corresponds to one of the insulating holes 528*b*. The first through holes 5208*a* of the first beam 520*a* align with the conductive holes 528*a* of the first conductive element 528 in a one-to-one manner. The installing holes 5207 of the first beam 520*a* align with the fixing holes 528*c* of the first conductive element 528 in a one-to-one manner, so that bolts extend through the fixing holes 528*c* and the installing holes 5207. Thus, the first conductive element 528 is fixed on the first beam 520*a*. The second conductive element 529 can be fixed on the second beam 520*b* in the same way.

One end of each of the four first electrodes 522 extends through one corresponding first through hole 5208*a* of the first beam 520*a* and one corresponding conductive hole 528*a* of the first conductive element 528, and then secured to the first conductive element 528. Thus, the four first electrodes 522 are electrically connected to the first conductive element 528. The other end of each of the four first electrodes 522 extends through one corresponding second through hole 5208*b* of the second beam 520*b* and electrically insulated from the second conductive element 529.

One end of each of the four second electrodes 524 extends through a first through hole 5208*a* of the second beam 520*b* and one corresponding conductive hole 528*a* of the second conductive element 529. The four second electrodes 524 can be welded to the second conductive element 529. Thus, the four second electrodes 524 are electrically connected to the second conductive element 529. The other end of each of the four second electrodes 524 extends through one corresponding second through hole 5208*b* of the first beam 520*a* and electrically insulated from the first conductive element 528. Use of the above connection can reduce the size of the thermoacoustic device 50. Thus it is conducive for mass production of the thermoacoustic device 50 and to be applied to other devices, such as mobile phones, MP3, MP4, TV, computers and other sound producing devices.

It is to be understood that the electrical connection between the first or second electrodes 522, 524 and the first or second conductive element 528, 529 is not limited to the above described methods, other ways electrically connect the first or second electrodes 522, 524 with the first or second conductive element 528, 529 such as welding the electrodes 522, 524 on the conductive element 528, 529 directly, or thread engagement, can be adopted.

It is also understood that the ways for the first or second conductive element 528, 529 fixed on the supporting frame 520 can be varied. Other ways such as using an adhesive or a clip to fix the first or second conductive element 528, 529 on the supporting frame 520, can be adopted.

In other embodiments, the insulators 5203 are optional. When the first beam 520*a* and the second beam 520*b* do not include the insulators 5203, the first or second conductive elements 528, 529 would not include the insulating holes 528*b*. The first electrodes 522 insulated from the second conductive element 529, and the second electrodes 524 insulated from the first conductive element 529 can be by other means. In one embodiment, one end of each of the four first electrodes 522 extends through the first beam 520*a* and welded on the first conductive element 528. The other end of each of the four first electrodes 522 does not extend through the second beam 520*b*. Thus, the four first electrodes 522 are electrically insulated from the second conductive element 529. Similarly, one end of each of the four second electrodes 524 extends through the second beam 520*b* and welded on the second conductive element 529. The other end of each of the four second electrodes 524 does not extend through the first beam 520*a*. Thus, the four second electrodes 524 are electrically insulated from the first conductive element 528. Signals are input to the sound wave generator 526 via the first and second conductive elements 528, 529, and the first and second electrodes 522, 524.

It is understood that the first concavity 5206 and the second concavity are optional. The first and second conductive elements 528, 529 can be fixed on the first beam 520*a* and the second beam 520*b* directly.

Figure 18:
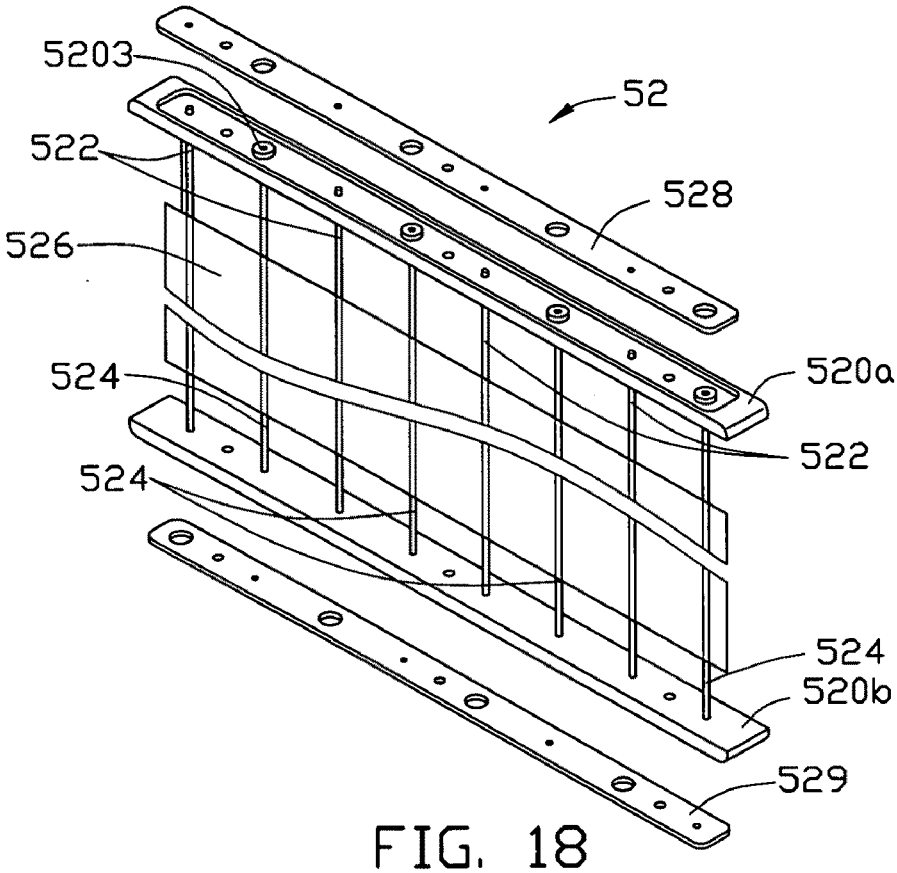
FIG. 18 is a schematic structural view of one embodiment of a thermoacoustic module.

Referring to the embodiment shown in FIG. 18, the supporting frame 520 includes the first beam 520*a* and the second beam 520*b*. The insulators 5203 can be secured on the first beam 520*a* and the second beam 520*b* by an adhesive.

Figure 19:
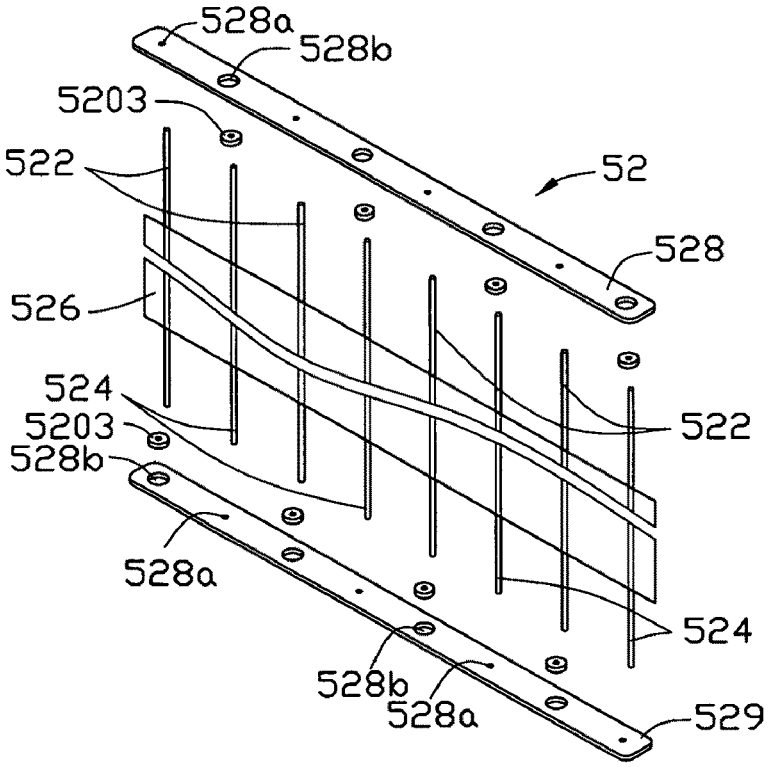
FIG. 19 is a schematic structural view of one embodiment of a thermoacoustic module.

Referring to the embodiment shown in FIG. 19, the supporting frame 520 is optional. The thermoacoustic module 52, without the supporting frame 520, includes the plurality of first electrodes 522, the plurality of second electrodes 524, the first and second conductive elements 528, 529, the plurality of insulators 5203 and the sound wave generator 526. The plurality of first electrodes 522 and the plurality of second electrodes 524 are arranged separately and alternately between the first conductive element 528 and the second conductive element 529. The plurality of first electrodes 522 and the plurality of second electrodes 524 are also supported by the first conductive element 528 and the second conductive element 529. The plurality of first electrodes 522 is electrically connected to the first conductive element 528 and insulated from the second conductive element 529 by the insulators 5203. The plurality of second electrodes 524 is electrically connected to the second conductive element 529 and insulated from the first conductive element 528 by the insulators 5203. Since the thermoacoustic module 52 is without the supporting frame 520, the first and second conductive elements 528, 529 can be without the fixing holes 528*c*. The plurality of insulators 5203 are located in the insulating holes 528 of the first and second conductive elements 528, 529, such as by an adhesive.

One end of each of the first electrodes 522 is inserted into the conductive hole 528*a* of the first conductive element 528, and secured on the first conductive element 528. The other end of each of the first electrodes 522 is inserted into one insulator 5203 located in the corresponding one insulating hole 528*b* of the second conductive element 529. Thereby the first electrodes 522 are electrically insulated from the second conductive element 529. One end of each of the second electrodes 524 is inserted into the conductive hole 528*a* of the second conductive element 529 and welded on the second conductive element 529. The other end of each of the second electrodes 524 is inserted into one insulator 5203 located in corresponding one insulating hole 528*b* of the first conductive element 528. Thus, the second electrodes 524 are electrically insulated from the first conductive element 528. One of the second electrodes 524 extends out of the second conductive element 529 and electrically connects with the fourth connector 57.

It is understood that there are other ways that the plurality of first electrodes 522 and the plurality of second electrodes 524 can be located between the first conductive element 528 and the second conductive element 529. For example, one end of each of the plurality of first electrodes 522 can be welded on the first conductive element 528, and the other end of each of the plurality of first electrodes 522 is inserted into one insulator 5203 located in corresponding one insulating hole 528*b* of the second conductive element 529. One end of each of the plurality of second electrodes 524 can be welded on the second conductive element 529 directly and the other end of each of the plurality of second electrodes 524 is inserted into one insulator 5203 located in corresponding insulating hole 528*b* of the first conductive element 528.

Two Protection Components

Referring to the embodiment shown in FIG. 8, the two protection components 54 can be used to protect the sound wave generator 526. The sound wave generator 526 is located between the two protection components 54. The protection components 54 have a good heat resistance property. In one embodiment, the protection components 54 also have a high sound transmission property. The protection components 54 can have a planar shape and/or a curved shape. When the protection components 54 each have a planar shape, the two protection components 54 and the sound wave generator 526 can be separately located by a supporter (not shown), such as by the supporting frame 520. A material of the protection components 54 is not limited, and can be conductive material or insulated material. A material of the protection components 54 can be metal or plastic. The metal can include stainless steel, carbon steel, copper, nickel, titanium, zinc and aluminum. The protection components 54 can be a porous structure, such as a grid; or a non-porous structure, such as glass plate. In one embodiment, one protection component 54 is a grid, and the other protection component 54 is a glass plate. In another embodiment, both the protection components 54 are plastic grids. The grids have a plurality of through holes. Percentage of area of the plurality of through holes to that of the protection components can be above 0% and less than 100%. In one embodiment, the percentage of area of the plurality of through holes to that of the protection components can be above 20% and less than 99%. In another embodiment, the percentage of area of the plurality of through holes to that of the protection components can be above 30% and less than 80%. Shape and distribution of the plurality of through holes can be varied. It is understood that the higher the percentage of area of the plurality of through holes to that of the protection components, the better the thermal interchange between the sound wave generator 526 and the surrounding medium. The less the percentage of area of the plurality of through holes to that of the protection components, the worse the thermal interchange between the sound wave generator 526 and the surrounding medium.

Referring to the embodiment shown in FIGS. 8-9, the protection components 54 can include a border (not shown). The ways for fixing the protection components 54 and the supporting frame 520 can be varied, such as by clips or bolts. In one embodiment, the protection components 54 and the supporting frame 520 are connected by clips, and at least one buckle 5204 is located on the third and fourth beams 520*c*, 520*d*. Each of the protection components 54 has at least one slot 540 that match the at least one buckle 5204 of the third and fourth beams 520*c*, 520*d* for fixing the protection components 54 on the supporting frame 520. The location of the buckle 5204 on the third and fourth beams 520*c*, 520*d* can be varied. In one embodiment, one buckle 5204 is located on the third beam 520*c* and is adjacent to the first beam 520*a*, and one buckle 5204 is located on the fourth beam 520*d* and is adjacent to the second beam 520*b*.

Figure 20:
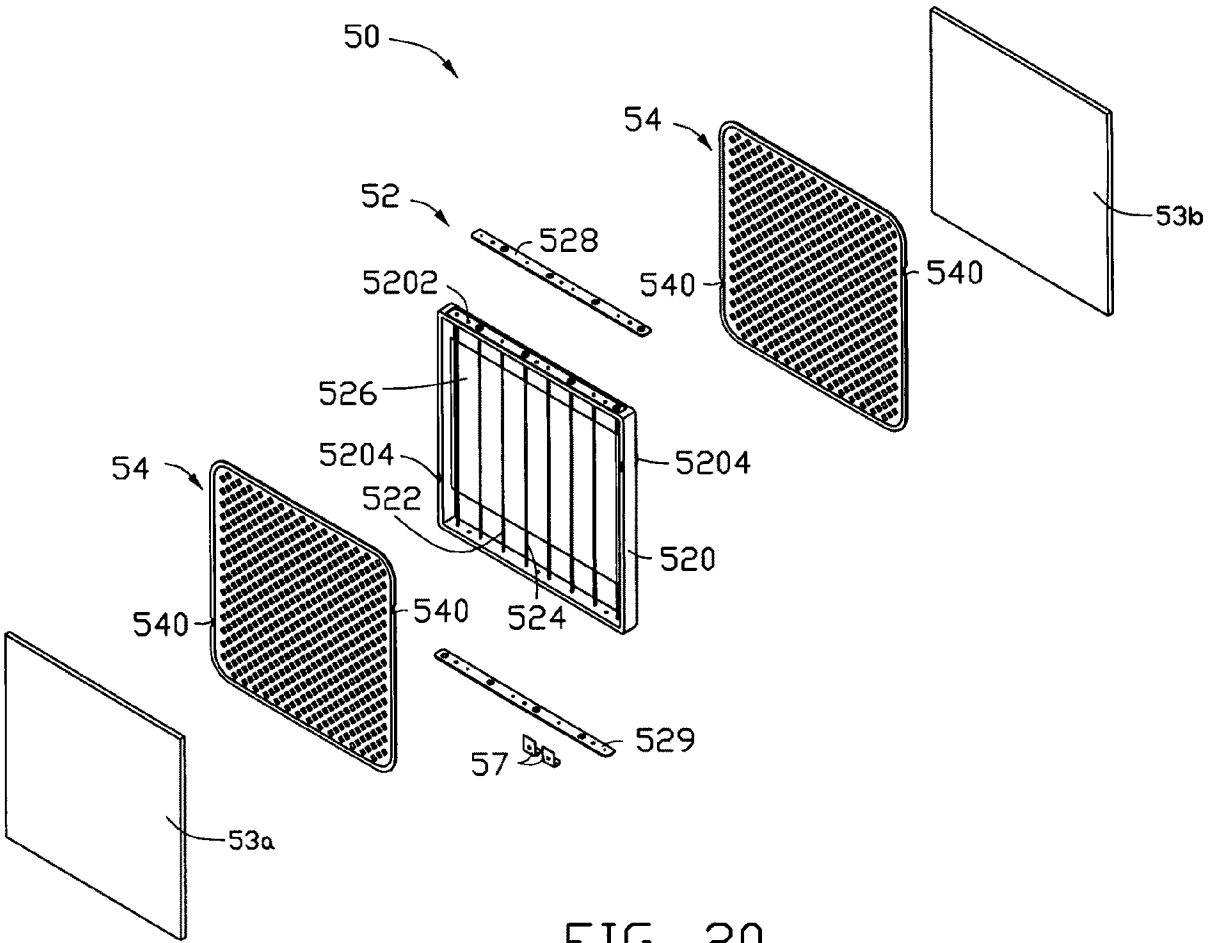
FIG. 20 is a schematic structural view of an embodiment of a thermoacoustic module with two protection components, wherein an infrared-reflective film and an infrared transmission film are located on the two protection components.

In one embodiment, referring to FIG. 20, an infrared-reflective film 53*a* can be located on a surface of one of the protection components 54. In one embodiment, the infrared-reflective film 53*a* can be located on an inner surface or an outer surface of one of the protection components 54. The infrared-reflective film 53*a* is spaced from the sound wave generator 526. The infrared-reflective film 53*a* can reflect infrared away from the user. In one embodiment, the infrared-reflective film 53*a* has a good heat insulation effect. A material of the infrared-reflective film 53*a* can be varied. The infrared-reflective film 53*a* can have a high infrared reflectivity.

The infrared-reflective film 53*a* can include a substrate and a reflective film attached on the substrate. The reflective film can be metallic reflective film. The metal can include gold, silver, copper and other materials having a good infrared reflective property. The substrate can comprise of polymers or fabrics. In one embodiment, the substrate includes a polyester film. The metallic reflective film can be prepared by sputtering a layer of metal material having a good infrared reflective property on the substrate. At least one layer of dielectric film can be located on a surface of the metal reflective film. A material of the dielectric film includes silicon oxide, magnesium fluoride, silicon dioxide or aluminum oxide. The dielectric film can be used to protect the metal reflective film. The infrared-reflective film 53*a* can be made of transparent material or opaque material. In one embodiment, the infrared-reflective film 53*a* is made of transparent material. The infrared reflectivity of the infrared-reflective film 53*a* can be in a range from about 20% to about 100%. In other embodiments, the infrared reflectivity of the infrared-reflective film 53*a* can be in a range from about 70% to about 99%. In another embodiment, the infrared-reflective film 53*a* is a polyester film with a layer of silver film thereon, and the infrared reflectivity of the infrared-reflective film 53*a* is about 95%. The infrared-reflective film 53*a* is located on an outer surface of one of the protection components 54. A metal reflective film can be formed directly on the protection component 54 and serve as the infrared-reflective film 53*a*.

A distance between the infrared-reflective film 53*a* and the sound wave generator 526 can be varied. In one embodiment, the distance between the infrared-reflective film 53*a* and the sound wave generator 526 is such that it will not affect the heat exchange between the sound wave generator 526 and the surrounding medium and effectively reflect the infrared to the side of the sound wave generator 526 away from the user. In one embodiment, the distance between the infrared-reflective film 53*a* and the sound wave generator 526 is about 10 millimeters.

An infrared transmission film 53*b* can be located on a surface of the other protection component 54. The infrared transmission film 53*b* can increase the transfer of the infrared at the side away from the user. Further, when the protection component 54 is a porous structure, the infrared transmission film 53*b* can be located on the protection component 54 and further play a role of protecting the sound wave generator 526. A material of the infrared transmission film 53*b* can have a high infrared transmission. The material of the infrared transmission film 53*b* can be zinc sulfide, zinc selenide, diamond, diamond-like carbon, and other materials having a high infrared transmittance in the infrared band. A transmission of the infrared transmission film 53*b* can be in a range from about 10% to about 99%. In one embodiment, the transmission of the infrared transmission film 53*b* can be in a range from about 60% to about 99%. In another embodiment, the material of the infrared transmission film 53*b* is zinc sulfide, and the transmission thereof is about 90%. It is understood that the infrared transmission film 53*b* is optional.

In use, the sound wave generator 526 can radiate electromagnetic waves to the surrounding medium to exchange heat with the surrounding medium. During the process, the infrared-reflective film 53*a* can change the propagation direction of the infrared radiated from the sound wave generator 526. Thus, infrared heat can be directed away from the user.

It is to be understood that the infrared-reflective film 53*a* and the infrared transmission film 53*b* also can be fixed directly on the supporting frame 520. The infrared-reflective film 53*a* and the infrared transmission film 53*b* can play a role of protecting the sound wave generator 526. In one embodiment, both the infrared-reflective film 53*a* and the infrared transmission film 53*b* have a free-standing structure. The size of the infrared-reflective film 53*a* and the infrared transmission film 53*b* can be the same as that of the supporting frame 520. The infrared-reflective film 53*a* and the infrared transmission film 53*b* can be fixed on the beams 520*a*, 520*b*, 520*c* and 520*d* of the supporting frame 520 by an adhesive.

Figure 21:
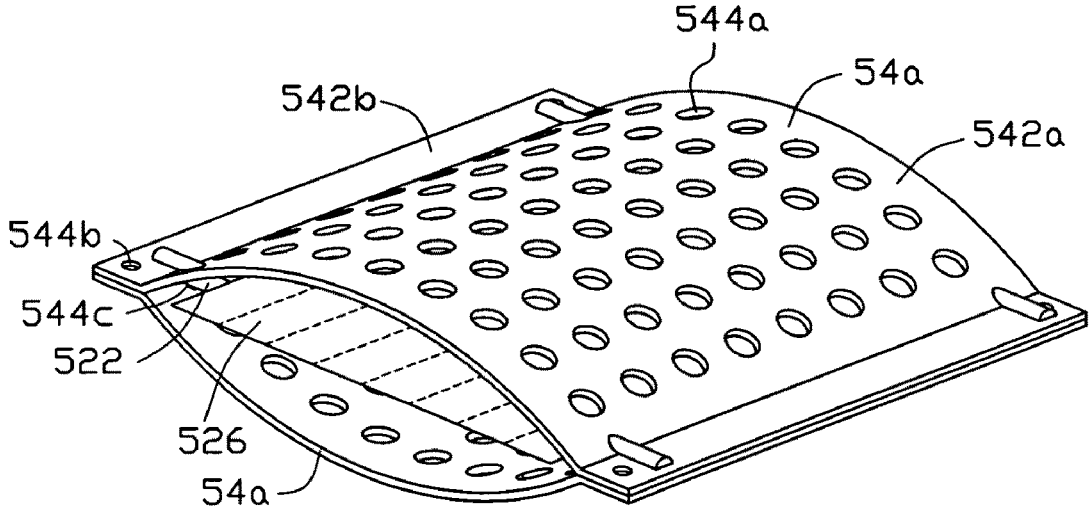
FIG. 21 is a schematic structural view of one embodiment of two curved protection components working together to fix the sound wave generator and the first and second electrodes therebetween.

The two protection components 54 can have other designs. Referring to the embodiment shown in FIGS. 21 and 22, two curved protection components 54*a* are shown. The curved protection components 54*a* can have a semi-circular shape or an arc shape. The sound wave generator 526 can be suspended between the two curved protection components 54*a* by the first electrodes 522 and the second electrodes 524. In one embodiment, the curved protection components 54*a* are plastic grids. Each of the two curved protection components 54*a* has a bow-shaped board 542*a* and two flat boards 542*b*. The two flat boards 542*b* horizontally extend from opposite sides of the bow-shaped board 542*a*. A plurality of through holes 544*a* is defined through the bow-shaped board 542*a*. Two grooves 544*c* are defined in opposite edges of each of the two flat boards 542*b*. The grooves 544*c* extend along a direction from one of the two flat boards 542*b* to the other one. The grooves 544*c* are used to receive the first and second electrodes 522, 524.

Figure 22:
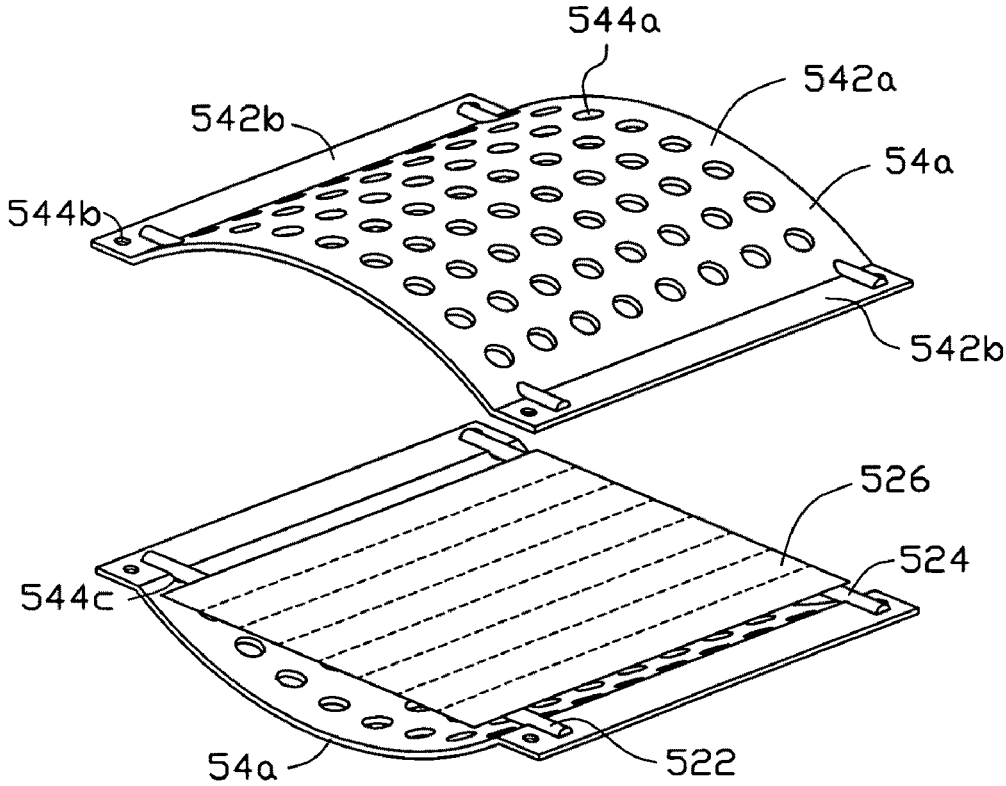
FIG. 22 is an exploded schematic structural view of the two curved protection components, the sound wave generator, and the first and second electrodes shown in FIG. 21.

The two curved protection components 54*a* can be fixed together by the flat boards 542*b*. The two curved protection components 54*a* can be secured together by varying means (e.g. bolts, bonding and riveting). In one embodiment, the flat boards 542*b* each include two or more fixing holes 544*b*, the two curved protection components 54*a* are fixed together by bolts extending through the fixing holes 544*b*. FIG. 22 shows two fixing holes 544*b* in each of the flat boards 542*b*. Two ends of each of the first and second electrodes 522, 524 are located in the grooves 544*c*, thus the first and second electrodes 522, 524 are supported by the curved protection components 54*a*. Each of the first and second electrodes 522, 524 extend between opposite flat boards 542*b*, and spans the bow-shaped boards 542*a*.

The two protection components 54, in other embodiments, can have other structures. Referring to the embodiment shown in FIGS. 23-24, two planar protection components 54*b* connected by two side plates 546*a* and a bottom plate 546*b* to form a box structure having an opening (not labeled). The two planar protection components 54*b* each have a plurality of through holes (not labeled). The structure of the two side plates 546*a* and the bottom plate 546*b* can vary (e.g. a porous structure or a non-porous structure). In one embodiment, the two side plates 546*a* and the bottom plate 546*b* have a same structure as the two planar protection components 54*b*. The two planar protection components 54*b*, the two side plates 546*a* and the bottom plate 546*b* define a receiving room 547. A cover 548 having a substantially same size as the opening is used to seal the box structure. The first and second electrodes 522, 524 are separately fixed on the cover 548, and extend into the receiving room 547. The sound wave generator 526 is located in the receiving room 547 by the first and second electrodes 522, 524.

Figure 23:
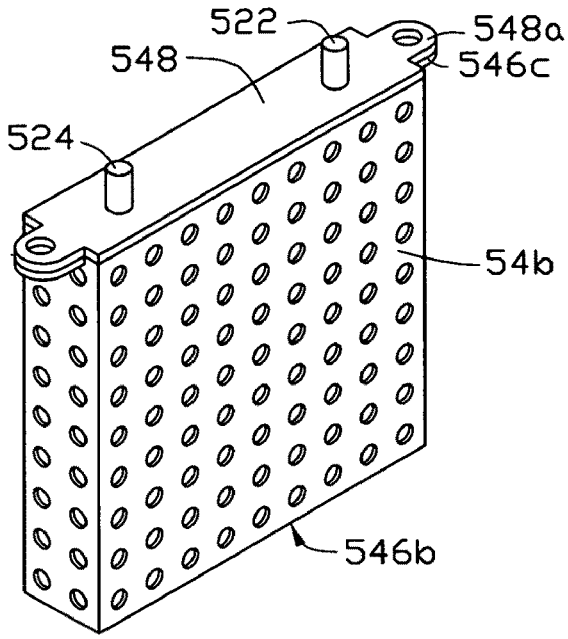
FIG. 23 is a schematic structural view of one embodiment of two planar protection components connected by two side plates and a bottom plate to form a box like structure to fix the sound wave generator and the first and second electrodes therein.
Figure 24:
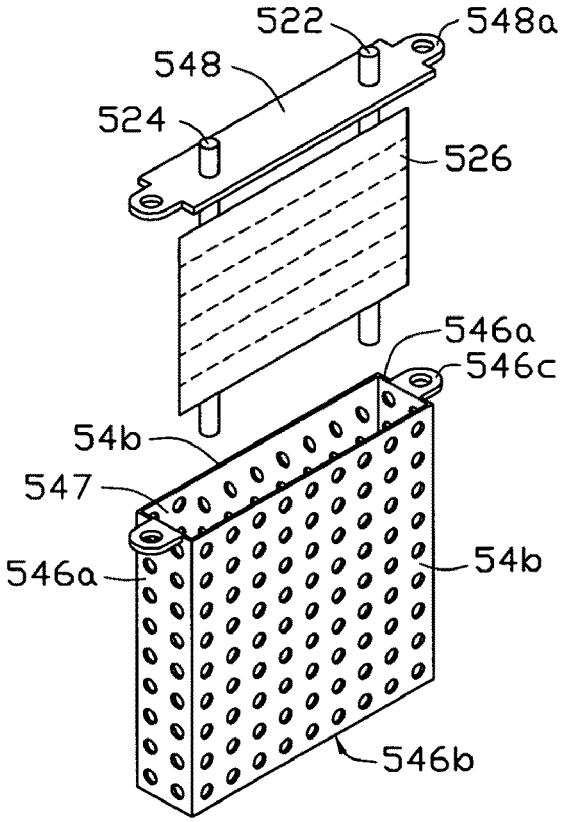
FIG. 24 is an exploded schematic structural view of the two planar protection components, the sound wave generator and the first and second electrodes shown in FIG. 23.

The box structure and the cover 548 can be assembled by bolts or clips. In one embodiment, the box structure and the cover 548 are assembled together by bolts. Specifically, two or more ears 546*c* extend from top portions of the side plates 546*a* adjacent to the opening. Each ear 546*c* has an installation hole. The cover 548 has two or more flanges 548*a* each having an installation hole matching the installation holes of the ears 546*c* of the box structure. In one embodiment, as shown in FIGS. 23-24, the box like structure has two ears 546*c* and the cover 548 has two flanges 548*a*. The installation holes of the ears 546*c* are aligned with the installation holes of the flanges 548*a* in a one-to-one manner, and then bolts are extended through the ears 546*c* and the flanges 548*a*. Thereby, the box structure and the cover 548 are detachably assembled together. As shown in FIG. 24, the cover 548, the first and second electrodes 522, 524 and the sound wave generator 526 can be pre-assembled together before being secured on the box structure. By such a design, the cover 548, the first and second electrodes 522, 524 and the sound wave generator 526 can be easily inserted or drawn out of the box structure like a drawer.

The first and second electrodes 522, 524 and the cover 548 can be formed into one piece or formed from one piece of material. The first and second electrodes 522, 524 can be substantially perpendicular to the cover 548. The cover 548 can be made of insulating material or conductive material. When the cover 548 is made of conductive material, the cover 548 has to be insulated from one of the first and second electrodes 522, 524. The cover 548 can also have a plurality through holes wherein one of the first and second electrodes 522, 524 can be inserted.

First and Second Fixing Frames

The first fixing frame 56 and the second fixing frame 58 are located on two sides of the thermoacoustic module 52. The first fixing frame 56 and the second fixing frame 58 can corporately constitute a frame to fix the thermoacoustic module 52 and the two protection components 54 therebetween. Referring to the embodiment shown in FIGS. 8-9 and 25-27, the first fixing frame 56 and the second fixing frame 58 each can be a rectangular frame. The first fixing frame 56 includes four first bars 560 joined end to end to form a first opening 562. The second fixing frame 58 includes four second bars 580 joined end to end to form a second opening 582. The first bars 560 and the second bars 580 can be planar. The first fixing frame 56 and the second fixing frame 58 corporately define a receiving space 588 to receive the thermoacoustic module 52 and the two protection components 54.

The first fixing frame 56 and the second fixing frame 58 can be fixed by bolts, riveting, clip, scarf joint, adhesive or any other connection means. The first fixing frame 56 and the second fixing frame 58 can be made of the insulating material, such as glass, ceramic, resin, wood, quartz or plastic. In one embodiment, the first fixing frame 56 and the second fixing frame 58 are rectangular frames. The first fixing frame 56 and the second fixing frame 58 are fixed together by bolts.

Referring to the embodiment shown in FIGS. 8-9, a slot 564 is defined in the middle of the exterior surface of the side bar 560 adjacent to the base 40, and two guiding grooves 566 are defined in two sides of the slot 564. A slot 584 is defined in the middle of the exterior surface of the side bar 580 adjacent to the base 40, and two guiding grooves 586 are defined in the side bar 560 at two sides of the slot 584. The hook portions 86 of the fixing piece 80 are detachably engaged in the slots 564, 584 for restricting the thermoacoustic device 50 in the base 40. The guiding grooves 566, 586 match the two guiding bulges 4468 of the base 40. During inserting the thermoacoustic device 50 into the base 40, the thermoacoustic device 50 is positioned above the concavity 4462 with the guiding grooves 566, 586 aiming at corresponding guiding bulges 4468. Then the thermoacoustic device 50 slides into the concavity 4462 guided by the guiding bulges 4468. When the thermoacoustic device 50 slides to contact with the hook portions 86 of the fixing piece 80, the thermoacoustic device 50 pushes the hook portions 86 outwards due to the elasticity of the fixing piece 80 and continues sliding downwards until reaching the bottom plate 4464. At that time, the hook portions 86 slide into the slots 4467 and return to their previous shape to hook into the slots 4467. As a result, the thermoacoustic device 50 is retained in the concavity 4462 of the base 40.

Figure 25:
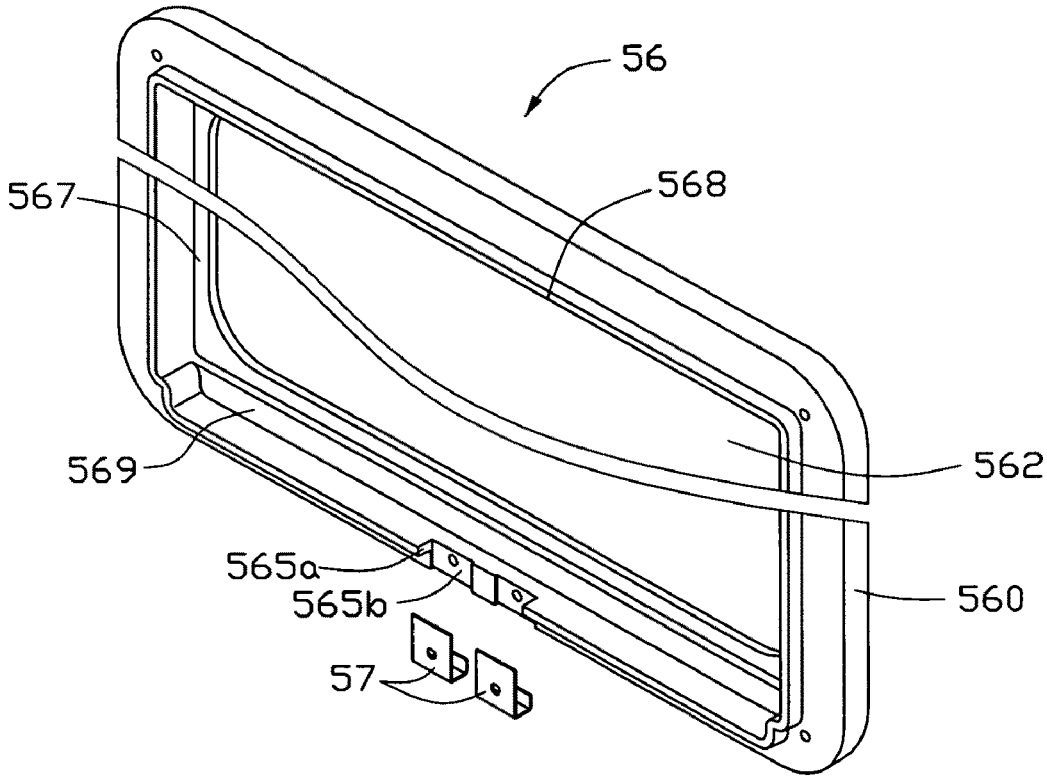
FIG. 25 is a schematic structural view of an embodiment of a first fixing frame.

Referring to the embodiment shown in FIG. 25, a first flange 567 inwardly and perpendicularly extends from an inner edge of each of the first side bar 560 at one side of the first fixing frame 56. A protruding ring 568 extends from an inner edge of the first fixing frame 56. A cutout 565*a* is defined in the protruding ring 568 near a central area of the first bar 560 adjacent to the base 40. Two grooves 565*b* are defined in the central area of the first bar 560 adjacent to the base 40 and communicate with the cutout 565*a*. The cutout 565*a* and the two grooves 565*b* are used to receive a fourth connector 57. The fourth connector 57 can also be referred to as an electrical contact terminal.

The fourth connector 57 can act as a conduit for the outside signals to the thermoacoustic module 52. In one embodiment, the fourth connector 57 is two metal pieces. The two metal pieces are electrically connected to the thermoacoustic module 52 by two conductive wires. Specifically, one metal touch is electrically connected to the first electrodes 522, and the other metal touch is electrically connected to the second electrodes 524. Each of the two metal pieces includes a first portion, secured in the cutout 565*a* and the corresponding groove 565*b*, and a second portion. The second portion perpendicularly extends from the first portion to connect the metal contacts 64 which are exposed outside of the rectangular openings 4465 of the base 40. Furthermore, a supporting plate 569 is provided at a joint portion between the first bar 560 and the flange 567 to support the thermoacoustic module 52 when assembled. Top surface of the supporting plate 569 is lower than that of the flange 567 when the first fixing frame 56 is placed in the position shown in FIG. 27. A wiring trough is defined by the supporting plate 569 and the side bar 560 to receive the conductive wires.

Figure 26:
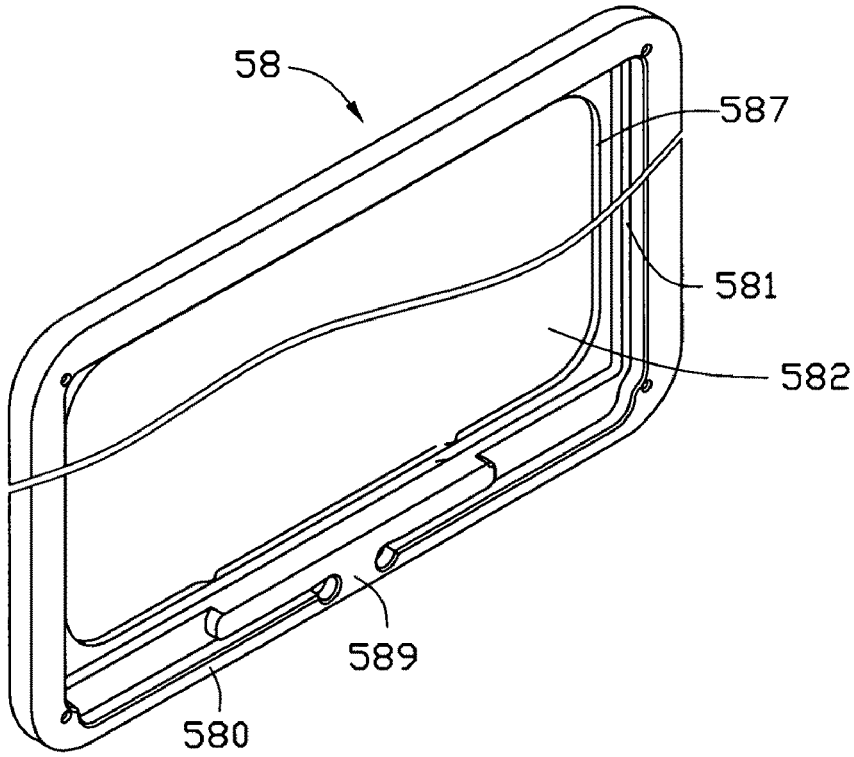
FIG. 26 is a schematic structural view of an embodiment of a second fixing frame.
Figure 27:
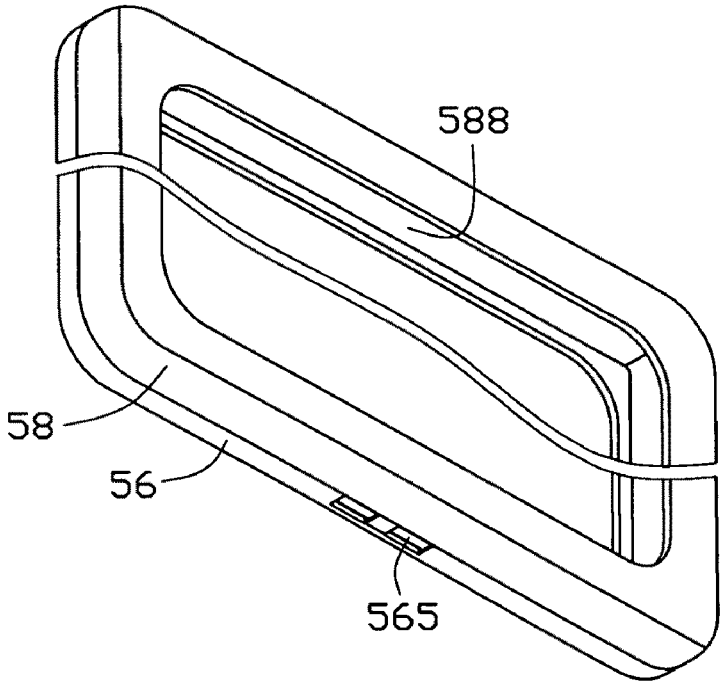
FIG. 27 is a schematic structural view of the first fixing frame cooperatively working together with the second fixing frame to form a receiving room.

Referring to the embodiment shown in FIG. 26, a second flange 587 inwardly and perpendicularly extends from an inner edge of each of the second side bars 580. The first and second flanges 567, 587 contact and secure the protection components 54 when they are assembled. At an opposite side of the second fixing frame 58, a support board 589 perpendicularly extends from the second side bar 580 adjacent to the base 40 towards the first fixing frame 56. The support board 589 has a "T" shape. The surface of the support board 589, near the second opening 582, and the surface of the supporting plate 569, near the first opening 562, are coplanar and support the thermoacoustic module 52. Space at two sides of the support board 589 forms wiring trough to receive conductive wire. Further, a ring shaped engaging rib 581 is provided at a joint portion between the second bars 580 and the second flange 587. The engaging rib 581 is capable of engaging with the protruding ring 568.

The thermoacoustic device 50 can be assembled as follows. The two protection components 54 are first secured on the supporting frame 520 of the thermoacoustic module 52. Then the first fixing frame 56 and the second fixing frame 58 are secured on two sides of the two protection components 54.

Referring to the embodiment shown in FIG. 8, the two protection components 54 can be secured on two sides of the supporting frame 520 by the engagement of the buckles 5204 and the slots 540. The buckles 5204 are provided on the third and fourth beams 520*c*, 520*d* of the supporting frame 520. The slots 540 are provided on the two protection components 54.

Figure 28:
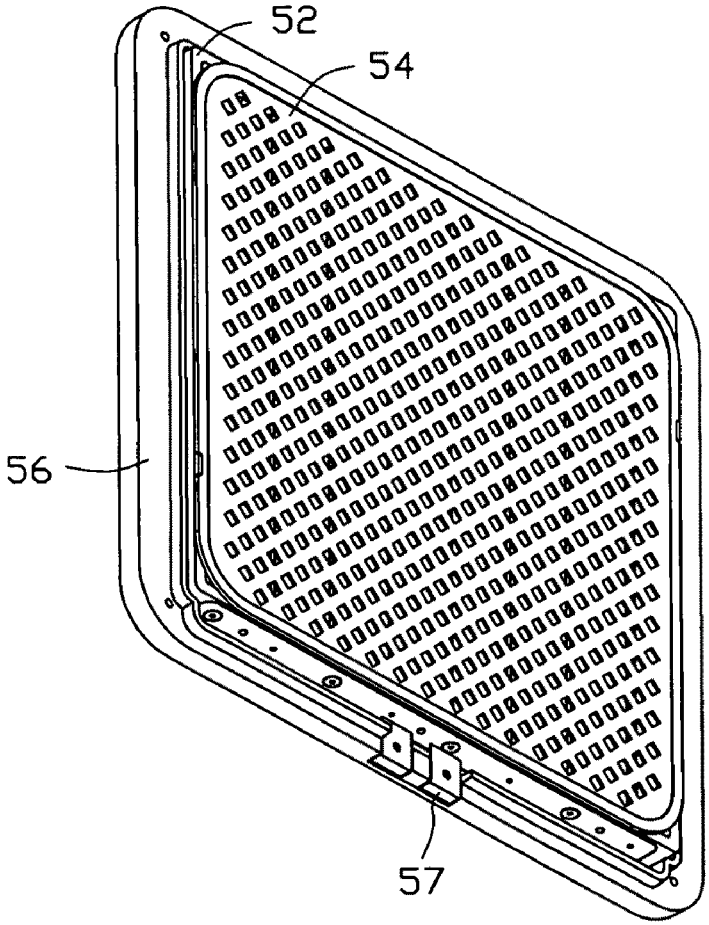
FIG. 28 is a schematic structural view of the first fixing frame with the thermoacoustic module and two protection components placed therebetween.

Referring to FIG. 28, the thermoacoustic module 52 and the two protection components 54 can be placed on the flanges 567. The first conductive element 528 is adjacent to the first bars 560, which is also adjacent to and installed in the base 40. The fourth connector 57 is spaced secured in the cutout 565*a* and the two grooves 565*b* and electrically connected to the thermoacoustic module 52 by the two conductive wires. It is understood that the electrical connection between the fourth connector 57 and the thermoacoustic module 52 can be varied, such as, the fourth connector 57 can be welded directly on the thermoacoustic module 52 and electrically connected therewith. The second fixing frame 58 then is placed on the other side of the thermoacoustic module 52 and corporately works together with the first fixing frame 56 to secure the thermoacoustic module 52 and the two protection components 54 in the receiving space 588. The two conductive wires are received in the wiring trough defined by the supporting plate 569 and the side bar 560. The two metal pieces of the fourth connector 57 electrically contact ends of the first and second electrodes 522,524, respectively, and exposed out of the side bars 560, 580 of the first and second fixing frames 56, 58 to receive the audio signals.

The assembled thermoacoustic device 50 has a flat panel shape, and it is conducive for the miniaturization thereof. When the speaker 30 is in use, an external audio signal source, such as a MP3, is inserted into the receiving room 960 of the second connector 90 and connected with the protrusion 964. The audio signals output from the audio signal source are input into the thermoacoustic device 50 by the second connector 90, the amplifier circuit device 70, the first connector 60 and the fourth connector 57. Then, sound is produced.

In some embodiments, the sound wave generator 526 of the thermoacoustic device 50 comprises of a carbon nanotube structure. The carbon nanotube structure can have a large area for causing the pressure oscillation in the surrounding medium by the temperature waves generated by the sound wave generator 526. In use, when audio signals, with variations in the application of the signal and/or strength are input applied to the carbon nanotube structure of the sound wave generator 526, heat is produced in the carbon nanotube structure according to the variations of the signal and/or signal strength. Temperature waves, which are propagated into surrounding medium, are obtained. The temperature waves produce pressure waves in the surrounding medium, resulting in sound generation. In this process, it is the thermal expansion and contraction of the medium in the vicinity of the sound wave generator 526 that produces sound. This is distinct from the mechanism of the conventional loudspeaker, in which the pressure waves are created by the mechanical movement of the diaphragm. Since the input audio signals are a kind of electrical signals, the operating principle of the thermoacoustic device 50 is an "electrical-thermal-sound" conversion.

In one embodiment, audio electrical signals with 50 volts are applied to the carbon nanotube structure. A microphone can be put in front of the sound wave generator 526 at a distance of about 5 centimeters, so as to measure the performance of the thermoacoustic device 50. The thermoacoustic device 50 has a wide frequency response range and a high sound pressure level. The sound pressure level of the sound waves generated by the thermoacoustic device 50 can be greater than 50 dB. The sound pressure level generated by the thermoacoustic device 50 reaches up to 105 dB. The frequency response range of the thermoacoustic device 50 can be from about 1 Hz to about 100 KHz with power input of 4.5 W. The total harmonic distortion of the thermoacoustic device 50 is extremely small, e.g., less than 3% in a range from about 500 Hz to 40 KHz.

Figure 29:
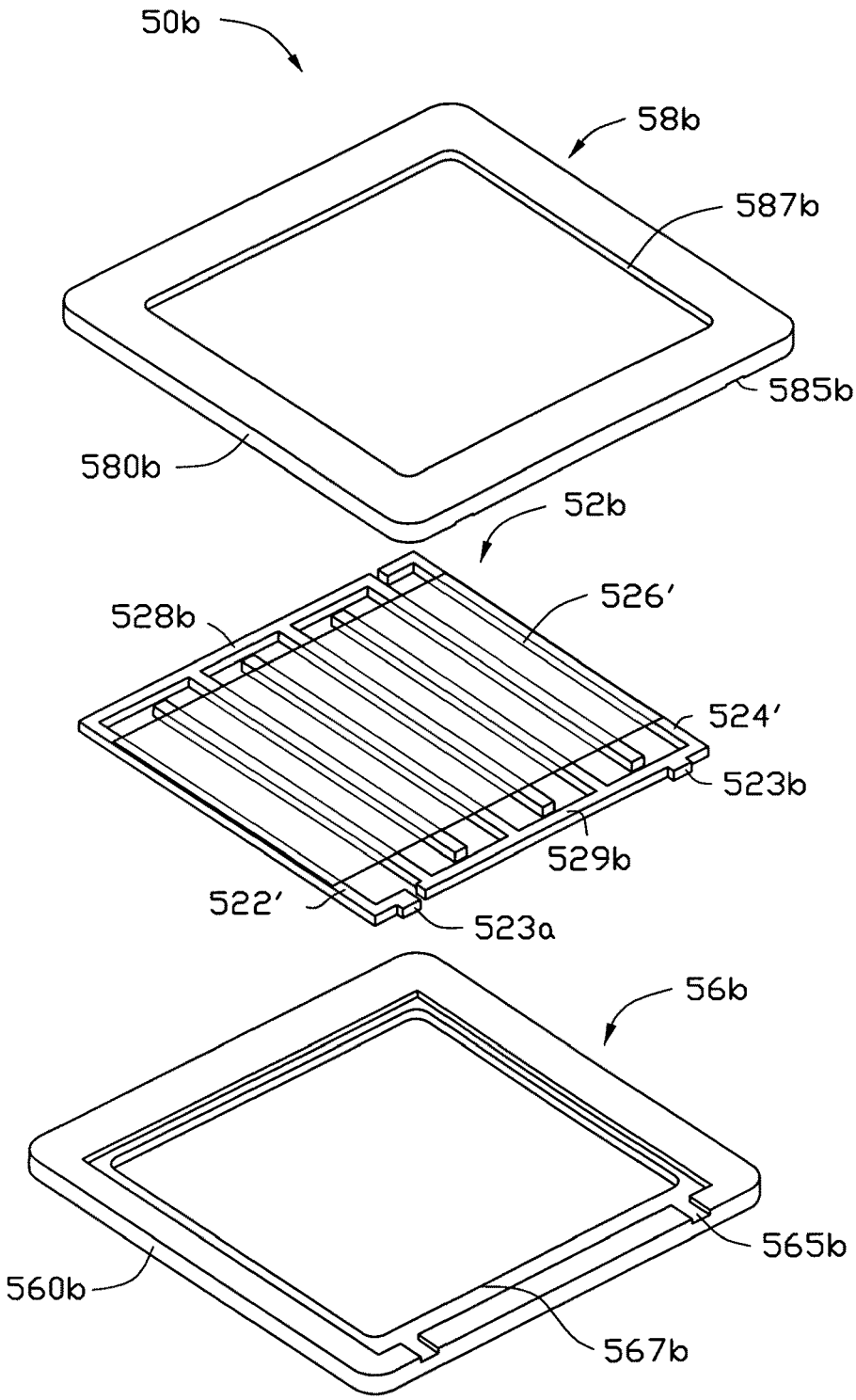
FIG. 29 is an exploded schematic structural view of one embodiment of the thermoacoustic device.
Figure 30:
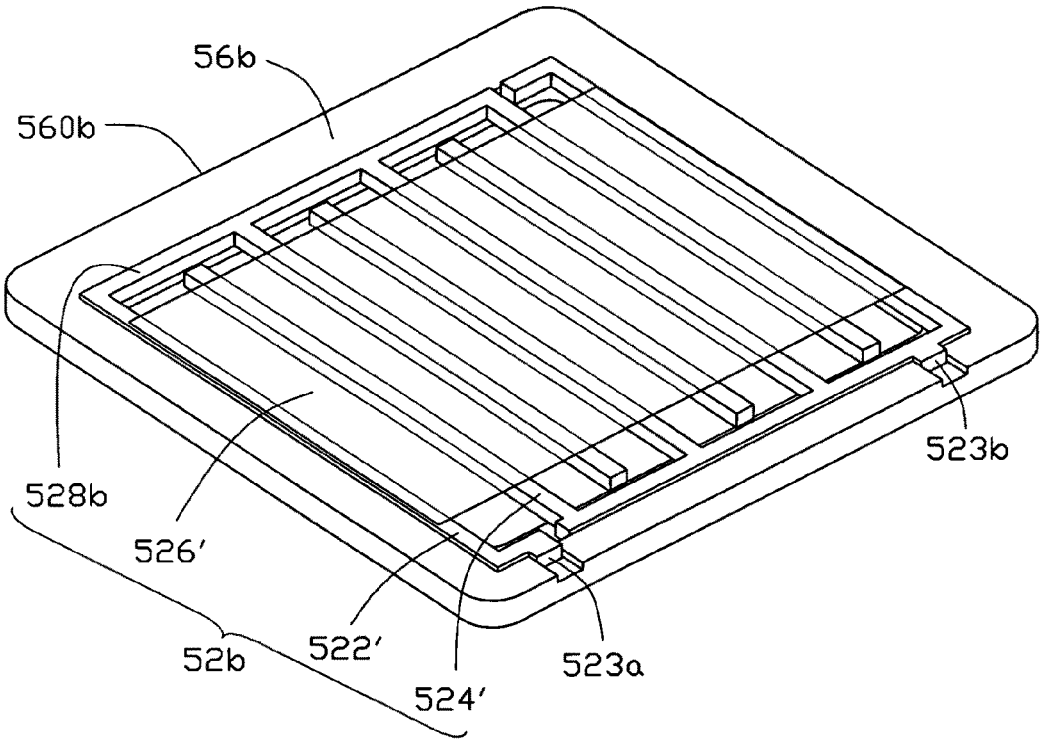
FIG. 30 is a schematic view of an embodiment having the sound wave generator and the first and second electrodes placed on the first fixing frame.

It is understood that in another embodiment, referring to FIGS. 29-30, a thermoacoustic device 50*b* that includes a thermoacoustic module 52*b*, a first fixing frame 56*b* and a second fixing frame 58*b* can be assembled as follows. The thermoacoustic module 52*b* includes a plurality of first electrodes 522', a plurality of second electrodes 524', and a sound wave generator 526'. The sound wave generator 526' is supported by and electrically connected to the first and second electrodes 522', 524'. The plurality of first electrodes 522' is electrically connected by a first conductive element 528*b*, and the plurality of second electrodes 524' is electrically connected by a second conductive element 529*b*. The first fixing frame 56*b* and the second fixing frame 58*b* are located on two sides of the thermoacoustic module 52*b* and secure the thermoacoustic module 52*b* therebetween. The first fixing frame 56*b* and the second fixing frame 58*b* have a same structure and are symmetrically arranged about the thermoacoustic module 52*b*. The first fixing frame 56*b* is a rectangular frame formed by four first bars 560*b* joined end to end. The second fixing frame 58*b* is also a rectangular frame formed by four second bars 580*b* joined end to end. First flanges 567*b* inwardly extend from an inner edge of each first bar 560*b* of the first fixing frame 56*b*. Second flanges 587*b* inwardly extend from an inner edge of each second bar 580*b* of the second fixing frame 58*b*. The first flanges 567*b* and the second flanges 587*b* contact the thermoacoustic module 52*b*. Two concavities 565*b* are spaced formed in a top surface of the first bar 560*b*. Two concavities 585*b* are formed in a top surface of the second bar 580*b*. The concavities 565*b*, 585*b* face opposite sides of the thermoacoustic module 52*b* for the convenience of receiving the external signals.

The fourth connector 57 also can be located in the concavities 565*b*, 585*b* to receive the external signals. The fourth connector 57 is electrically connected to the first and second electrodes 522', 524'. The thermoacoustic module 52*b* further includes a first electrical contact terminal 523*a* extending from the first electrode 522' and a second electrical contact terminal 523*b* extending from the second electrode 524'. The thermoacoustic device 50*b* can be assembled as follows. Referring to FIG. 28, the thermoacoustic module 52*b* is placed into the first fixing frame 56*b*, and the first and second conductive elements 528*b*, 529*b*, one first electrode 522' and one second electrode 524' contact with a sidestep formed by the first fixing frame 56*b* and the flanges 567*b*. At the same time, the two electrical contact terminals 523*a*, 523*b* are placed into the two concavities 565*b*, 585*b*, respectively. Then the second fixing frame 58*b* is placed on the thermoacoustic module 52*b* and engages with the first fixing frame 56*b* to secure the thermoacoustic module 52*b* therebetween. In use, audio signals are input to the sound wave generator 526' of the thermoacoustic module 52*b* by the two electrical contact terminals 523*a*, 523*b*.

Amplifier Circuit

Figure 31:
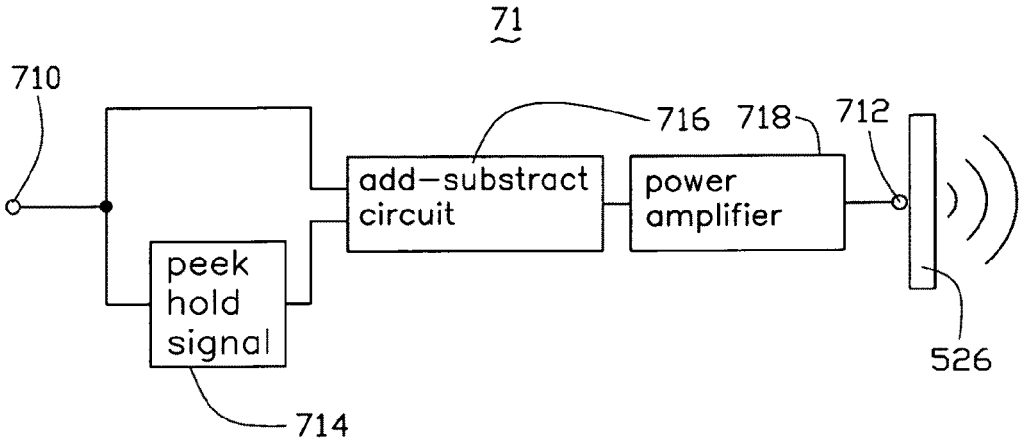
FIG. 31 is a schematic connection view of one embodiment of an amplifier circuit with a sound wave generator.

Referring to the embodiment shown in FIG. 31, an amplifier circuit 71 is shown. The amplifier circuit 71 is integrated in the printed circuit board 74 shown in FIG. 2. The amplifier circuit 71 has an input 710 and an output 712. The amplifier circuit 71 receives a signal, such as an audio signal, by the input 710. The amplifier circuit 71 deals with the audio signal to acquire an amplified signal, and send the amplified signal to the sound wave generator 526 by the output 712 to drive the sound wave generator 526 produce sound waves. Specifically, the amplified signal is sent to the sound wave generator 526 by the first and second electrodes 522, 524. In one embodiment, the audio signal is an analog signal.

Figure 32:
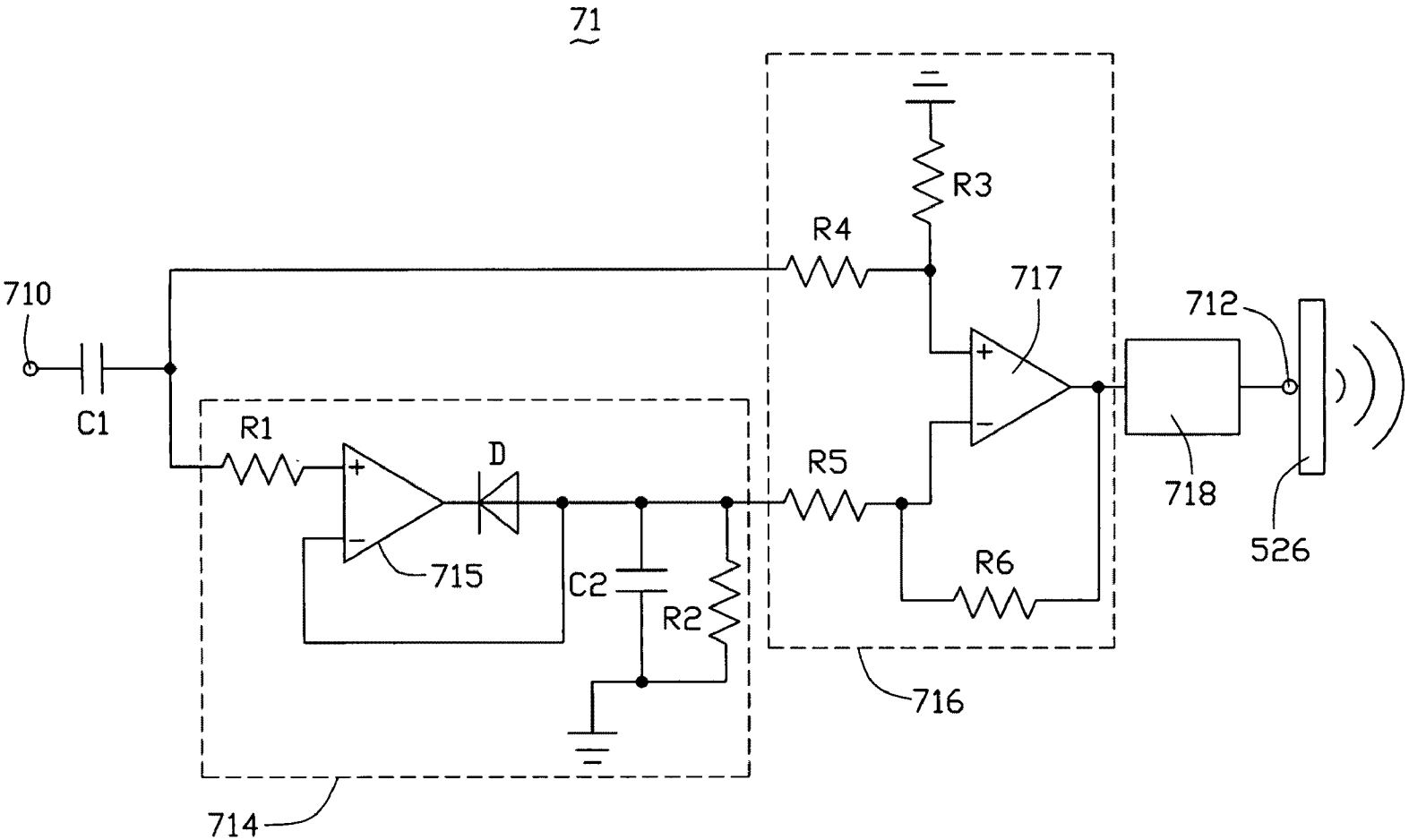
FIG. 32 is a schematic view of the amplifier circuit connected with the sound wave generator, showing components of a peak hold circuit and an add-subtract circuit.

The amplifier circuit 71 includes a peak hold circuit 714, an add-subtract circuit 716 and a power amplifier 718. Referring to FIG. 32, a first capacitor C1 can be located between the peak hold circuit 714 and the input 710 of the amplifier circuit 71. The first capacitor C1 plays a role of blocking direct current. The peak hold circuit 714 is connected to the power amplifier 718 by the add-subtract circuit 716. The power amplifier 718 is connected to the output 712 of the amplifier circuit 71. When an audio signal input into the peak hold circuit 714 and the add-subtract circuit 716, the peak hold circuit 714 outputs a peak hold signal. A modulated signal then is output by the add-subtract circuit 716 after the addition and subtraction operation of the peak hold signal and the original audio signal. The modulated signal then inputs into the power amplifier 718 and amplified by the power amplifier 718 to output an amplified voltage signal. The modulated signal has a same frequency and a same phase with the audio signal input into the peak hold circuit 714.

The peak hold circuit 714 holds the peaks of the positive voltage or negative voltage to output the peak hold signal. In one embodiment, the peak hold circuit 714 outputs the peak hold signals from one anode of a diode D.

Referring to the embodiment shown in FIG. 32, the peak hold circuit 714 includes an operation amplifier 715, the diode D, a first resistor R1, a second resistor R2 and a second capacitor C2. The operation amplifier 715 includes a positive phase input, a negative phase output and an output. One end of the first resistor R1 is connected to the first capacitor C1. The other end of the first resistor R1 is connected to the positive phase input of the operation amplifier 715. The output of the operation amplifier 715 is electrically connected to a cathode of the diode D, and the anode of the diode D is electrically connected to negative phase output of the operation amplifier 715 to provide a negative feedback signal for the operation amplifier 715. The anode of the diode D is connected to the second capacitor C2. The anode of the diode D is also connected to the second resistor R2. The second capacitor C2 and the second resistor R2 are grounded. The anode of the diode D is still electrically connected to the add-subtract circuit 716.

The audio signal, after passing through the first capacitor C1, inputs into the positive phase input of the operation amplifier 715. The output signal of the operation amplifier 715 returns to the negative phase output to maintain the voltage of the positive phase input and the negative phase output equal. The operation amplifier 715 supplies output negative voltage thereof to the second capacitor C2 to charge the second capacitor C2 via the diode D acting as a rectifier, and after that, discharges by the second resistor R2. Therefore, the second capacitor C2 keeps the peaks of the negative voltage and output a negative peak hold signal to the add-subtract circuit 716. Referring to FIG. 30, due to the presence of second resistor R2, the peak signal voltage continuously declines in trend to zero slowly till next audio signal appears. Product of the second capacitor C2 and the second resistor R2 (constant of time) is greater than 50 milliseconds (R2C2>50 mS) to ensure the frequency of the peak hold signal less than the lowest frequency of 20 Hz that human can hear, thereby avoiding mixing with the audio signal.

It is understood that when the anode and cathode of the diode D inversed, the above peak hold circuit 714 is a positive peak hold circuit and can keep peaks of a positive voltage.

It is understood that the peak hold circuit 714 is not limited to the above specific circuit connection, and also can include other ways, such as it can be a peak detector circuit with the second resistor R2 connected therein. Other ways that can hold the peaks of the positive voltage or negative voltage of the audio signal and output a positive peak hold signal or a negative peak hold signal can be adopted.

Both the input 710 of the amplifier circuit 71 and the peak hold circuit 714 are connected to the add-subtract circuit 716, and input the audio signal and the peak hold signal thereto. In one embodiment, the add-subtract circuit 716 is a subtraction circuit. Specifically, the add-subtract circuit 716 includes a third resistor R3, a fourth resistor R4, a sixth resistor R6 and an operation amplifier 717. The operation amplifier 717 includes a positive phase input, a negative phase output and an output. The positive phase input of the operation amplifier 717 is connected in series to the third resistor R3 that is grounded. The output of the operation amplifier 717 is connected in series to the sixth resistor R6 and then connected to the negative phase output of the operation amplifier 717 to input a negative feedback signal. The positive phase input of the operation amplifier 717 is connected to the first capacitor C1 and to the fourth resistor R4 in series. The negative phase output of the operation amplifier 717 is connected to the anode of the diode D and to the fifth resistor R5 in series. The peak hold signal inputs into the negative phase output of the operation amplifier 717 via passing through the fifth resistor R5 and the audio signal inputs into the positive phase output of the operation amplifier 717 via passing through the fourth resistor R4. According to operation formula of the subtraction circuit, that is $$Vo = \frac{R5 + R6}{R5} \times \frac{R3}{R3 + R4} \times Vs - \frac{R6}{R5} \times Vc,$$

wherein Vs represents an input voltage of the fourth resistor R4, Vc represents an input voltage of the fifth resistor R5, when R3=R4=R5=R6, Vo=Vs−Vc, thus, output voltage output by the operation amplifier 717 is the voltage of audio signal subtracted by the voltage of the negative peek hold signal.

Figure 33:
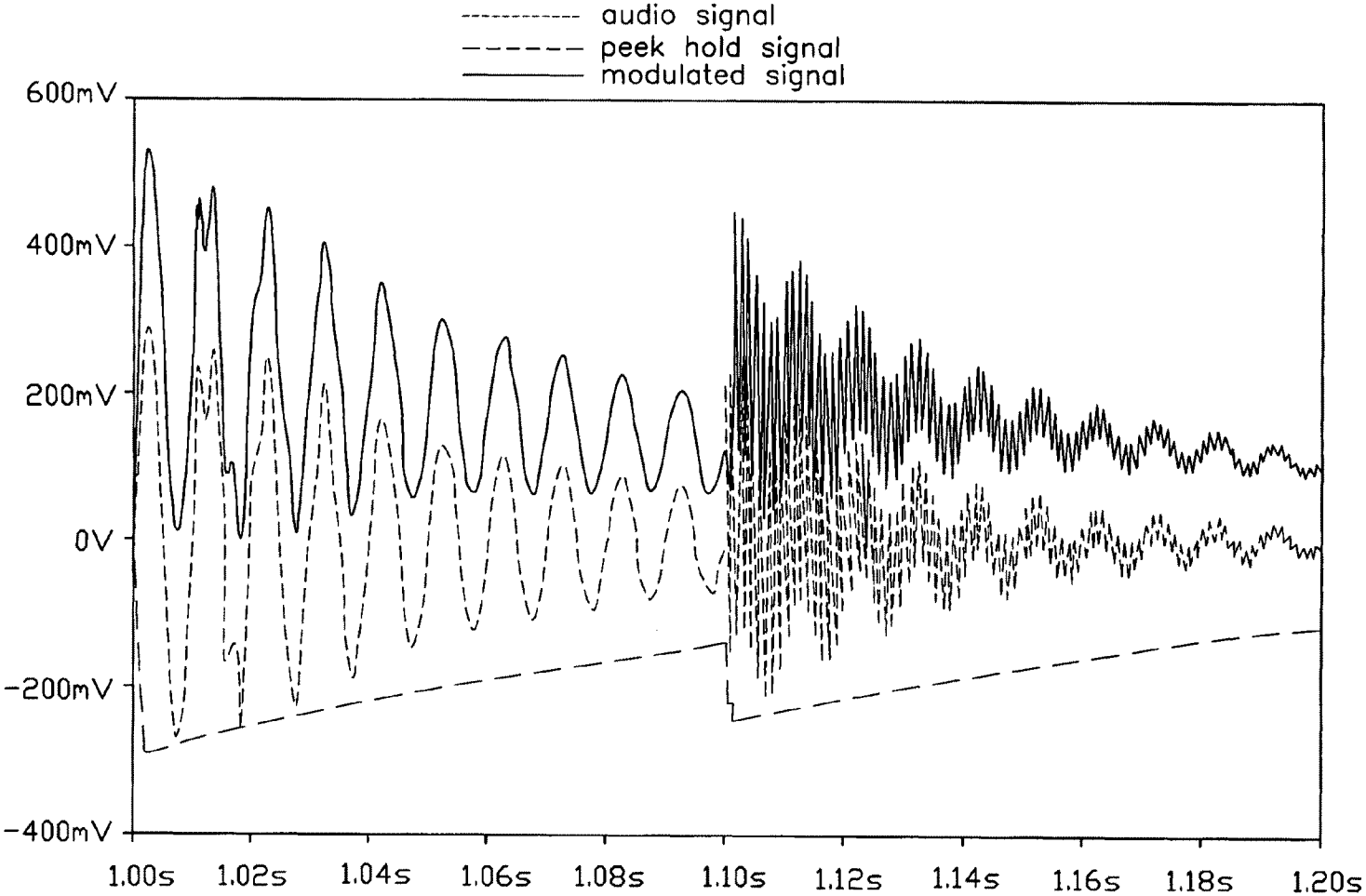
FIG. 33 shows a comparison chart of the audio signal, the peek hold signal and the modulated signal in one embodiment.

Referring to the embodiment shown in FIG. 33, in one embodiment, since the negative peek hold signal output from the peak hold circuit 714, thus a positive voltage signal outputs by the add-subtract circuit 716 after the voltage of the negative peek hold signal subtracting from the audio signal. The positive voltage signal has a peek voltage at the position of the positive peek of the audio signal, and it has a valley voltage at the position of the negative peek of the audio signal. The valley voltage being close to zero. It is understood that the peak hold circuit 714 also can be designed to be a positive peak hold circuit, and the corresponding add-subtract circuit 716 is an addition circuit that can add the voltage of the positive peak hold signal to the voltage of the audio signal.

Figure 34:
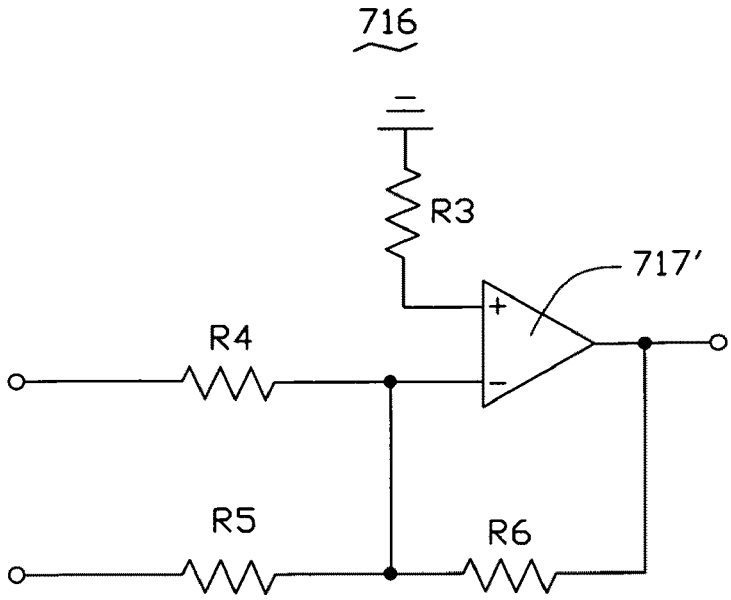
FIG. 34 is a schematic circuit view of the add-subtract circuit shown in FIG. 32.

Referring to the embodiment shown in FIG. 34, the addition circuit includes the third resistor R3, the fourth resistor R4, the fifth resistor R5, the sixth resistor R6 and an operation amplifier 717'. The operation amplifier 717' includes a positive phase input, a negative phase output and an output. The negative phase output of the operation amplifier 717' is connected to the first capacitor C1 via connected in series to the fourth resistor R4, and connected to the cathode of the diode D via connected in series to the fifth resistor R5, wherein the anode and cathode of the diode D inversed compared to the subtraction circuit. The positive phase input of the operation amplifier 717' is connected in series to the third resistor R3 that is grounded. The output of the operation amplifier 717' is connected in series to the sixth resistor R6 and then connected to the negative phase output of the operation amplifier 717' to input a negative feedback signal. The peak hold signal inputs into the negative phase output of the operation amplifier 717' via passing through the fifth resistor R5 and the audio signal inputs into the positive phase output of the operation amplifier 717' via passing through the fourth resistor R4. The output of the operation amplifier 717' sends modulated signal to the power amplifier 718.

According to operation formula of the addition circuit, $$-Vo = \frac{R6}{R4} \times Vs + \frac{R6}{R5} \times Vc,$$

wherein Vs represents an input voltage of the fourth resistor R4, Vc represents an input voltage of the fifth resistor R5, when R3=R4=R5=R6, −Vo=Vs+Vc, thus, modulated signal output by the operation amplifier 717' is the voltage of audio signal added by the voltage of the positive peek hold signal. Thus, when the modulated signal is addition of the audio signal added and the positive peek hold signal, the amplifier circuit 71 can further include an inverter circuit connected to the output of the operation amplifier 717', output an inverted signal of the modulated signal, and input to the power amplifier 718.

The add-subtract circuit 716 is electrically connected to the sound wave generator 526 by the power amplifier 718. The modulated signal is amplified by the power amplifier 718 and amplified modulated signal is input to the sound wave generator 526.

The power amplifier 718 can be a class A power amplifier, a class B power amplifier, a class AB power amplifier, a class C power amplifier, a class D power amplifier, a class E power amplifier, a class F power amplifier, a class H power amplifier and other types of power amplifiers. In one embodiment, the power amplifier 718 is the class D power amplifier.

Figure 35:
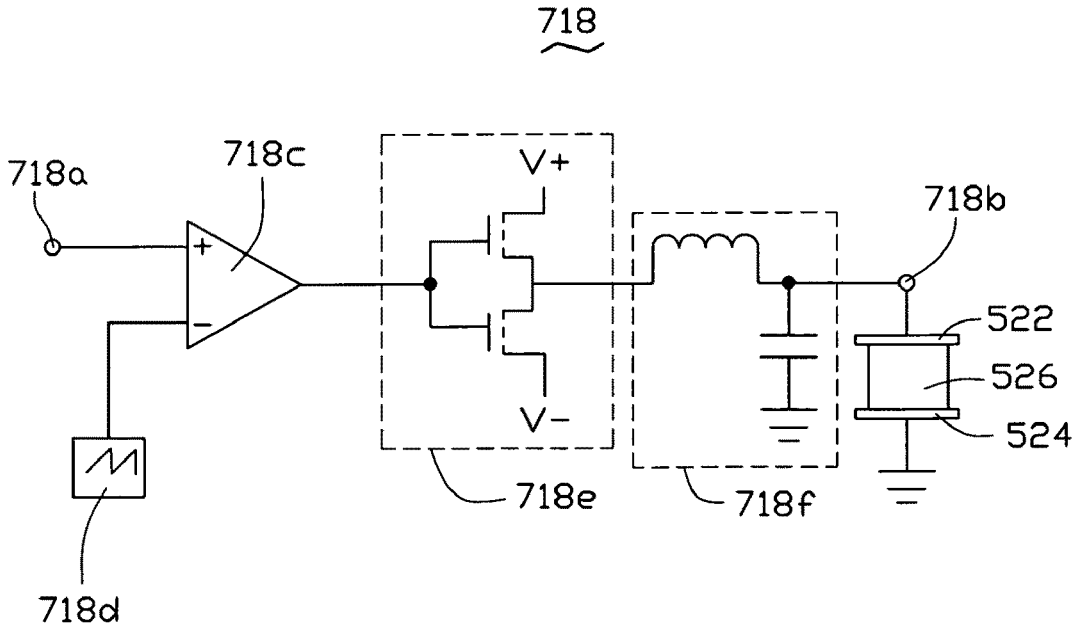
FIG. 35 is a schematic circuit view of a class D power amplifier connected to a sound wave generator.
Figure 36:
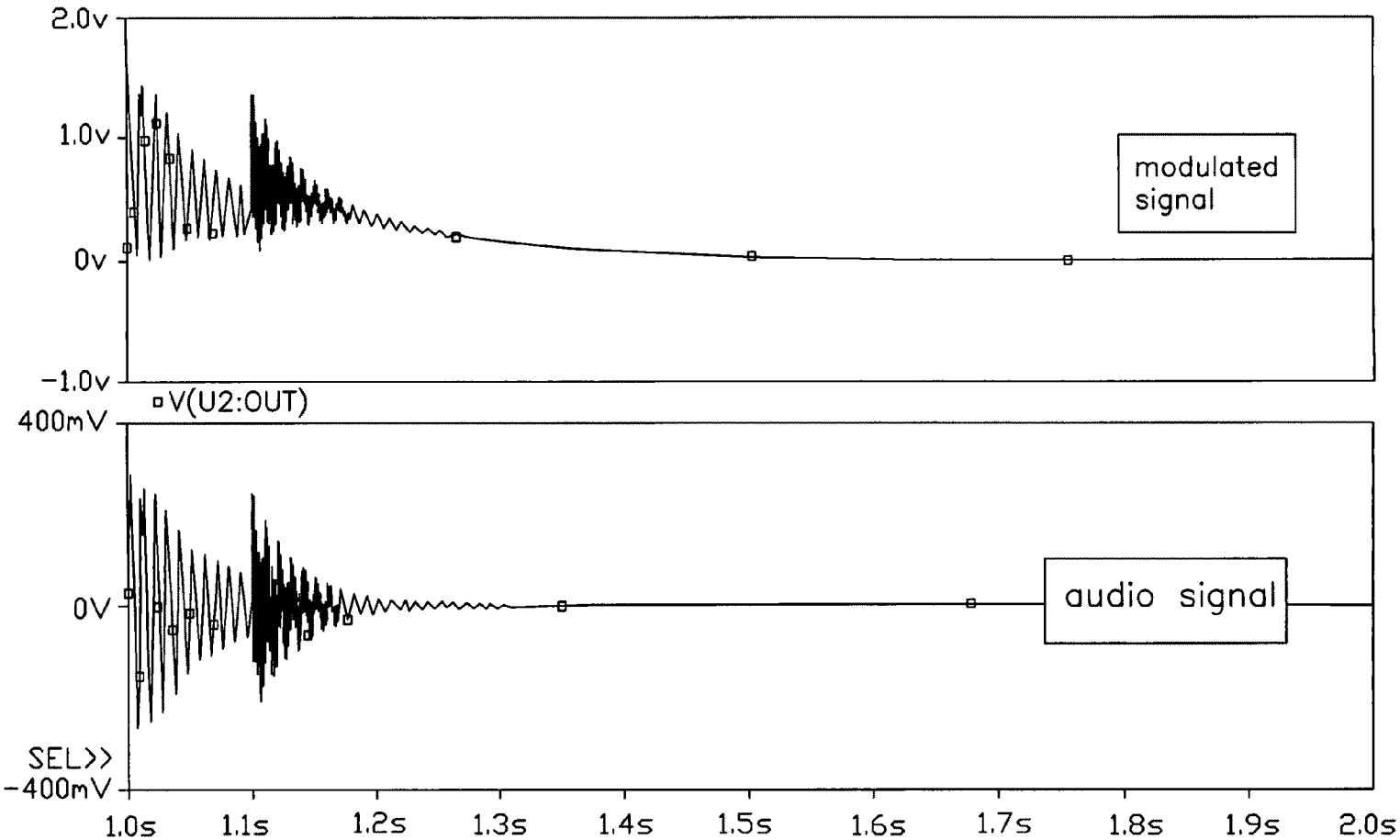
FIG. 36 is a comparison chart of the audio signal and the modulated signal.

Referring to the embodiment shown in FIG. 35, the class D power amplifier includes an input 718*a* connected to the add-subtract circuit 716 and an output 718*b* connected to the sound wave generator 526. The class D power amplifier includes a triangular wave generator 718*d*, a comparator 718*c*, a field effect transistor (FET) driver 718*e*, such as a metal-oxide-semiconductor field-effect transistor (MOSFET) driver, and a low-pass filter 718*f*. The operation amplifier 718*c* includes a positive phase input, a negative phase output and an output. The triangular wave generator 718*d* is connected to the positive phase input of the comparator 718*c* to produce a triangular wave signal and, the triangular wave signal is input to the comparator 718*c*. The modulated signal inputs to the negative phase output of the comparator 718*c*. After comparing the modulated signal with the triangular wave signal by the comparator 718*c*, a pulse-width modulation (PWM) signal is output. Output of the comparator 718*c* is electrically connected to the FET driver 718*e*. Generally, the FET driver 718*e* includes two FETs sharing a same gate electrode. The FET driver 718*e* outputs a pulse-width modulated amplified signal according to PWM signal. The pulse-width modulated amplified signal is then input to the low-pass filter 718*f* for restoring the waveform thereof. When conventional circuits for sound producing devices are adopted in thermoacoustic device 50, since the operating principle of the thermoacoustic device 50 is the "electrical-thermal-sound" conversion, a direct consequence is that the frequency of the output signals of the sound wave generator 526 doubles that of the input signals. This is because when an audio current passes through the sound wave generator 526, the sound wave generator 526 is heated during both positive and negative half-cycles. This double heating results in a double frequency temperature oscillation as well as a double frequency sound pressure. Thus, when a conventional power amplifier, such as a bipolar amplifier, is used to drive the sound wave generator 526, the output signals, such as the human voice or music, sound strange because of the output signals of the sound wave generator 526 doubles that of the input signals. When a bias voltage is applied to the sound wave generator 526 to make the audio signal all positive or negative, the input audio signal can reproduce faithfully. However, this way for applying the bias voltage makes the sound wave generator 526 always work under a high voltage, the power consumption is large, and the sound wave producing efficiency is low. Referring to FIG. 36, when the amplifier circuit 71 is adopted, the amplified signal output by the amplifier circuit 71 has a same frequency with the audio signal, and the audio signal can reproduce faithfully. Voltage of the amplified signal change dynamically with the audio signal, and when the intensity of the audio signal decreases, the intensity of the amplified signal weakens accordingly. The amplifier circuit 71 has a low power consumption, the sound wave producing efficiency can range from about 50% to about 90%.

Figure 37:
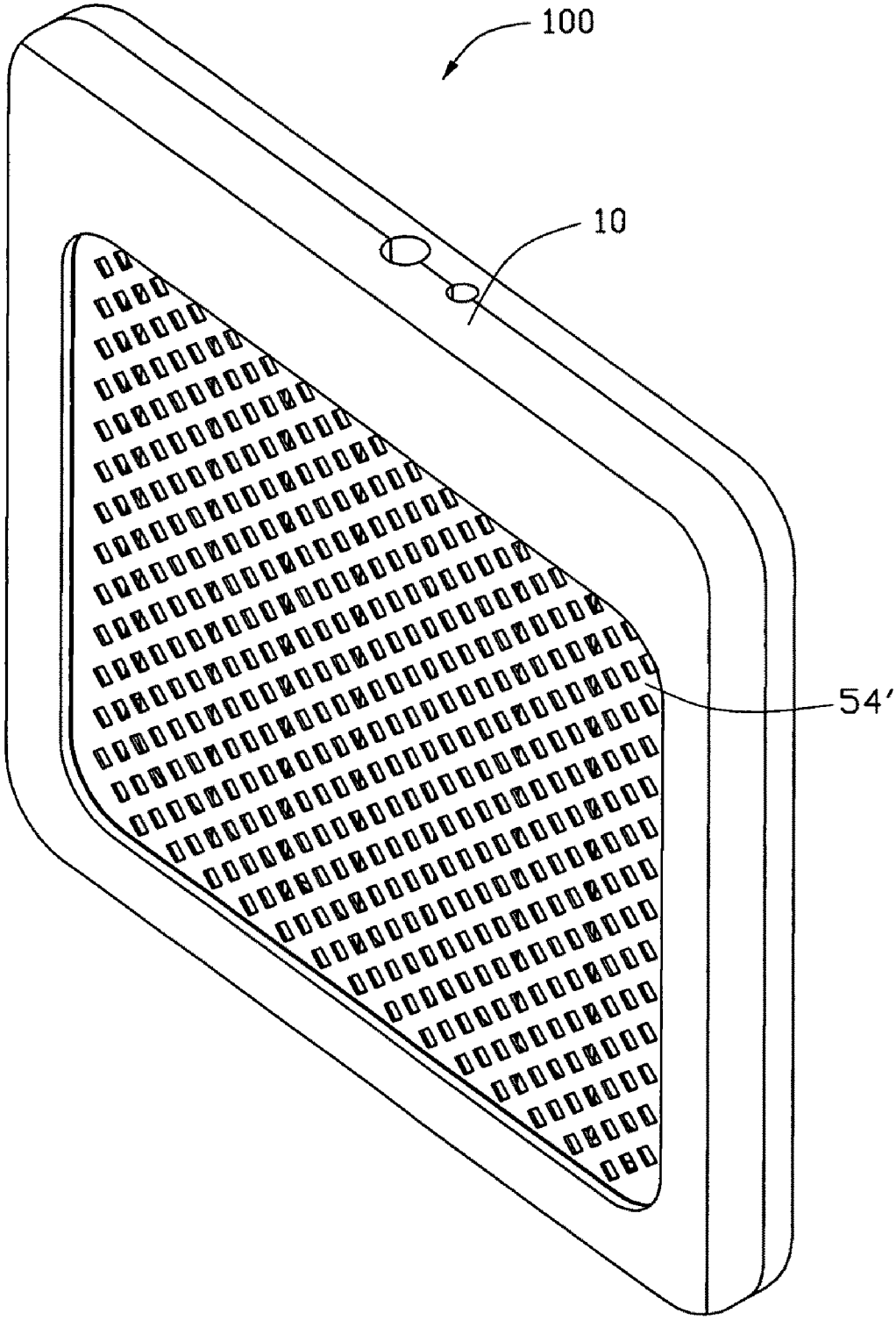
FIG. 37 is a schematic structural view of one embodiment of a speaker.
Figure 38:
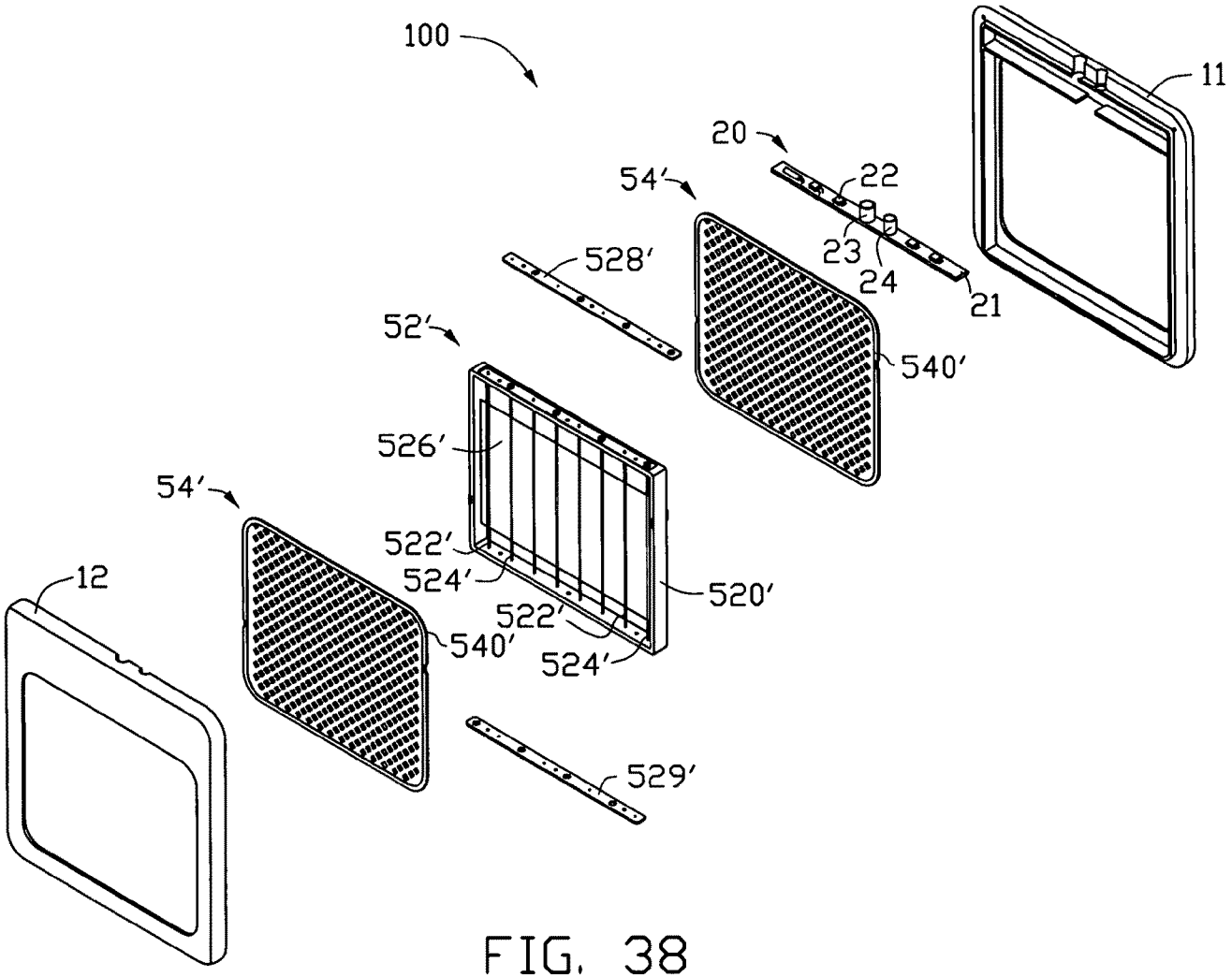
FIG. 38 is an exploded schematic structural view of the speaker shown in FIG. 37.

Referring to the embodiment shown in FIGS. 37-38, a speaker 100 according to one embodiment includes a thermoacoustic module 52', two protection components 54', an amplifier circuit board 20, a third fixing frame 11 and a fourth fixing frame 12. The third fixing frame 11 and the fourth fixing frame 12 secure the thermoacoustic module 52', the two protection components 54' and the amplifier circuit board 20 together. The thermoacoustic module 52' includes a supporting frame 520', a plurality of first electrodes 522', a plurality of second electrodes 524', and a sound wave generator 526'.

Amplifier Circuit Board

Figure 39:
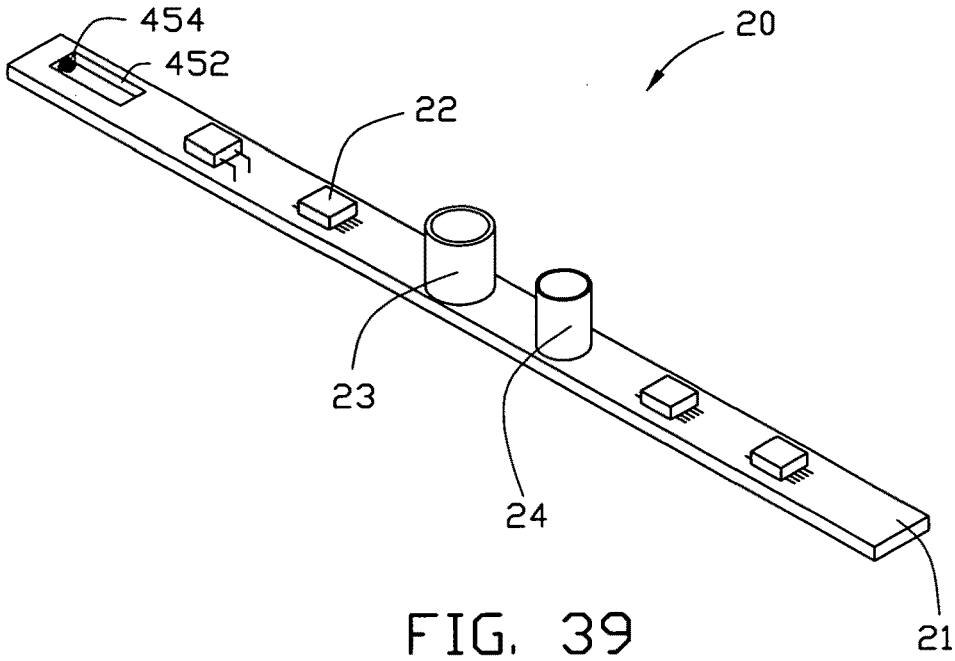
FIG. 39 is an enlarged view of an amplifier circuit board of the speaker shown in FIG. 38.

The amplifier circuit board 20 is coupled to the first and second electrodes 522', 524'. Referring to the embodiment shown in FIG. 39, the amplifier circuit board 20 includes a substrate 21, and an amplifier chip 22, an audio connector 23 and a power connector 24 located thereon. The substrate 21 is configured to support the amplifier chip 22, the audio connector 23 and the power connector 24. The amplifier chip 22 is electrically connected to the power connector 24, the audio connector 23 and the sound wave generator 526'. When the power connector 24 is electrically connected to an external power supply, the amplifier circuit board 20 can amplify audio signal output from the audio connector 23 and send the amplified audio signal to the sound wave generator 526'.

The amplifier circuit board 20 can further include a fixing slot 452 for receiving and fixing batteries. Two conductive touch pieces 454 can be located separately in the fixing slot. The two conductive touch pieces 454 are electrically connected to the amplifier chip 22. When a battery is placed into the fixing slot, the battery is electrically connected to the amplifier chip 22 by the two conductive touch pieces 454, thus the amplifier circuit board 20 would not need to be connected to an external power supply and can be driven by the batteries. It is understood that the amplifier chip 22 can be powered by a battery and/or a power source.

Third and Fourth Fixing Frames

Figure 40:
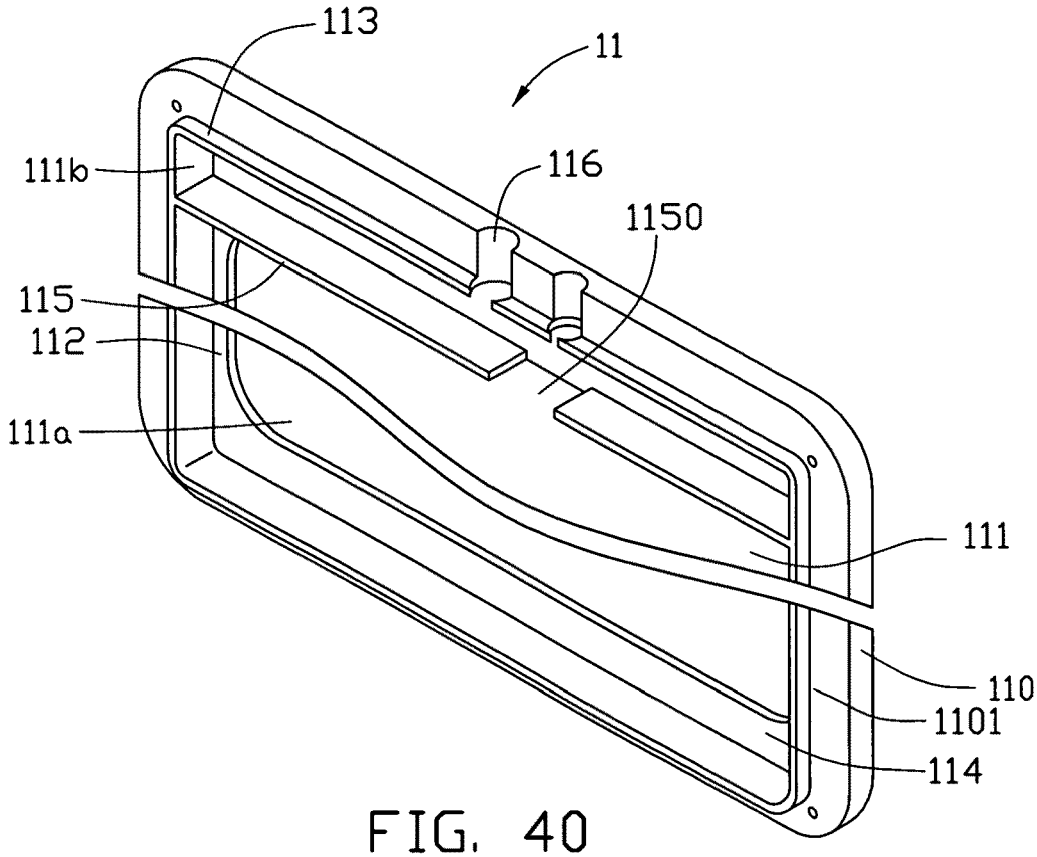
FIG. 40 is a schematic structural view of a first fixing frame shown in FIG. 38.
Figure 41:
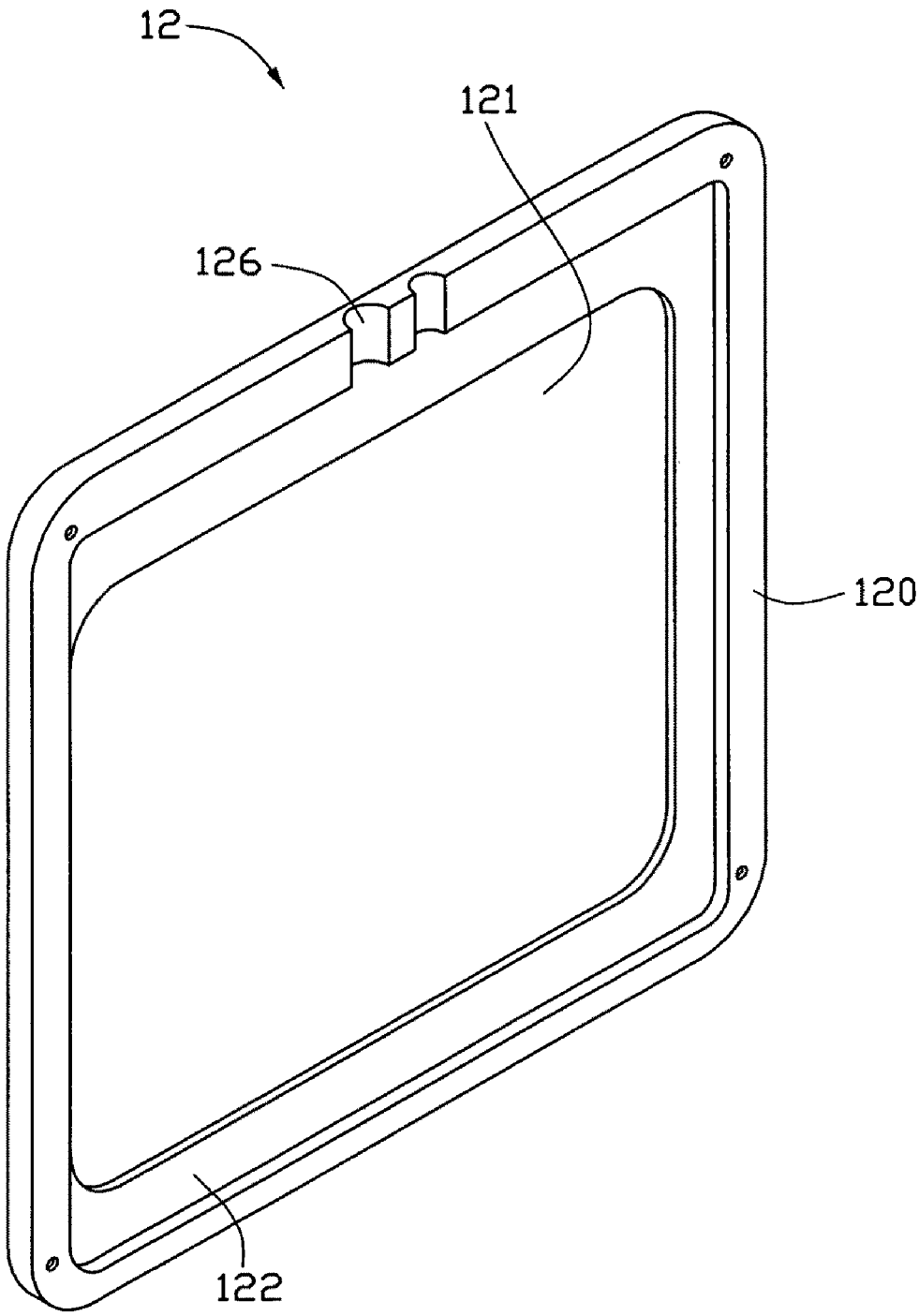
FIG. 41 is a schematic structural view of a second fixing frame shown in FIG. 38.
Figure 42:
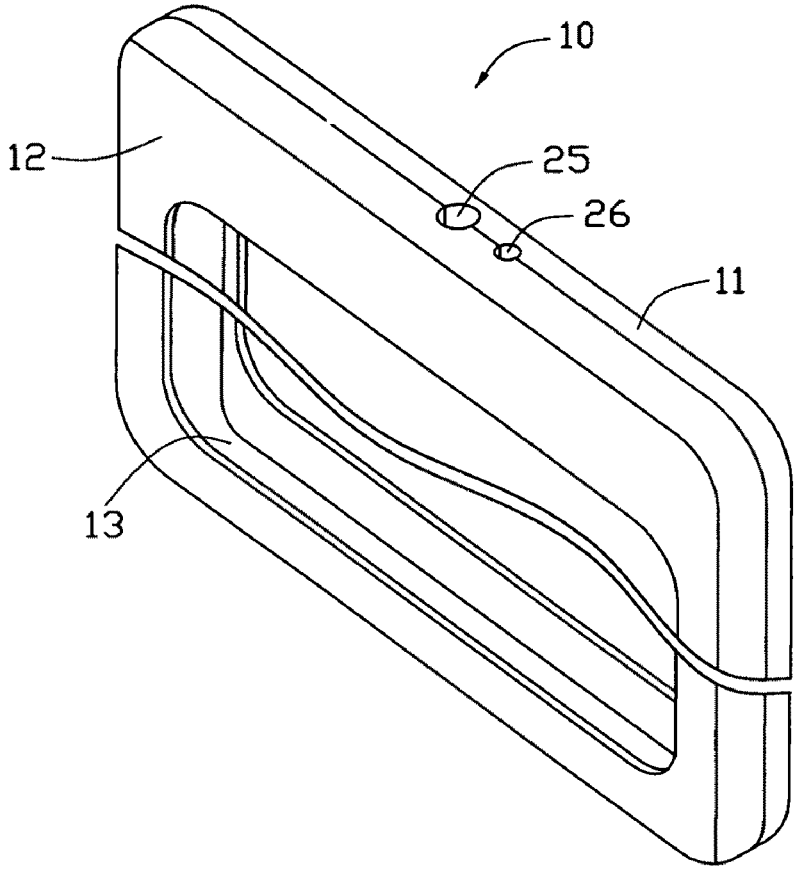
FIG. 42 is a schematic structural view of the first fixing frame corporately working together with the second fixing frame to form a receiving room.
Figure 43:
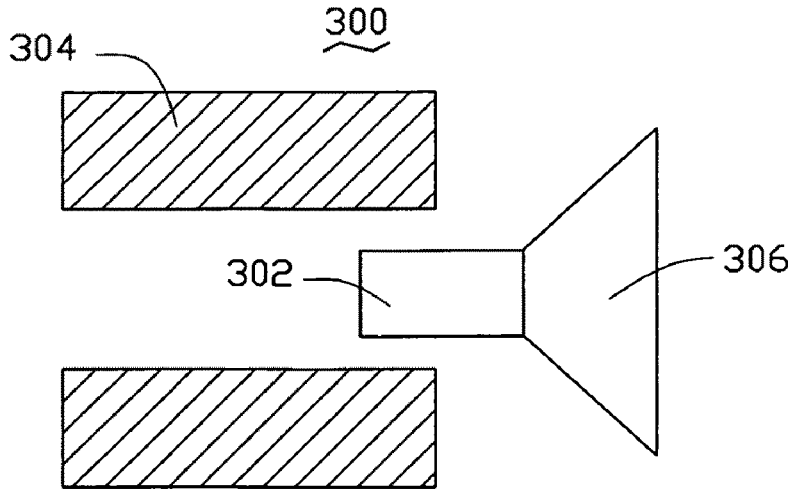
FIG. 43 (PRIOR ART)
FIG. 43 is a schematic structural view of a conventional loudspeaker according to the prior art.

Referring to the embodiment shown in FIGS. 40-41, a third fixing frame 11 and a fourth fixing frame 12 matching with the third fixing frame 11 corporately constitute a fixing frame 10 shown in FIG. 42. The third fixing frame 11 and the fourth fixing frame 12, when used, can also be referred as a first fixing frame and a second fixing frame. The third fixing frame 11 includes a partition 115 and four first side bars 110 joined end to end. The four first side bars 110 and the partition 115 can be integral. The four first side bars 110 are joined end to end to define a first opening 111. Each of the four first side bars 110 includes a first surface 1101 and a second surface (not shown) opposite thereto. The first surface 1101 of the each of the four first side bars 110 contacts with the fourth fixing frame 12.

Four flanges 112 inwardly extend into the first opening 111 from an inner edge of each of the first side bars 110. The four flanges 112 are at the second surface of the first side bars 110. A length of each of the four flanges 112 is equal. A width of three flanges 112 which can contact with protection components 54' is equal and smaller than that of the other flange 112 which can contact with both the protection components 54' and the amplifier circuit board 20 when assembled. Further, a ring-shape ridge portion or four edges 113 extend towards the fourth fixing frame 12 along a direction perpendicular to the first surface of the first side bars 110 from an inner edge of each of the first fixing frame 56 at the first surface of the first side bars 110.

The partition 115 is located on the flange 112 which has a larger width and arranged parallel to one opposite first side bar 110. The partition 115 can contact the other two opposite side bars 110, side edges of the partition 115 are flush with four edges 113. The partition 115 divides the first opening 111 into two rooms, a first room 111*a* and a second room 111*b*. The first room 111*a* has a larger area than the second room 111*b*. The first room 111*a* is used to receive the sound wave generator 526' and the two protection components 54'. The second room 111*b* is used for receiving the amplifier circuit board 20. A gap 1150 is defined in the partition 115 for conductive wire electrically connecting the sound wave generator 526' and the amplifier circuit board 20 passing through.

The fourth fixing frame 12 includes four second side bars 120. The four second side bars 120 are joined end to end to define a second opening 121. Four flanges 122 inwardly extend into the second opening 121 from an inner edge of each of the second side bars 120. The flanges 122 are located at rear side of the fourth fixing frame 12 when the fourth fixing frame 12 is placed in the position shown in FIG. 41. A length of each of the four flanges 122 is equal. A width of three flanges 122 is equal and smaller than that of the other flange 122 opposite to the flange 112 having a larger width.

Referring further to FIG. 42, when the fourth fixing frame 12 is placed on the third fixing frame 11, the edges 113 abut against the flanges 122 of the fourth fixing frame 12, and the partition 115 contacts with the flange 122 having a larger width, thereby forming a first receiving room 13 for receiving the sound wave generator 526' and the two protection components 54'therein and a second receiving room (not shown) for receiving the amplifier circuit board 20.

The third fixing frame 11 and the fourth fixing frame 12 can be fixed together by bolts, adhesive or any other means. The third fixing frame 11 and the fourth fixing frame 12 are made of insulating material, such as glass, ceramic, resin, wood, quartz or plastic. In one embodiment, the third fixing frame 11 and the fourth fixing frame 12 are rectangular plastic frame. The third fixing frame 11 and the fourth fixing frame 12 are fixed together by bolts.

In addition, two grooves 116 are defined in the first side bar 110 opposite to the partition 115 and corporately defining the second receiving room with the partition 115. Two grooves 126 are defined in the second side bar 120 of the fourth fixing frame 12. The two grooves 116 and the two grooves 126 corporately forms a first port 25 for receiving the audio connector 23 and a second port 26 for receiving the power connector 24 once assembled. The power connector 24 is installed in the third fixing frame 11. The substrate 21 is received in the second room 111*b*. The audio connector 23 is received in the first port 25 and the power connector 24 is received in the second port 26.

It is understood that the first port 25 and the second port 26 also can be formed directly on the first side bar 110. It is also understood that a first gap (not shown) can be defined in the first side bar 110 with two grooves 116 defined therein, a second gap (not shown) also can be defined in the second side bar 120 with two grooves 126 defined therein. The first gap and the second gap can be corporately form an opening (not shown) opposite to the fixing slot of the amplifier circuit board 20 for easy loading and unloading of the battery. The speaker can further include a board (not shown), and the board corporately works together with the opening to encapsulate the battery.

The speaker 100 can be assembled as follows. The thermoacoustic module 52' can be assembled the same as the thermoacoustic module 52. The thermoacoustic module 52' and the two protection components 54' are placed in the first room of the third fixing frame 11, contact with the partition 115. The amplifier circuit board 20 is placed in the second room of the third fixing frame 11. The thermoacoustic module 52 is electrically connected to the amplifier circuit board 20. Then the fourth fixing frame 12 is placed on the third fixing frame 11 to corporately work together. Thus, the thermoacoustic module 52' and the two protection components 54' are received in the first receiving room 13, and the amplifier circuit board 20 is received in the second receiving room.

In use, the power connector 24 is electrically connected to an external power supply, and an audio signal is input to the amplifier circuit board 20 by the audio connector 23. The audio signal is amplified by the amplifier circuit board 20 and the amplified audio signal is sent to the sound wave generator 526 of the thermoacoustic module 52' to drive the sound wave generator 526 producing sound waves.

Finally, it is to be understood that the above-described embodiments are intended to illustrate rather than limit the invention. Variations may be made to the embodiments without departing from the spirit of the invention as claimed. Elements associated with any of the above embodiments are envisioned to be associated with any other embodiments. The above-described embodiments illustrate the scope of the invention but do not restrict the scope of the invention.

What is claimed is:

1. A thermoacoustic device, the thermoacoustic device comprising:

a sound wave generator, the sound wave generator comprises a carbon nanotube structure;

a plurality of first electrodes electrically connected with each other;

a plurality of second electrodes electrically connected with each other, the plurality of second electrodes and the plurality of first electrodes are separately connected to the sound wave generator, the plurality of second electrodes and the plurality of first electrodes are parallel to each other and are alternately arranged at uniform intervals;

wherein a working voltage applied to the first and second electrodes is less than or equal to about 50 volts, and the sound wave generator and the first and second electrodes satisfy a formula consisting of $$1\Omega \le \frac{R_1}{(n-1)^2} \le 125\Omega,$$

wherein R1 represents a resistance of the sound wave generator in the direction from the plurality of first electrodes to the plurality of second electrodes, and n represents a sum of the total number of the first electrodes and the second electrodes added together.

2. The thermoacoustic device of claim 1, wherein the carbon nanotube structure comprises at least one carbon nanotube film.

3. The thermoacoustic device of claim 2, wherein the carbon nanotube structure comprises two or more stacked carbon nanotube films.

4. The thermoacoustic device of claim 1, wherein the plurality of first electrodes is electrically connected with each other by a first conductive element, and the plurality of second electrodes is electrically connected with each other by a second conductive element.

5. The thermoacoustic device of claim 1, wherein an input power of the thermoacoustic device is larger than 20 watts and less than 500 watts.

6. A thermoacoustic device, the thermoacoustic device comprising:

a sound wave generator, the sound wave generator comprises at least one carbon nanotube film;

a plurality of first electrodes electrically connected with each other;

a plurality of second electrodes electrically connected with each other; the plurality of second electrodes and the plurality of first electrodes are connected to the sound wave generator and electrically connected to the sound wave generator; the at least one carbon nanotube film comprises a plurality of carbon nanotubes arranged substantially along a direction extending that is perpendicular to the plurality of first electrodes and the plurality of second electrodes; the plurality of second electrodes and the plurality of first electrodes are parallel to each other and are alternately arranged at uniform intervals;

wherein a working voltage applied to the first and second electrodes is less than or equal to about 50 volts, and the sound wave generator and the first and second electrodes satisfy a formula consisting of $$1\Omega \leq \frac{R}{m(n-1)^2} \leq 125\Omega,$$

wherein R represents a resistance of each layer of the carbon nanotube film in the direction from the plurality of first electrodes to the plurality of second electrodes, m represents a total number of layers of the carbon nanotube film, and n represents a sum of the total number of the first electrodes and the second electrodes.

7. The thermoacoustic device of claim 6, wherein the sound wave generator comprises a plurality of substantially similar stacked carbon nanotube films.

8. The thermoacoustic device of claim 6, wherein an input power of the thermoacoustic device is larger than 20 watts and less than 500 watts.

9. The thermoacoustic device of claim 6, wherein a sheet resistance of the at least one carbon nanotube film is in a range from about 800 Ohms to about 1000 Ohms.

10. The thermoacoustic device of claim 6, wherein the sound wave generator is a single carbon nanotube film, a sheet resistance of the single carbon nanotube film is about 1000 Ohms, and n satisfies $4 \leqq n \leqq 32$.

11. The thermoacoustic device of claim 10, wherein the working voltage is about 42 volts, and n satisfies $5 \leqq n \leqq 17$.

12. The thermoacoustic device of claim 10, wherein the working voltage is about 36 volts, and n satisfies $5 \leqq n \leqq 20$.

13. The thermoacoustic device of claim 10, wherein the working voltage is about 24 volts, and n satisfies $7 \leqq n \leqq 30$.

14. The thermoacoustic device of claim 6, wherein the sound wave generator is two stacked carbon nanotube films, a sheet resistance of each carbon nanotube film is 1000 Ohms, and n satisfies $3 \leqq n \leqq 32$.

15. The thermoacoustic device of claim 14, wherein the working voltage is about 42 volts, and n satisfies $4 \leqq n \leqq 12$.

16. The thermoacoustic device of claim 14, wherein the working voltage is about 36 volts, and n satisfies $4 \leqq n \leqq 14$.

17. The thermoacoustic device of claim 14, wherein the working voltage is about 24 volts, and n satisfies $6 \leqq n \leqq 21$.

18. A thermoacoustic device, the thermoacoustic device comprising:

a sound wave generator, the sound wave generator comprises a carbon nanotube structure, the carbon nanotube structure comprises a plurality of carbon nanotubes substantially parallel to each other;

a plurality of first electrodes electrically connected with each other;

a plurality of second electrodes electrically connected with each other, the plurality of second electrodes and the plurality of first electrodes are separately connected to the sound wave generator, the plurality of second electrodes and the plurality of first electrodes are parallel to each other and alternately arranged at uniform intervals, the plurality of carbon nanotubes is substantially perpendicular to the plurality of first electrodes and the plurality of second electrodes;

wherein a working voltage applied to the first and second electrodes is less than or equal to about 50 volts, and the sound wave generator and the first and second electrodes satisfy a formula consisting of $$1\Omega \leq \frac{R_1}{(n-1)^2} \leq 125\Omega,$$

wherein R1 represents a resistance of the sound wave generator in the direction from the plurality of first electrodes to the plurality of second electrodes, and n represents a sum of the total number of the first electrodes and the second electrodes.

19. The thermoacoustic device of claim 18, wherein an arranged direction of the carbon nanotubes is parallel to a surface of the carbon nanotube structure.

20. A thermoacoustic device, the thermoacoustic device comprising:

a sound wave generator, the sound wave generator comprises a plurality of carbon nanotube films stacked with each other;

a plurality of first electrodes electrically connected with each other;

a plurality of second electrodes electrically connected with each other; the plurality of second electrodes and the plurality of first electrodes are separately connected to the sound wave generator and electrically connected to the sound wave generator; each of the plurality of carbon nanotube films comprises a plurality of carbon nanotubes arranged substantially along a direction extending that is perpendicular to the plurality of first electrodes and the plurality of second electrodes; the plurality of second electrodes and the plurality of first electrodes are parallel to each other and are alternately arranged at uniform intervals;

wherein a working voltage applied to the first and second electrodes is less than or equal to about 50 volts, and the sound wave generator and the first and second electrodes satisfy a formula of $$1\Omega \leq \frac{R}{m(n-1)^2} \leq 125\Omega,$$

wherein R represents a resistance of each layer of the carbon nanotube films in the direction from the plurality of first electrodes to the plurality of second electrodes, m represents a total number of layers of the carbon nanotube films, and n represents a sum of the total number of the first electrodes and the second electrodes.

* * * * *